US012435946B2

(12) United States Patent
Otten

(10) Patent No.: US 12,435,946 B2
(45) Date of Patent: Oct. 7, 2025

(54) ARCHERY RELEASE AID HOLDER

(71) Applicant: Advanced Outdoor Technology LLC, San Jose, CA (US)

(72) Inventor: Paul D. Otten, San Jose, CA (US)

(73) Assignee: Avanced Outdoor Technology LLC, San Jose, CA (US)

( * ) Notice: Subject to any disclaimer, the term of this patent is extended or adjusted under 35 U.S.C. 154(b) by 263 days.

(21) Appl. No.: 17/944,934

(22) Filed: Sep. 14, 2022

(65) Prior Publication Data

US 2023/0003483 A1 Jan. 5, 2023

Related U.S. Application Data

(60) Continuation-in-part of application No. 17/411,501, filed on Aug. 25, 2021, now Pat. No. 11,725,900, which is a division of application No. 16/805,603, filed on Feb. 28, 2020, now Pat. No. 11,131,523.

(60) Provisional application No. 62/847,200, filed on May 13, 2019.

(51) Int. Cl.
*F41B 5/14* (2006.01)

(52) U.S. Cl.
CPC ..... *F41B 5/1469* (2013.01); *F41B 5/14* (2013.01); *B65D 2313/04* (2013.01)

(58) Field of Classification Search
CPC . F41B 5/14; F41B 5/1469; A47G 1/17; A45F 5/02; A63B 71/0036; B65D 2313/04
See application file for complete search history.

(56) References Cited

U.S. PATENT DOCUMENTS 2,679,740 A * 6/1954 Seletzky ..... F23Q 2/365 431/129
2,954,874 A 10/1960 Rouse
3,337,100 A * 8/1967 Berning ..... B26B 29/025 224/183
3,895,621 A 7/1975 Kellog
4,168,129 A 9/1979 Herrnring
4,826,059 A * 5/1989 Bosch ..... A45C 11/24 211/DIG. 1
4,919,107 A 4/1990 Bunts
5,025,966 A * 6/1991 Potter ..... A45F 5/02 224/183
5,064,159 A * 11/1991 Kotick ..... A47G 29/08 248/309.4
5,181,609 A * 1/1993 Spielmann ..... A61B 50/362 206/370
5,209,694 A 5/1993 Utt, Jr.
5,760,668 A * 6/1998 Testa ..... B23Q 3/1546 211/DIG. 1

(Continued)

FOREIGN PATENT DOCUMENTS

WO WO 2017213628 A1 12/2017

*Primary Examiner* — John A Ricci
(74) *Attorney, Agent, or Firm* — Robert Moll

(57) ABSTRACT

An archery release aid mount includes an attachment mechanism configured to rigidly attach the archery release aid to a bow. A securing device is configured to receive an archery release aid. The securing device includes a securing device that upon the archery release aid mount receiving the archery release aid, holds the archery release aid securely, and that is configured to allow a user to without tools remove the archery release aid from the archery release aid mount when the user wants to use the archery release aid during archery.

12 Claims, 88 Drawing Sheets

(56) References Cited

U.S. PATENT DOCUMENTS 6,085,916 A 7/2000 Kovacevic et al.
6,305,656 B1 10/2001 Wemyss
6,394,677 B2 5/2002 Wang
6,520,663 B1 2/2003 Holmes et al.
6,520,863 B2 * 2/2003 Porper ..... A63D 15/16 224/183
6,612,299 B2 9/2003 Martin et al.
6,889,683 B1 5/2005 Smith
7,100,591 B2 9/2006 Terry
7,299,795 B2 11/2007 Brannen
7,775,201 B2 * 8/2010 Cooper ..... F41B 5/14 224/916
7,789,229 B2 9/2010 Frakes
8,065,994 B2 11/2011 Holmberg
8,297,569 B2 10/2012 Kuhn et al.
8,596,256 B2 12/2013 McPherson
8,622,050 B2 1/2014 Goff et al.
8,839,776 B2 9/2014 Kingsbury et al.
8,893,701 B1 11/2014 Entrup
9,210,996 B1 * 12/2015 Kramer ..... A46B 17/02
9,915,491 B2 3/2018 Perry
10,390,661 B1 * 8/2019 Steingraber ..... A47G 21/14
11,131,523 B2 9/2021 Otten
11,725,900 B2 8/2023 Otten
2002/0130231 A1 * 9/2002 Winnard ..... B25H 3/04 248/206.5
2002/0175100 A1 * 11/2002 Holland ..... B25H 3/00 224/183
2008/0110951 A1 * 5/2008 Lauri ..... A45F 5/02 224/183
2010/0018512 A1 1/2010 Sandel
2011/0139732 A1 * 6/2011 Cabanban ..... A47G 29/087 211/13.1
2012/0125306 A1 5/2012 Kempf
2013/0119098 A1 * 5/2013 Stiefel ..... A45F 5/021 224/663
2013/0288743 A1 * 10/2013 Hunt ..... F16M 11/2014 29/434
2014/0224847 A1 * 8/2014 Miller ..... F41C 33/0263 224/183
2020/0363156 A1 11/2020 Otten
2021/0381795 A1 12/2021 Otten

* cited by examiner

SECTION D-D
SCALE 1 : 1

DETAIL D
SCALE 2 : 1

SECTION E-E
SCALE 2 : 1

DETAIL F
SCALE 8 : 1

SECTION C-C
SCALE 2 : 1

SECTION J-J

SECTION M-M

SECTION N-N

ARCHERY RELEASE AID HOLDER

This is a continuation-in-part application of U.S. application Ser. No. 17/411,501, filed on Aug. 25, 2021, which is a divisional of U.S. application Ser. No. 16/805,603, filed on Feb. 28, 2020, issued as U.S. Pat. No. 11,131,523 B2 on Sep. 28, 2021, which claimed the benefit of U.S. Provisional Application 62/847,200, filed on May 13, 2019, which are all hereby incorporated by reference in their entireties.

BACKGROUND

In archery, an archery release aid typically uses a trigger mechanism to release the bow string resulting in more precise firing of arrows. The archery release aid allows a quick release of the bowstring while reducing the amount of torque placed upon the bow string.

Archers may store an archery release aid in a pouch or holster or holder clipped on to a belt or a piece of clothing. A binocular harness can also be used to carry an archery release aid.

SUMMARY OF THE INVENTION

The present invention relates to an archery release aid mount for releasably securing an archery release aid. In a feature, the mount adapted to secure to the bow, includes a box shaped holder with an open top and a partly closed bottom and uses magnet(s) to releasably secure an archery release aid. In another feature, the holder substantially conforms to the release aid. In other features, the holder include an open bottom side and a closed bottom side and side walls that define a L-shape surface. In still another feature, the holder has a strap wall that includes strap hole and peg to secure the holder to the user.

DETAILED DESCRIPTION

The following description includes the best mode of carrying out the invention. The detailed description illustrates the principles of the invention and should not be taken in a limiting sense. The scope of the invention is determined by reference to the claims.

Figure 1:
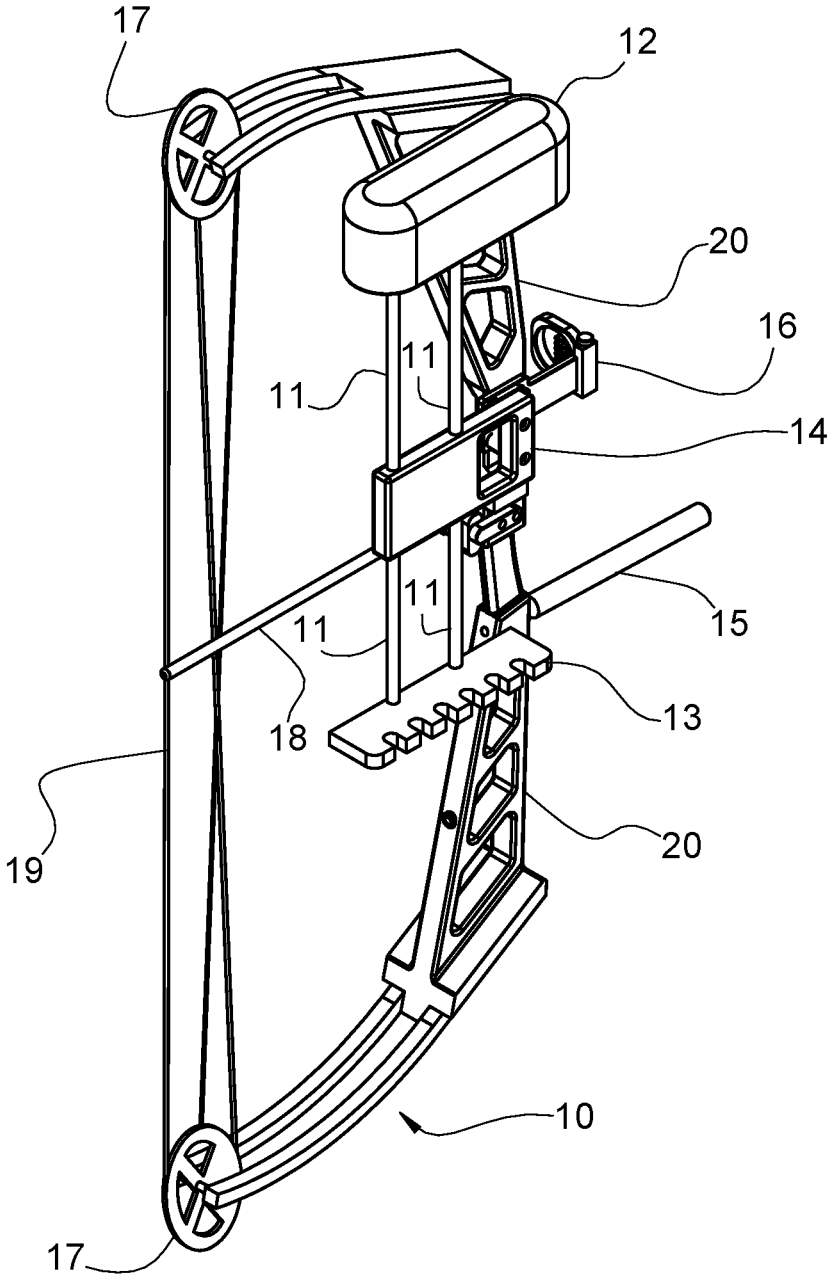
FIGURE 1 (PRIOR ART)
FIG. 1, FIG. 2 and FIG. 3 show a bow that includes various accessories in accordance with the prior art.
Figure 2:
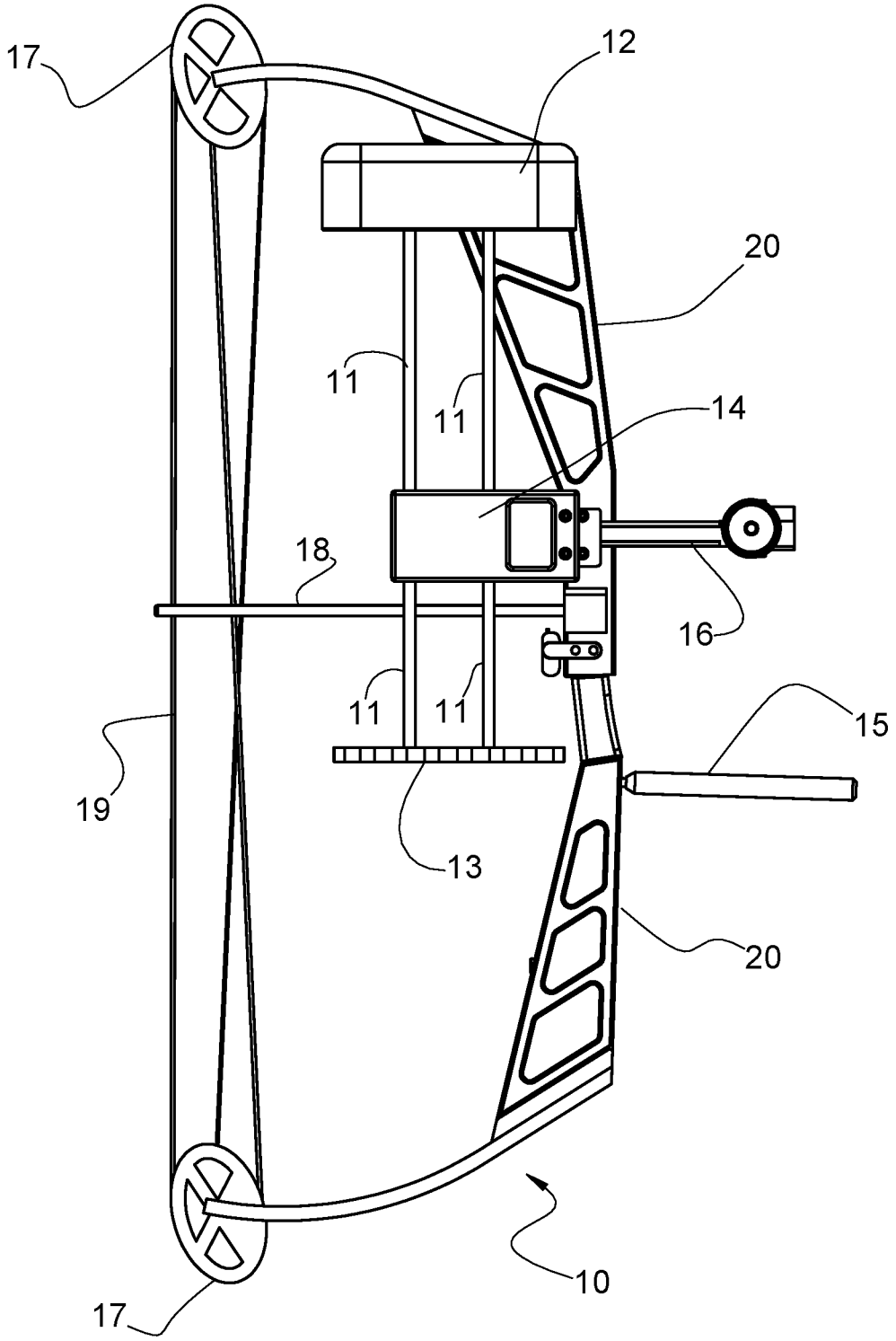
FIGURE 2 (PRIOR ART)

FIG. 1 and FIG. 2 show a bow 10 that is a bow assembly that includes a bow frame and various incorporated or attached parts and accessories. For example, a quiver includes a top structure 12, quiver support shafts 11, a quiver midsection 14 and quiver arrow retainer structure 13. For example, quiver arrow retainer structure 13 includes quiver retainers implemented using clips. A fixed pin sight 16 is attached to the bow frame. A stabilizer 15 is attached to a bow riser 20. Bow riser 20 forms the bow frame for the bow.

Cams 17 store energy in the limbs of the bow. Bow 10 include a bowstring 19. A cable guide 18 keeps the cables out of the path of the arrow. A stabilizer 15 is attached to one of bow riser 20.

Figure 3:
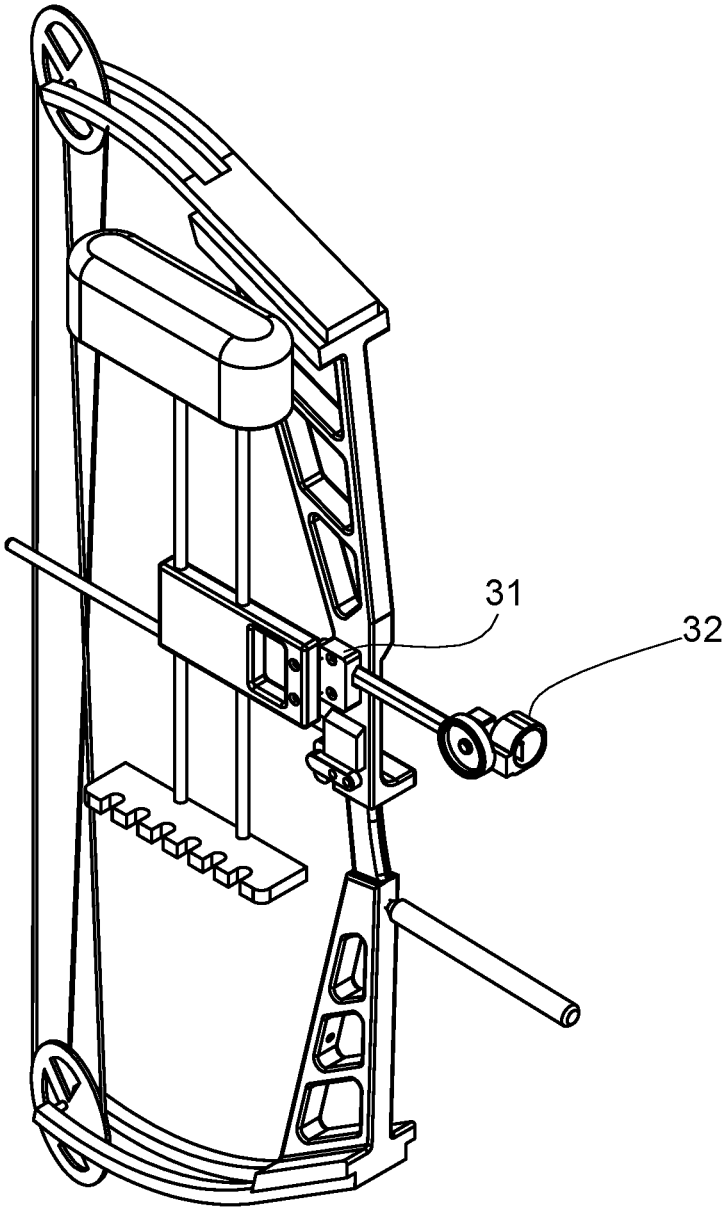
FIGURE 3 (PRIOR ART)

FIG. 3 shows a slightly different configuration of bow 10 where a fixed pin sight 16 has been replaced with an adjustable sight 32 attached to bow 10 using a dove tail sight mount 31.

Figure 4:
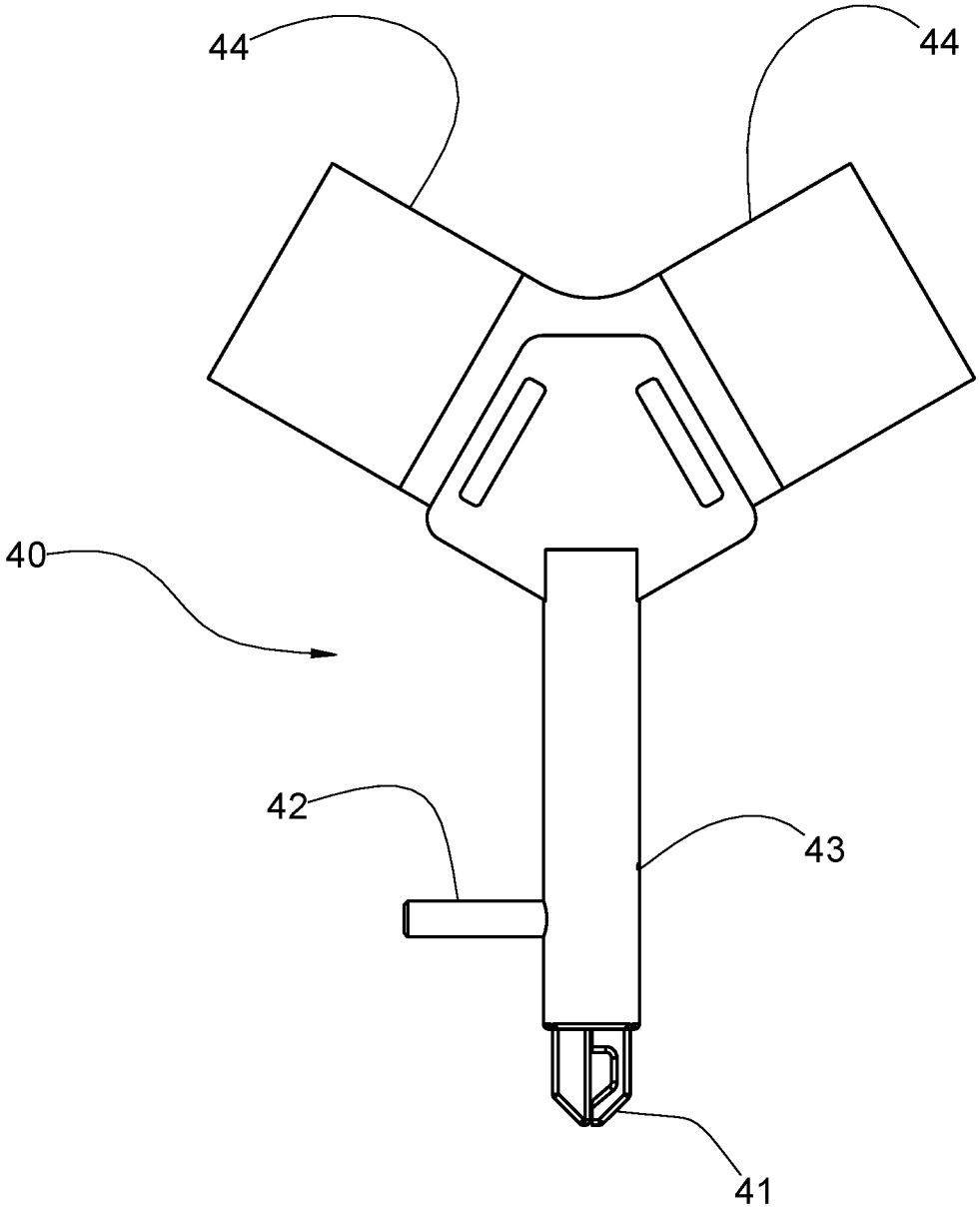
FIGURE 4 (PRIOR ART)
FIG. 4, FIG. 5, FIG. 6, FIG. 7, and FIG. 8 show archery release aids in accordance with the prior art.
Figure 5:
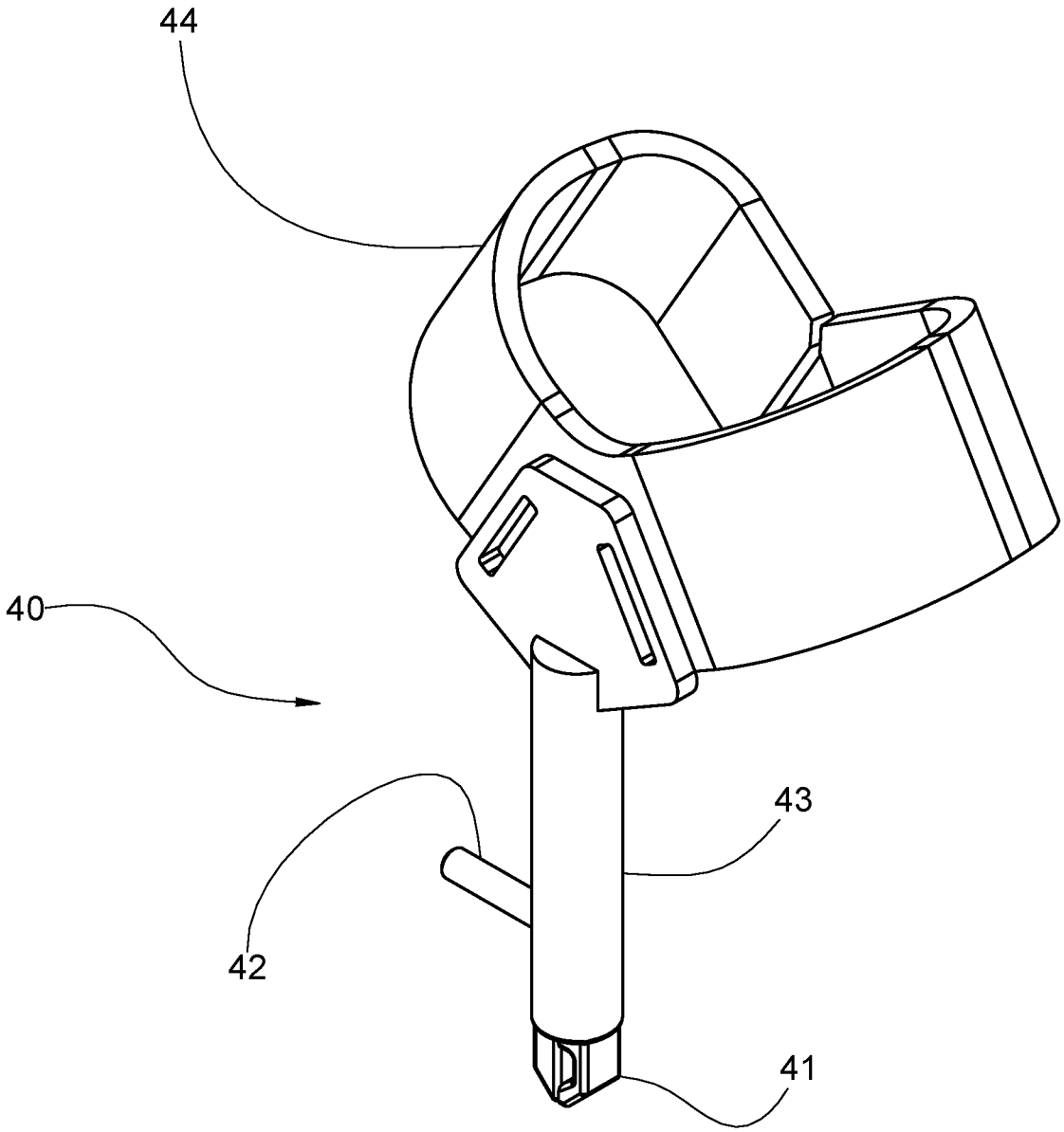
FIGURE 5 (PRIOR ART)

FIG. 4 and FIG. 5 show an archery release aid 40 that includes a wrist strap 44, a body 43, a trigger 42 and jaws 41. Jaws 41 are used for capturing bow string 19.

Figure 6:
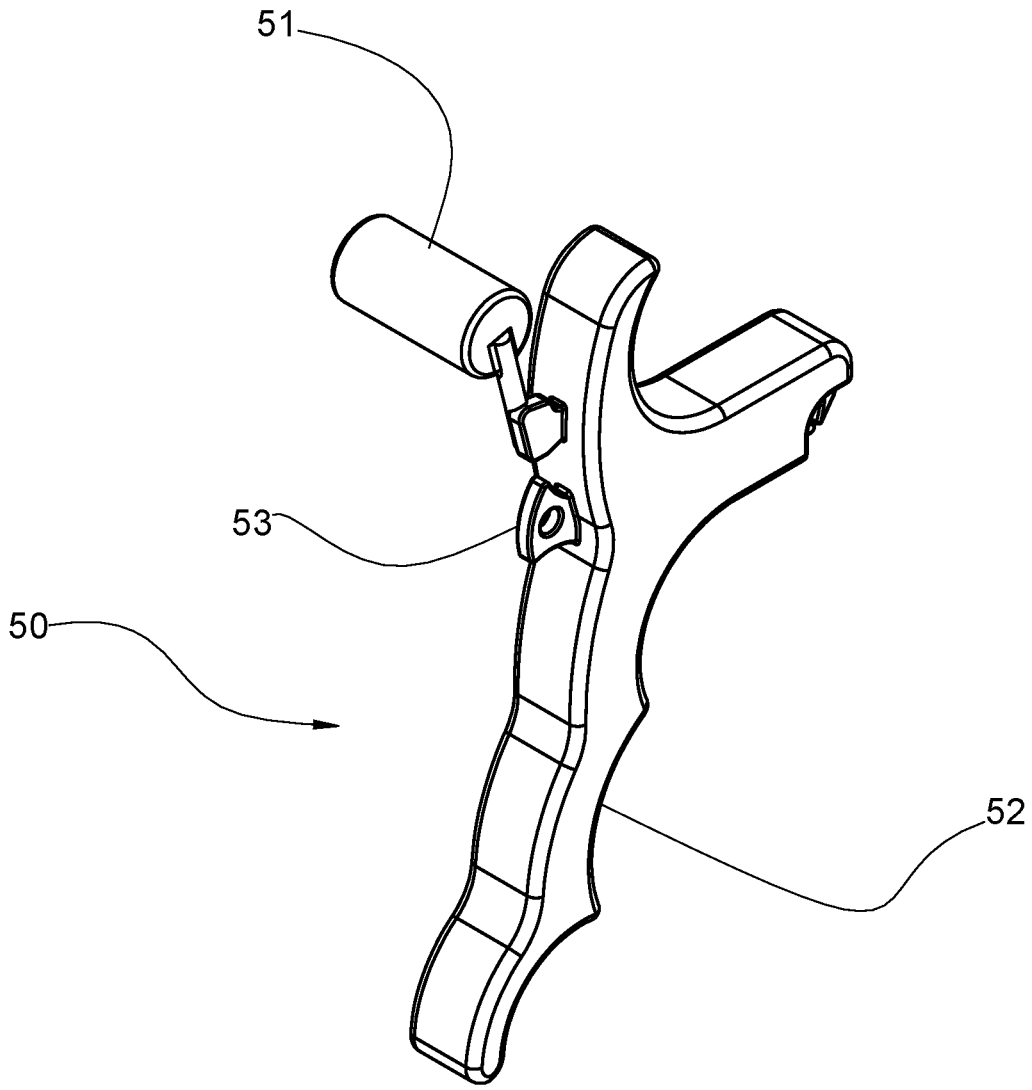
FIGURE 6 (PRIOR ART)
Figure 7:
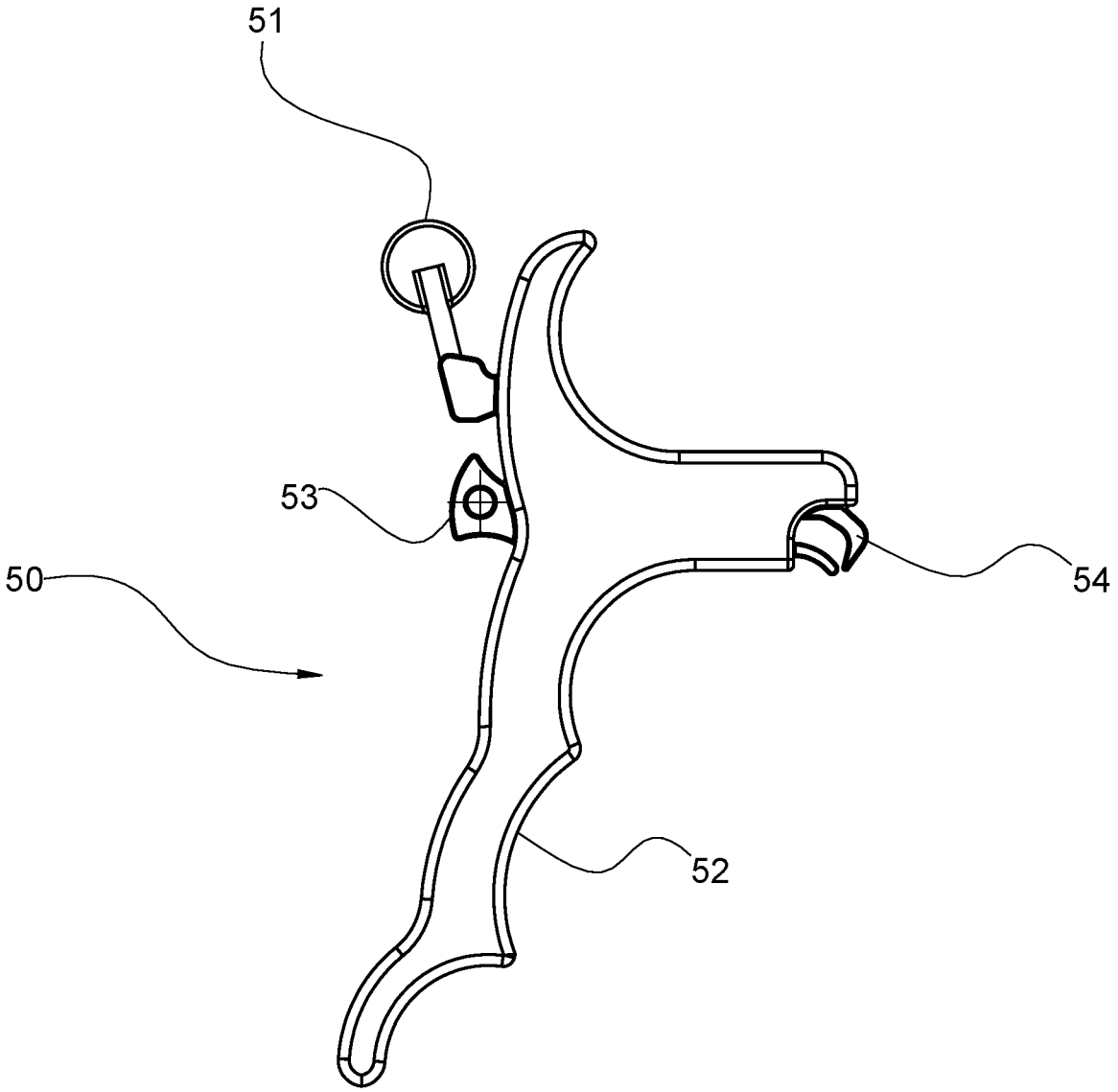
FIGURE 7 (PRIOR ART)
Figure 8:
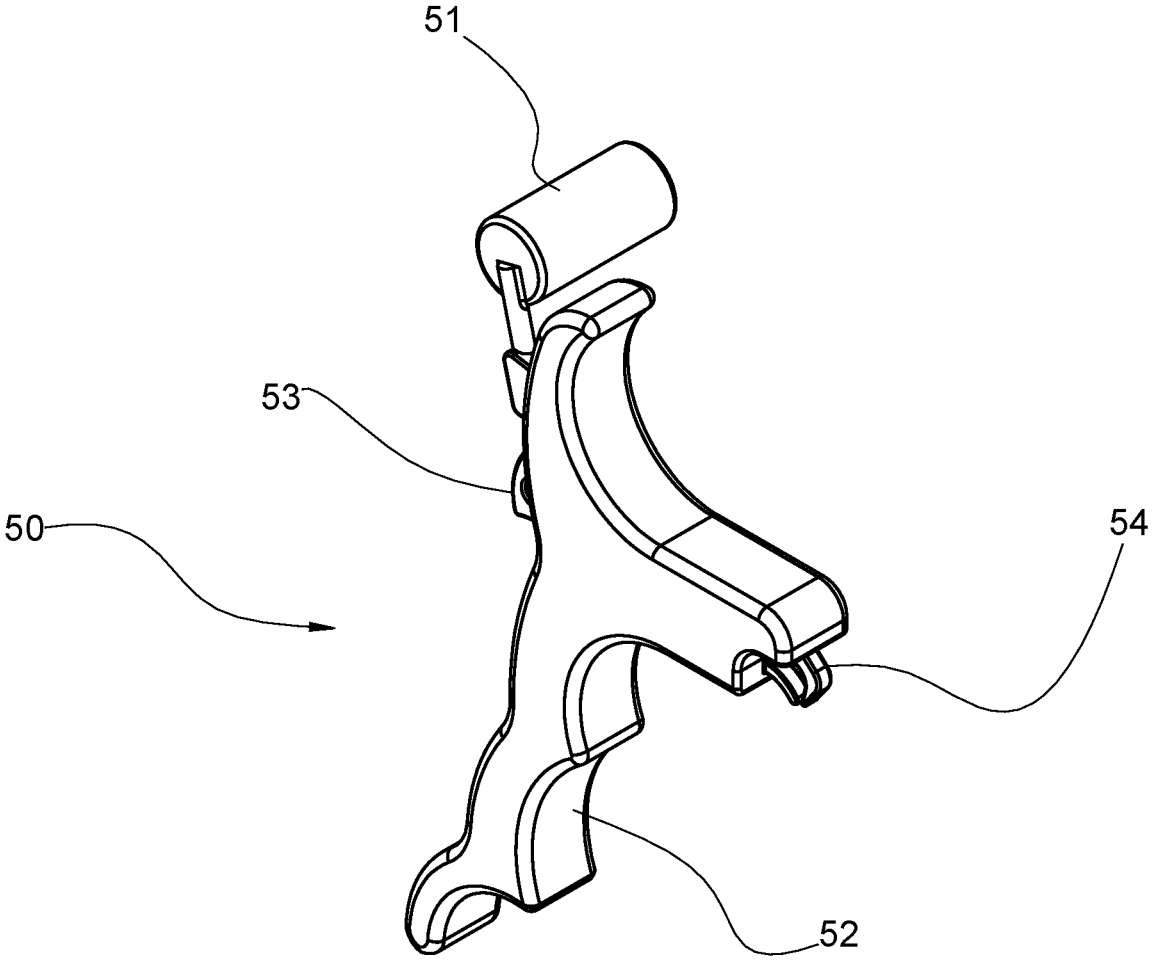
FIGURE 8 (PRIOR ART)

FIG. 6, FIG. 7 and FIG. 8 show an archery release aid 50 that includes a thumb trigger 51, a mechanical reset 53, a structure 52 with contours for fingers 52 and jaws 54 that are used to capture bow string 19.

Figure 9:
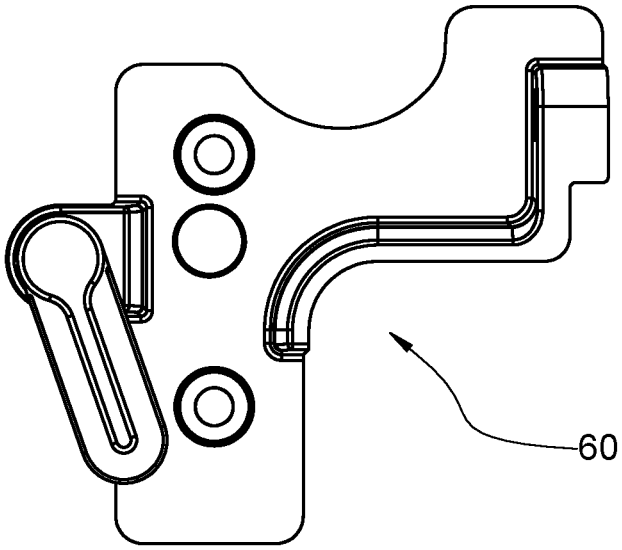
FIG. 9, FIG. 10, FIG. 11, FIG. 12, FIG. 13, FIG. 14 and FIG. 15 show archery release aid mounts in accordance with preferred implementations.

FIG. 9 shows an archery release aid mount 60 optimized to hold a Carter/Nockon Silverback back tension archery release aid available from Nock on Archery and is manufactured by Carter enterprises.

Figure 10:
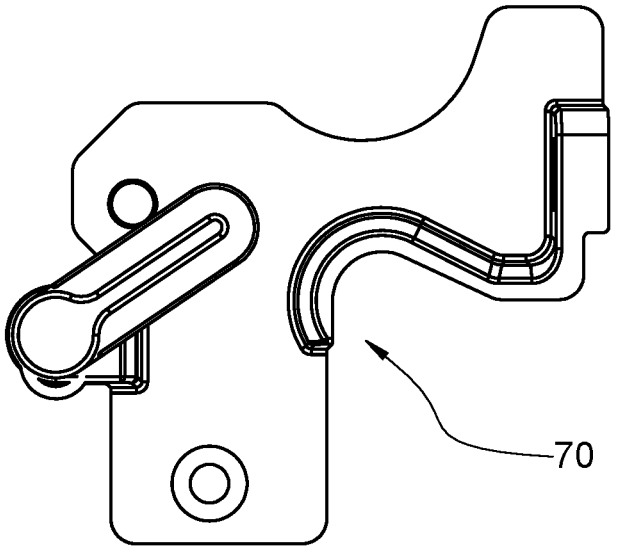

FIG. 10 shows an archery release aid mount 70 optimized to hold a Carter "Nock 2it" archery release aid available from Nock on Archery and manufactured by Carter enterprises.

Figure 11:
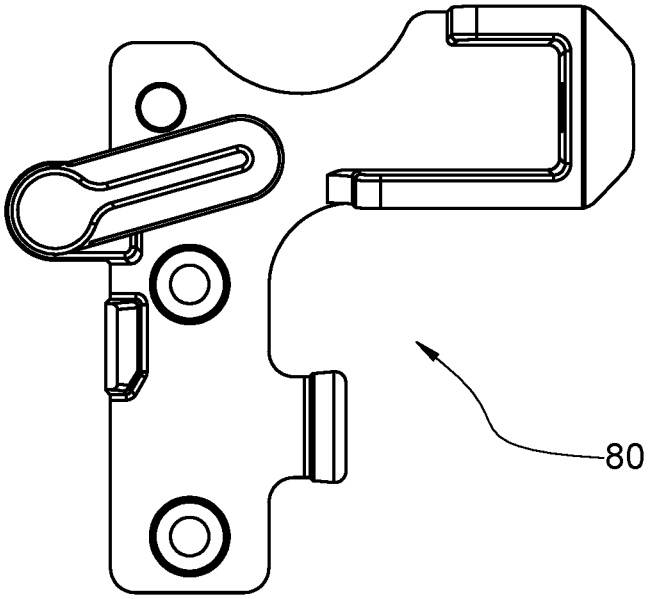

FIG. 11 shows an archery release aid mount 80 optimized to hold a Stan PerfX archery release aid available from Stanislawski Archery Products.

Figure 12:
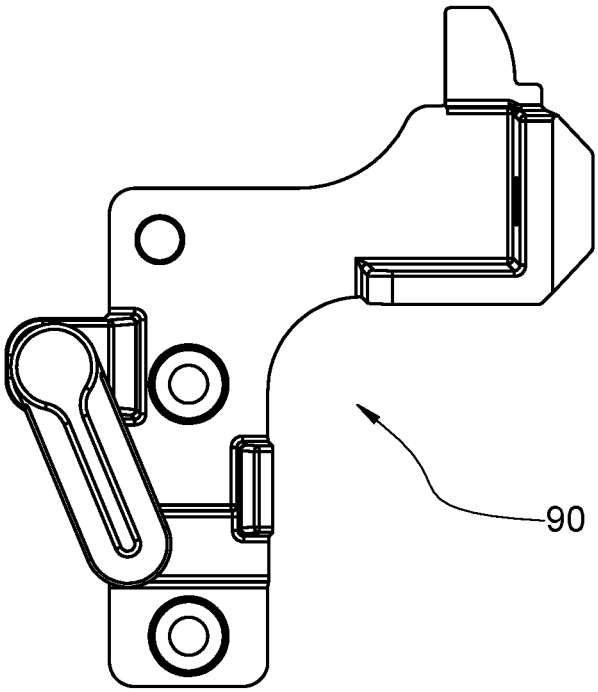

FIG. 12 shows an archery release aid mount 90 optimized to hold a Scott Sigma Release available from Scott Archery.

Figure 13:
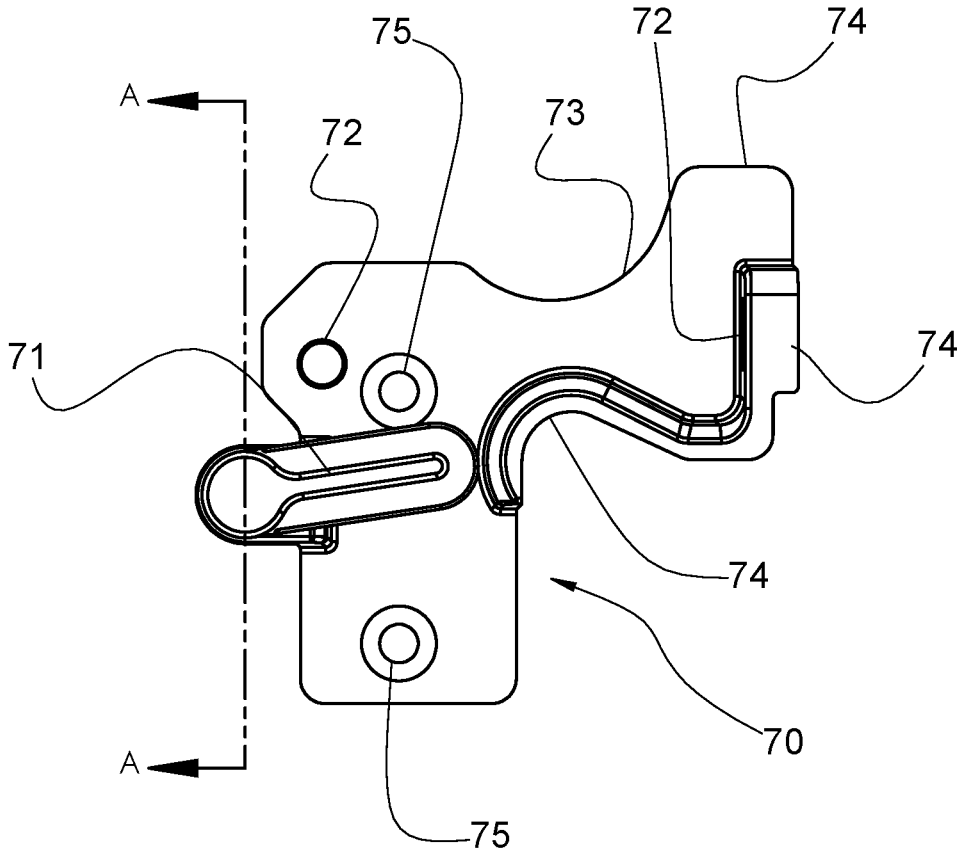
Figure 14:
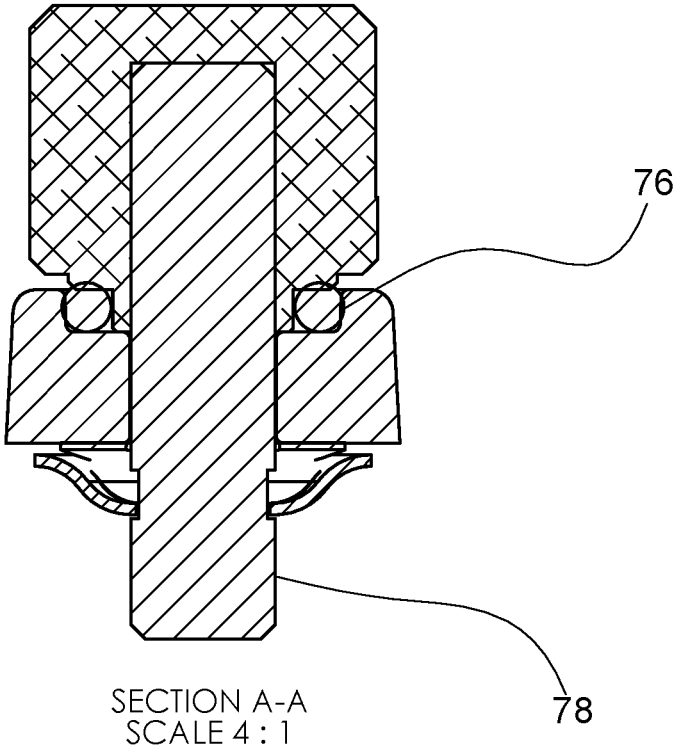
Figure 15:
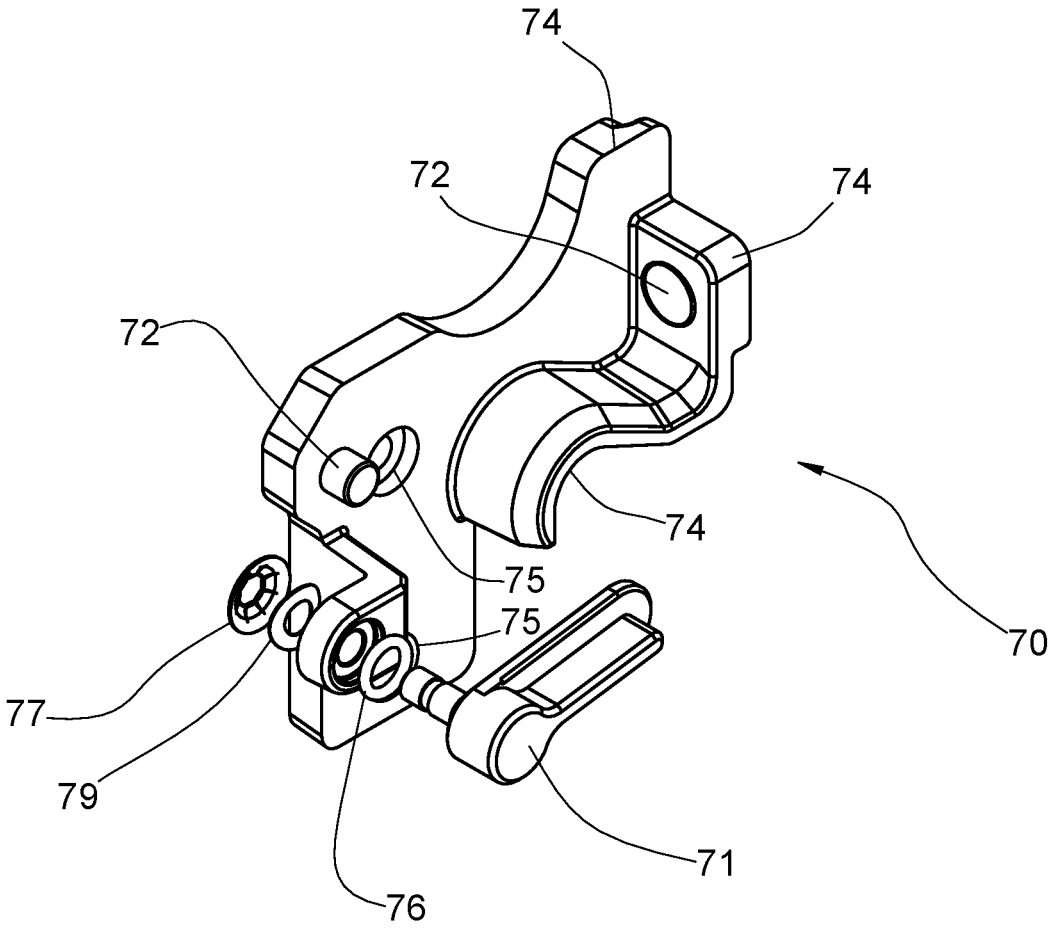

FIG. 13, FIG. 14 and FIG. 15 show that archery release aid mount 70 includes a locking lever 71 with a tab 78, magnets 72, a structure 74 with hand clearance area 73, mounting holes 75, an O-ring 76, a spring washer 79 and a retaining ring 77 that fastens onto rod 78. As illustrated by FIG. 14, O ring 76 creates friction to keep tab 78 in position. Locking lever 71 and magnets 72 serve as securing devices of a mounting mechanism that upon the archery release aid mount 70 receiving an archery release aid, hold the archery release aid securely, and that is configured to allow a user to without tools remove the archery release aid from archery release aid mount 70 when the user wants to use the archery release aid during archery.

Figure 16:
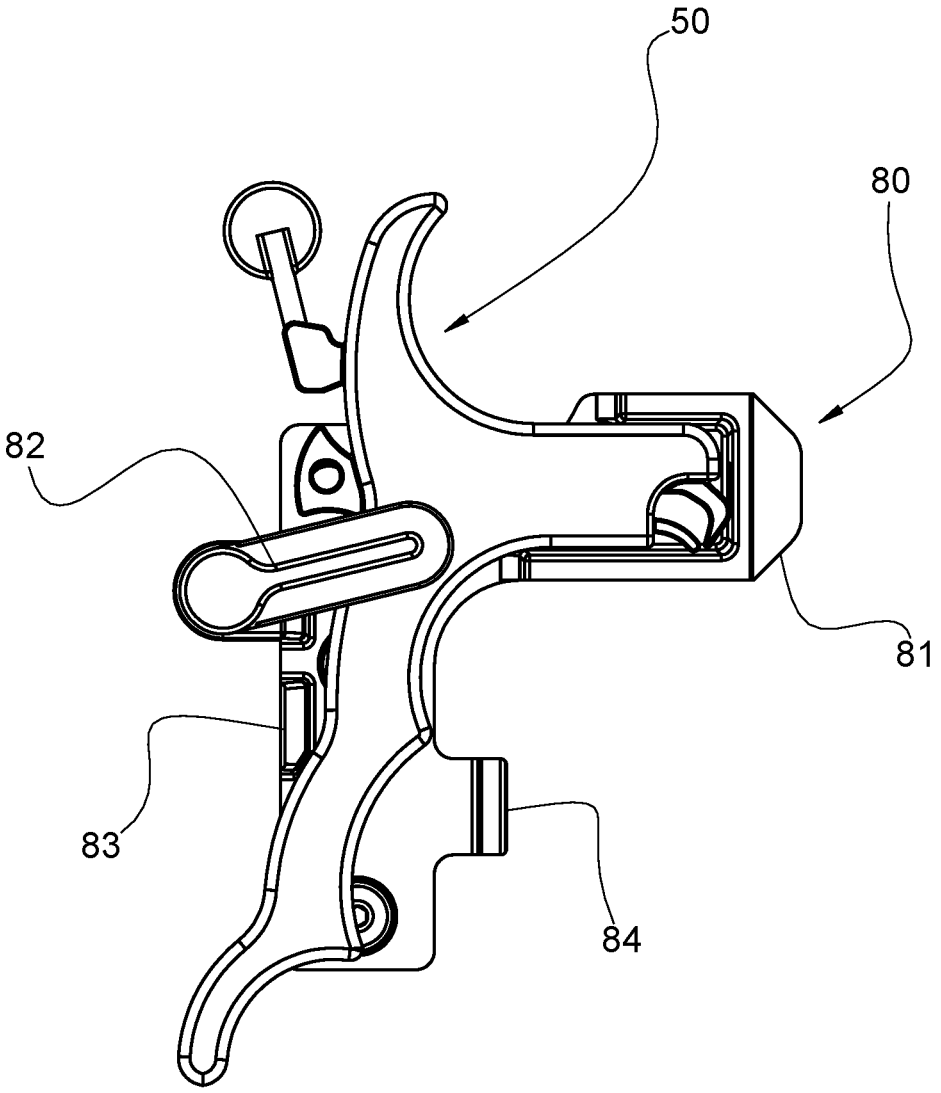
FIG. 16 and FIG. 17 show an archery release aid stored within an archery release aid mount in accordance with an implementation.
Figure 17:
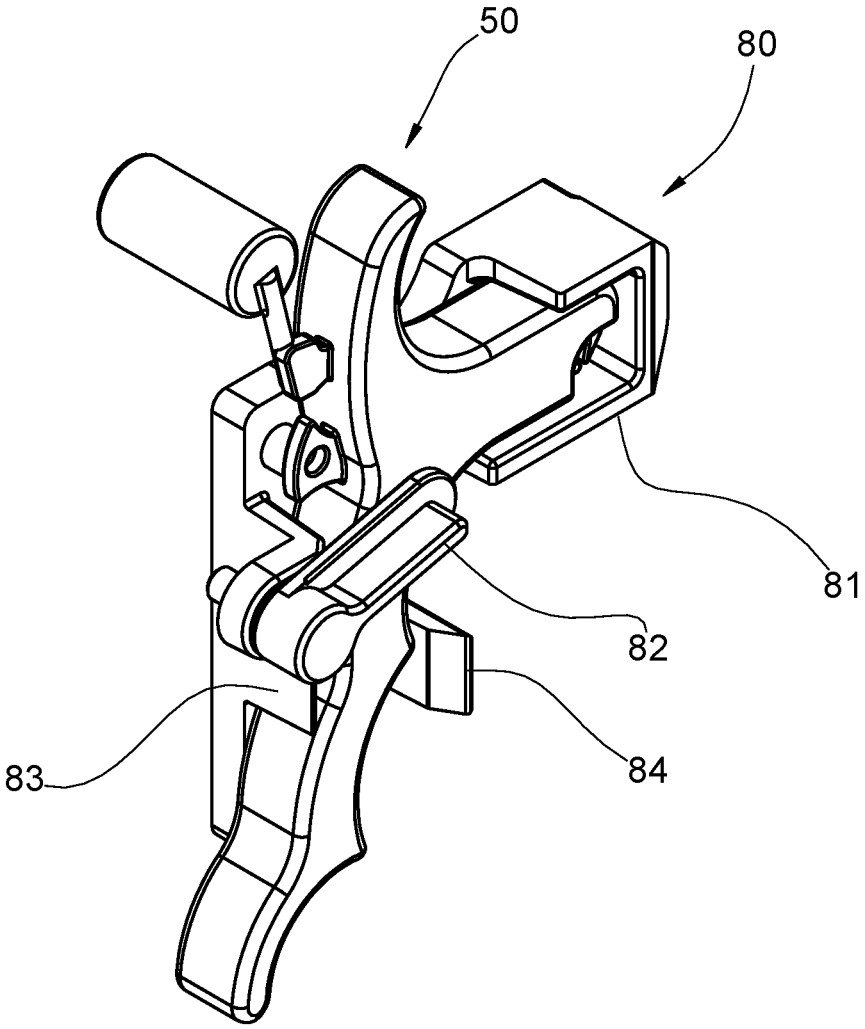
Figure 18:
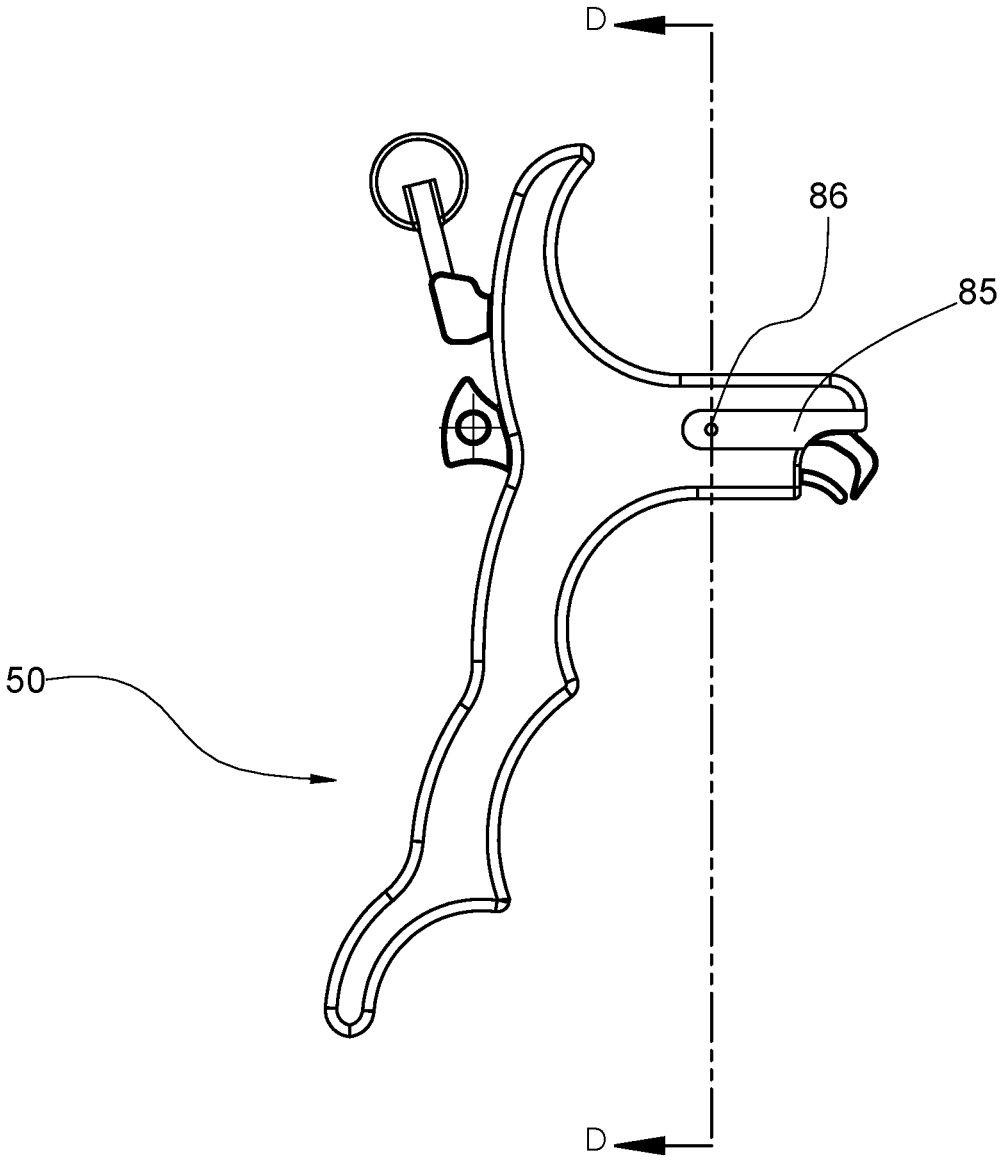
FIG. 18, FIG. 19, FIG. 20 and FIG. 21 shows an archery release aid modified to be better stored within an archery release aid mount in accordance with an implementation.
Figure 19:
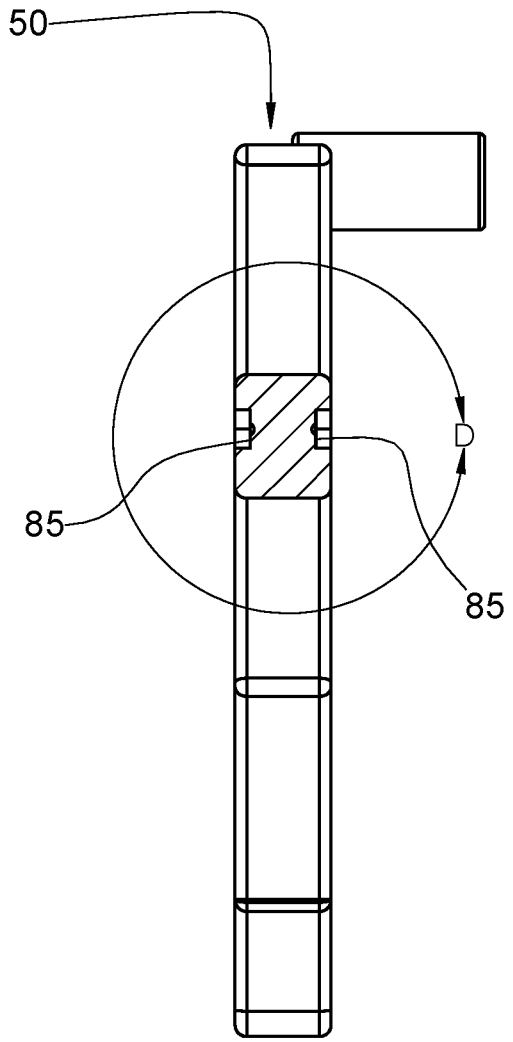
Figure 20:
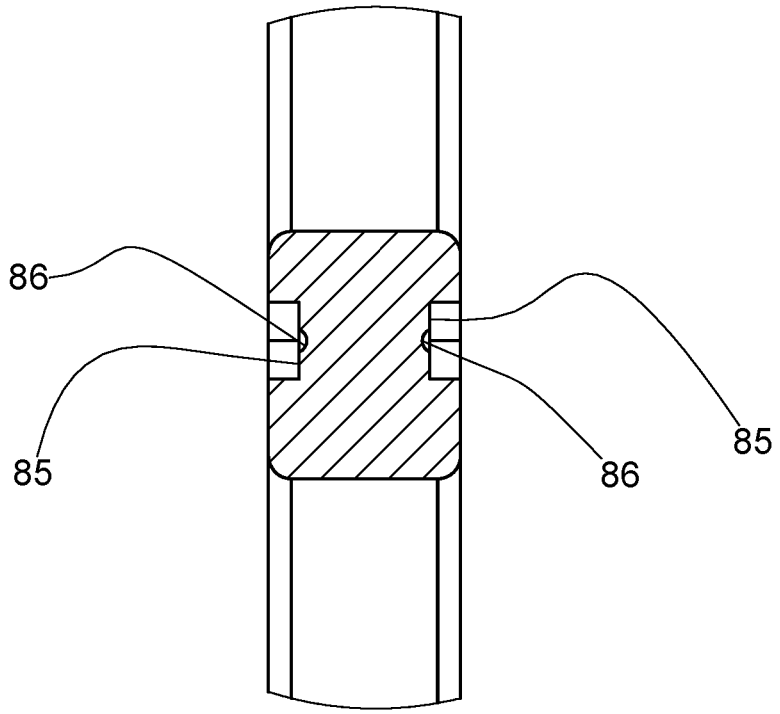
Figure 21:
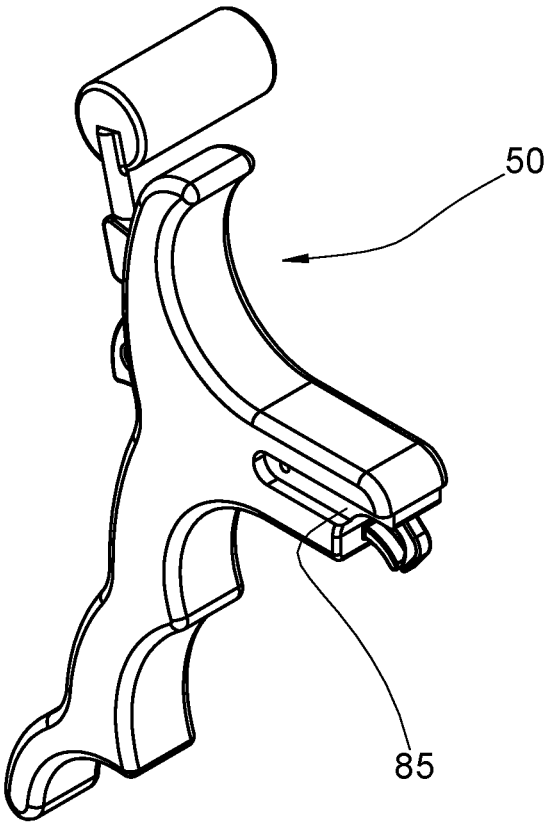
Figure 22:
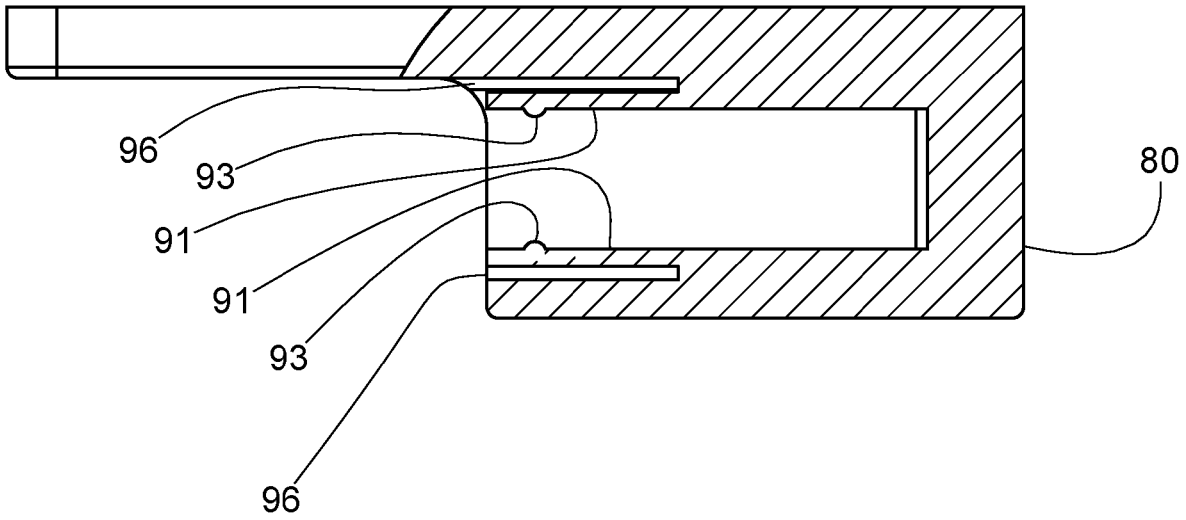
FIG. 22, FIG. 23, FIG. 24, FIG. 25, FIG. 26, FIG. 27 and FIG. 28 show modification to archery release aid mounts to better hold archery release aids in accordance with preferred implementations.
Figure 23:
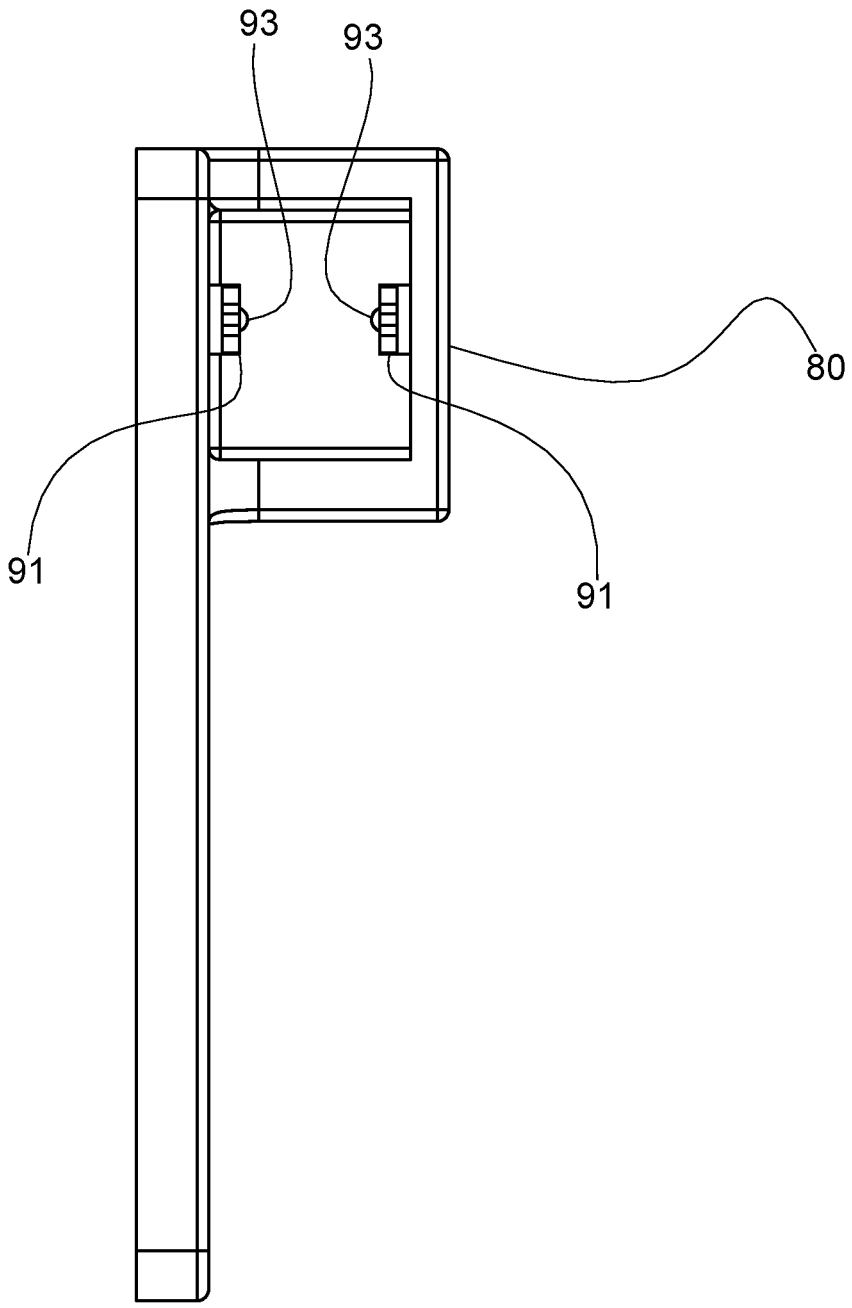
Figure 24:
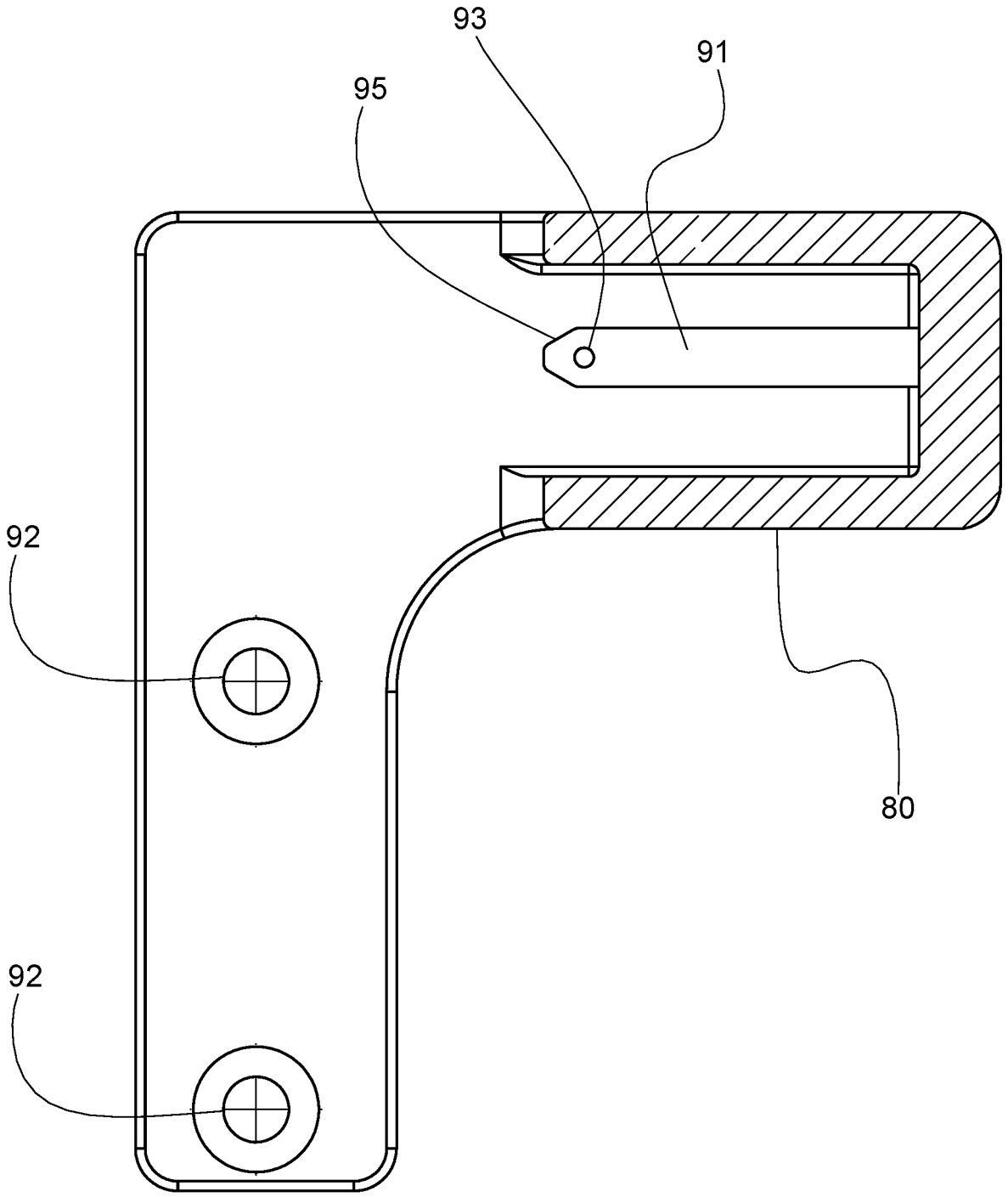
Figure 25:
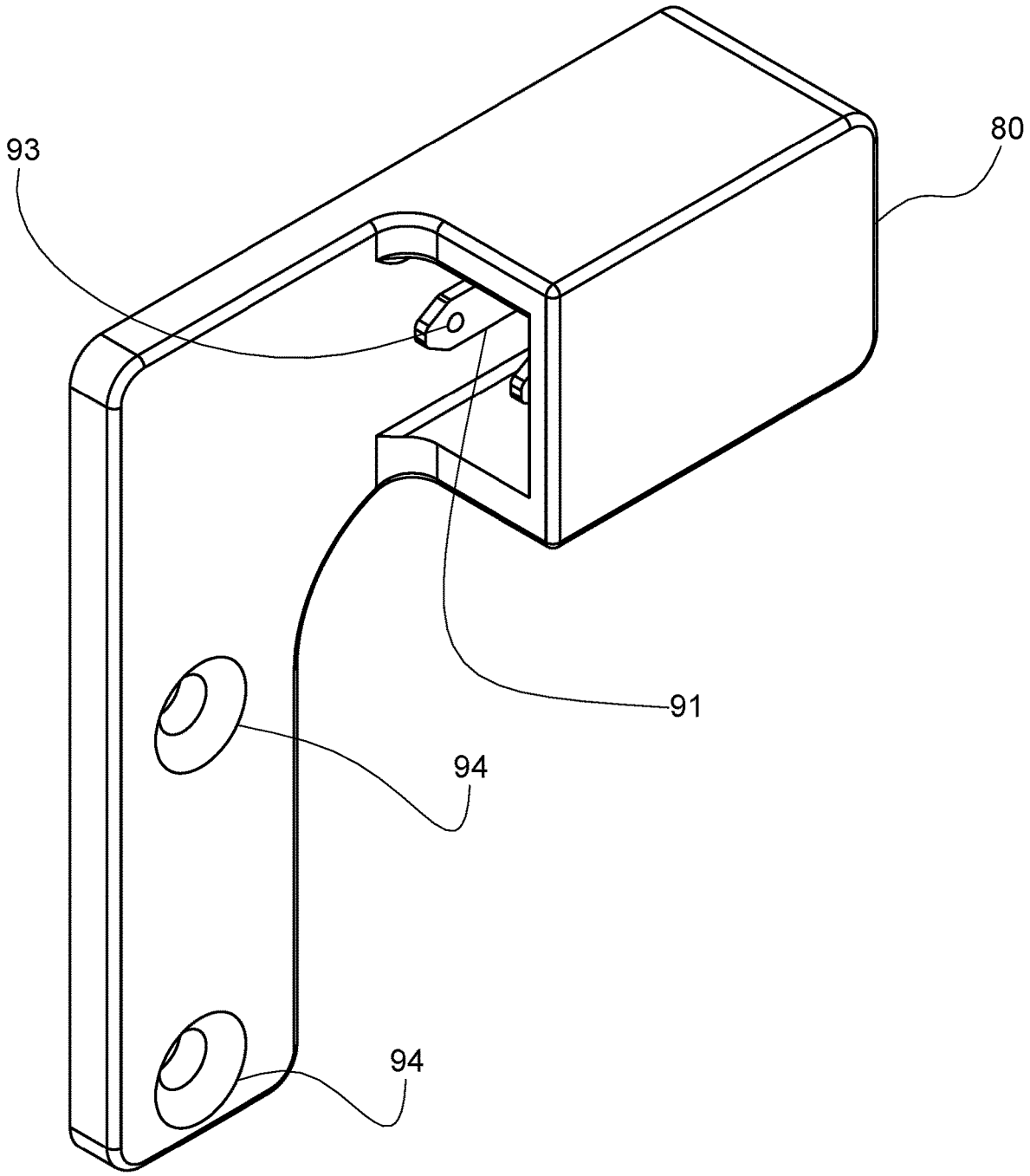

FIG. 16 and FIG. 17 show archery release aid 50 mounted within archery release aid mount 80. A lever 82 keeps archery release aid securely held within structure 81 of archery release aid mount 80. In various embodiments, changes can be made to archery release aid mount 80 to accommodate configuration changes to archery release aid mount 50. For example, lever 82 can be designed to lock in an open or a closed position. A tab 83 and a tab 84 can also be designed to adjust locations to accommodate configuration changes to archery release aid mount 50.

FIG. 18, FIG. 19, FIG. 20 and FIG. 21 show grooves 85 added to one or both sides of archery release aid 50. Grooves 85 are used to interface with archery release aid mount 80 to create a solid but easily removable mounting feature. Additionally, spherical indentations 86 can be added to interface with a spherical protrusions in archery release aid mount 80. This allows archery release aid mount 80 to hold securely archery release aid 50 while also allow a user to easily remove archery release aid 50 from archery release aid mount 80.

FIG. 22, FIG. 23, FIG. 24, and FIG. 25 show archery release aid mount 80 configured to include protrusions 91 and spherical protrusions 93. Protrusions 91 are sized to fit within grooves 85 of archery release aid 50. Spherical protrusions 93 are sized to fit within spherical indentations 86. A relief area 96 behind protrusions s 91 allow deflection so that spherical protrusions lock in place within spherical indentions 86. Tapers 95 at the end of protrusions 91 aid alignment when placing archery release aid 50 within archery release aid mount 80. Screw holes 94, shaped to receive screws 92, are used to attached archery release aid mount 80 to a bow. Protrusions 91 and spherical protrusions 93 serve as securing devices of a mounting mechanisms that upon the archery release aid mount 80 receiving an archery release aid, hold the archery release aid securely, and that is configured to allow a user to without tools remove the archery release aid from archery release aid mount 80 when the user wants to use the archery release aid during archery.

Figure 26:
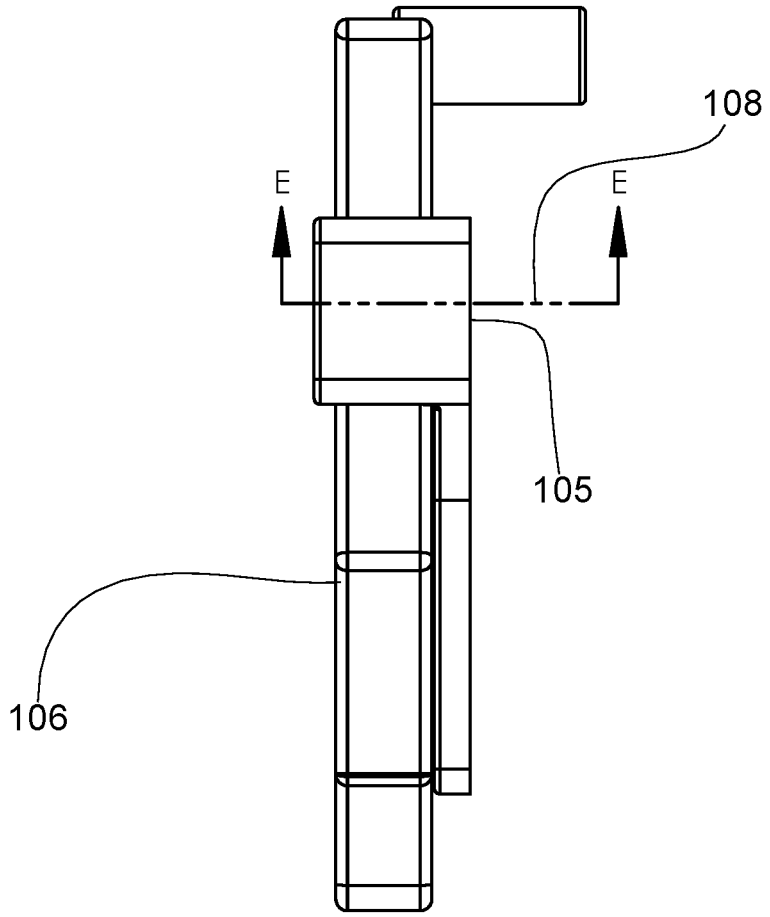

FIG. 26 shows an archery release aid 106 held by an archery release aid mount 105.

Figure 27:
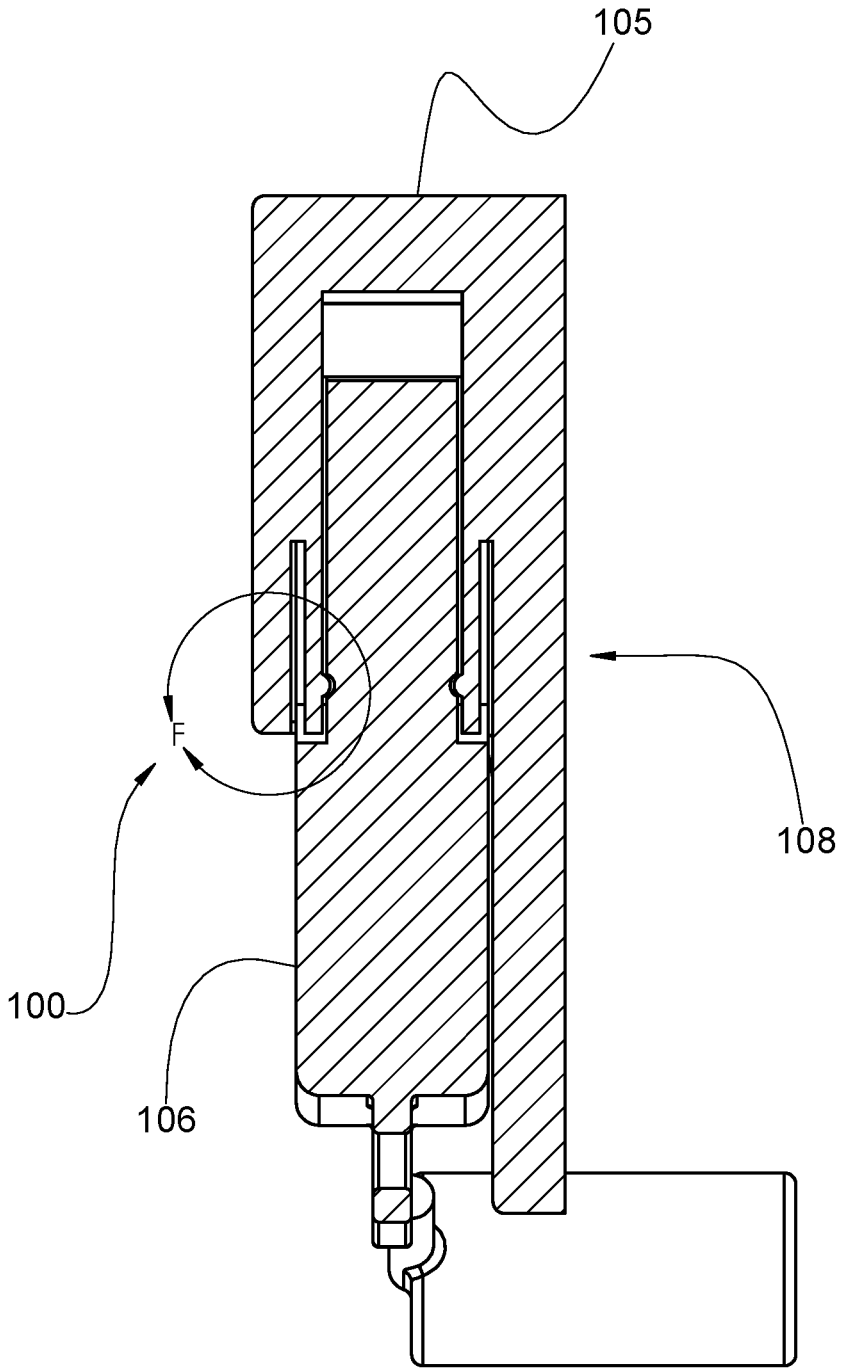

FIG. 27 shows a cross section 108 of archery release aid 106 and archery release aid mount 105.

Figure 28:
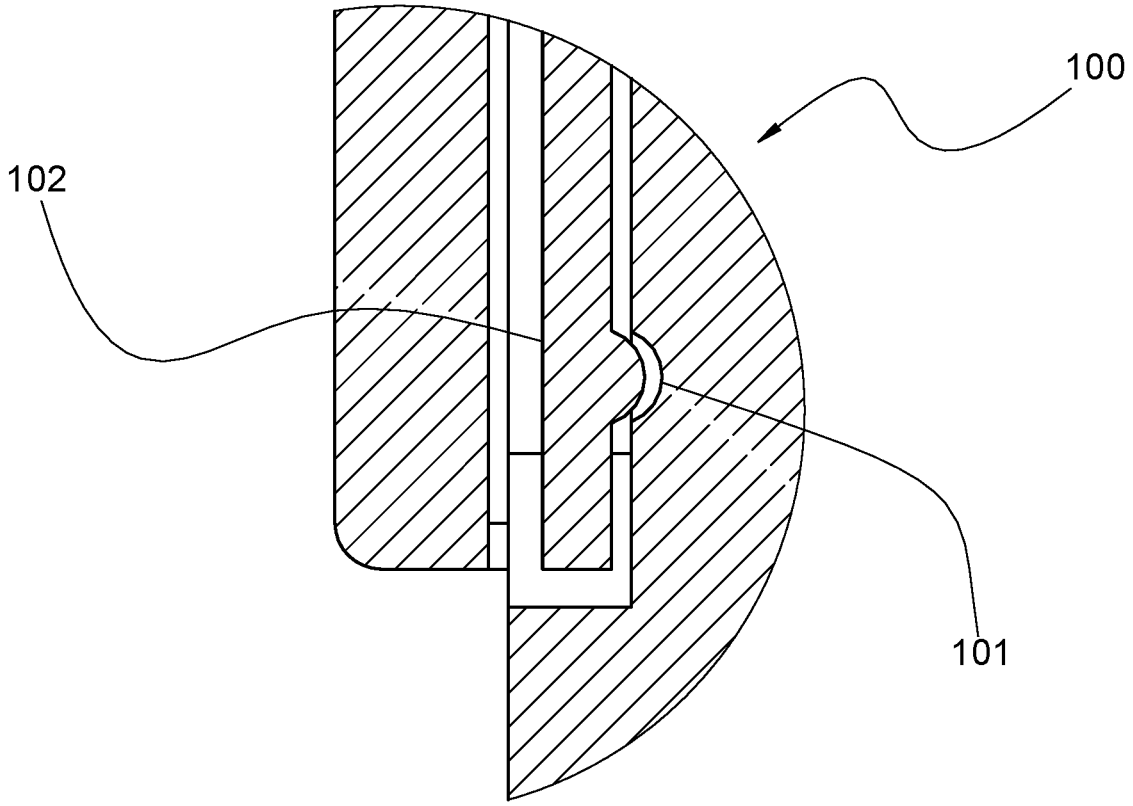

FIG. 28 shows a close up section 100 of cross section 108. A flange 102 has a ball and socket detente interface which secures archery release aid 106 to archery release aid mount 105, but allows archery release aid 106 to be easily removed from archery release aid mount 105 by the user. The ball and socket détente interface serves as a securing device of a mounting mechanisms that upon the archery release aid mount 106 receiving an archery release aid, holds the archery release aid securely, and that is configured to allow a user to without tools remove the archery release aid from archery release aid mount 106 when the user wants to use the archery release aid during archery.

Figure 29:
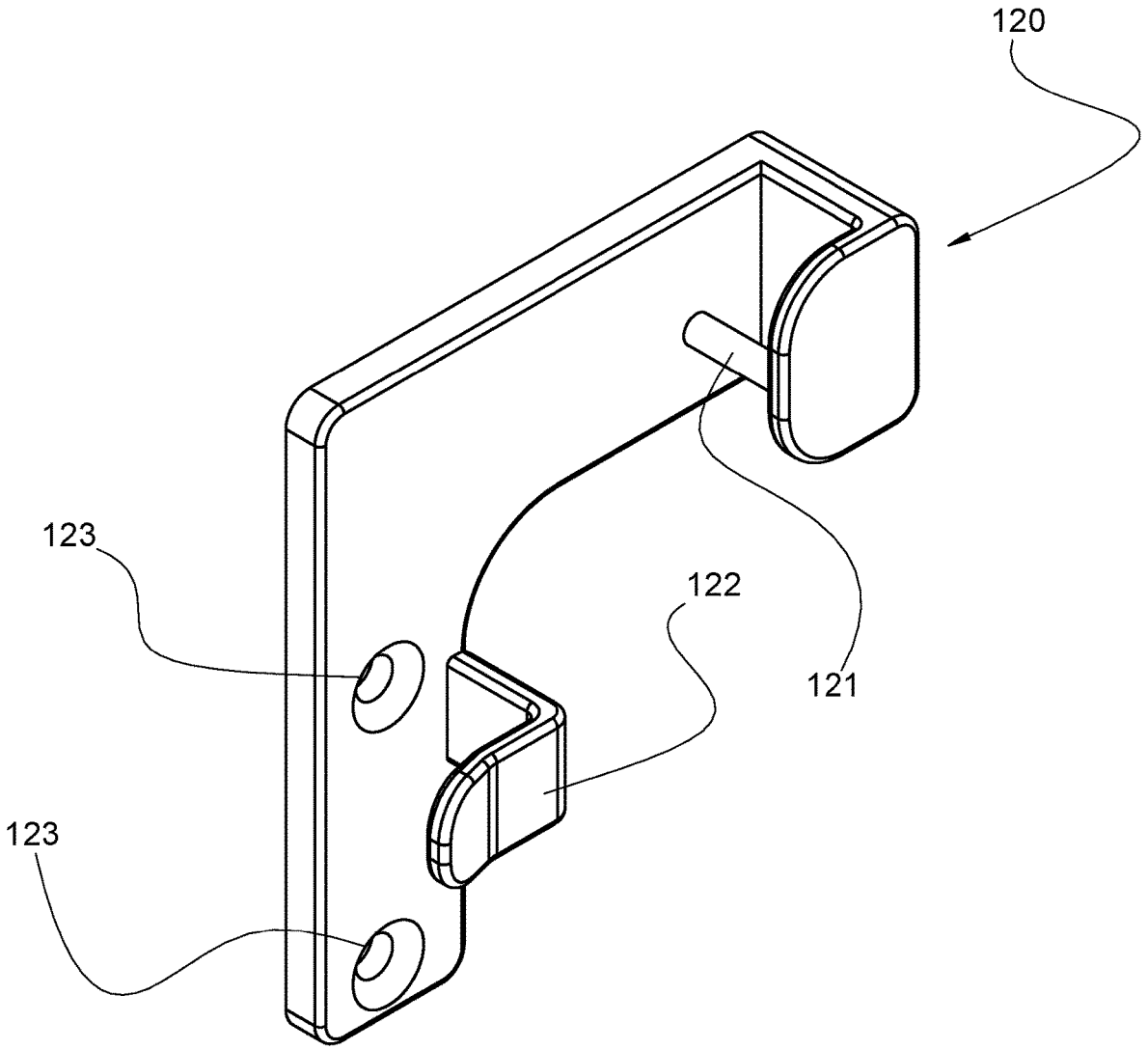
FIG. 29, FIG. 30, FIG. 31, FIG. 32, FIG. 33, FIG. 34, FIG. 35, FIG. 35A and FIG. 36 show additional archery release aid mounts in accordance with preferred implementations.

FIG. 29 shows an archery release aid mount 120 that includes a thin cylinder 121. Cylinder 121 can be composed of, for example, rope, plastic metal or another material that can be shaped to simulate a bow string. An archery release aid is attached to cylinder 121 in that same way the archery release aid is attached to a bow string. This allows a simple way to retain the archery release aid attached to archery release aid mount 120. An additional feature 122 is used to hold another part of the archery release aid to reduce movement when attached to archery release aid mount. For example, additional feature 122 is a spring loaded tab. Screw holes 123 are used to attached archery release aid mount 120 to a bow. Thin cylinder 121 and additional feature 122 serve as securing devices of a mounting mechanisms that upon the archery release aid mount 120 receiving an archery release aid, hold the archery release aid securely, and that is configured to allow a user to without tools remove the archery release aid from archery release aid mount 120 when the user wants to use the archery release aid during archery.

Figure 30:
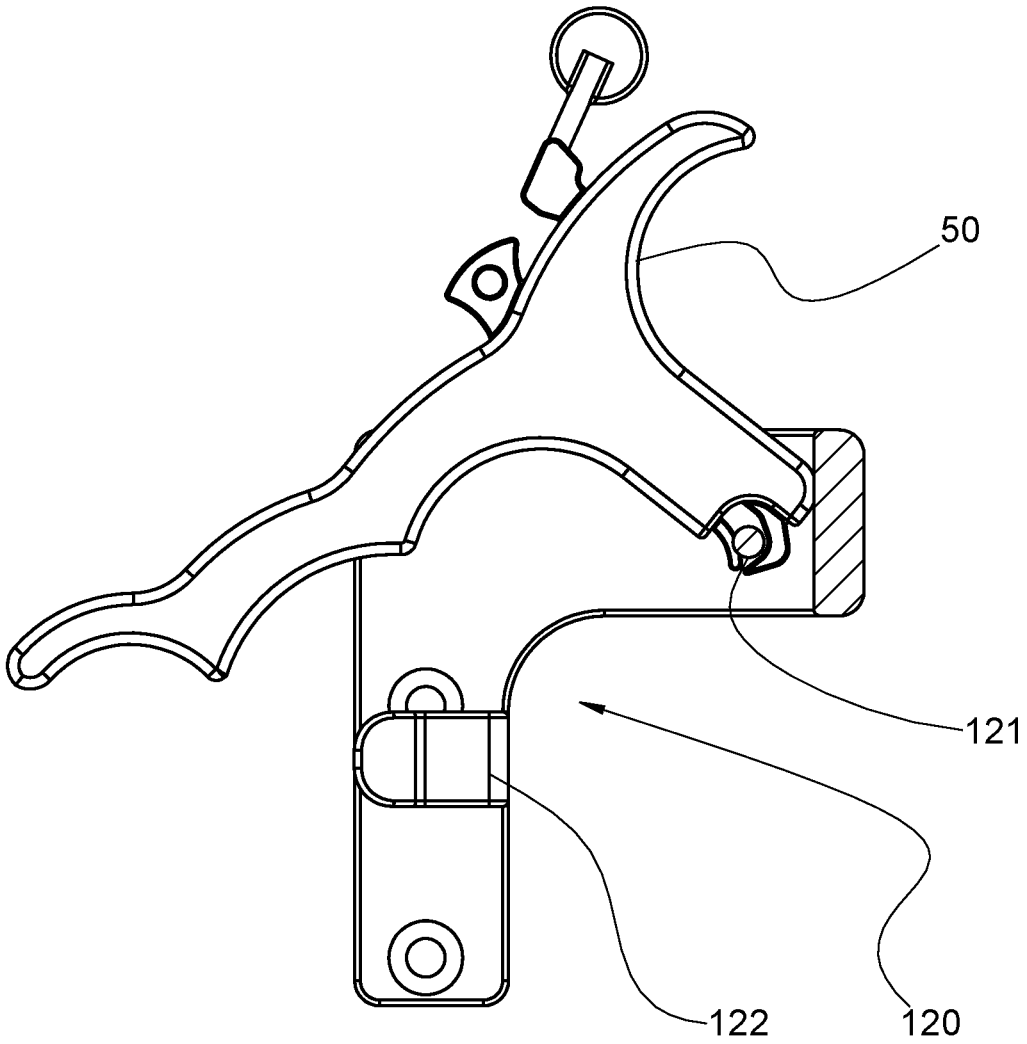
Figure 31:
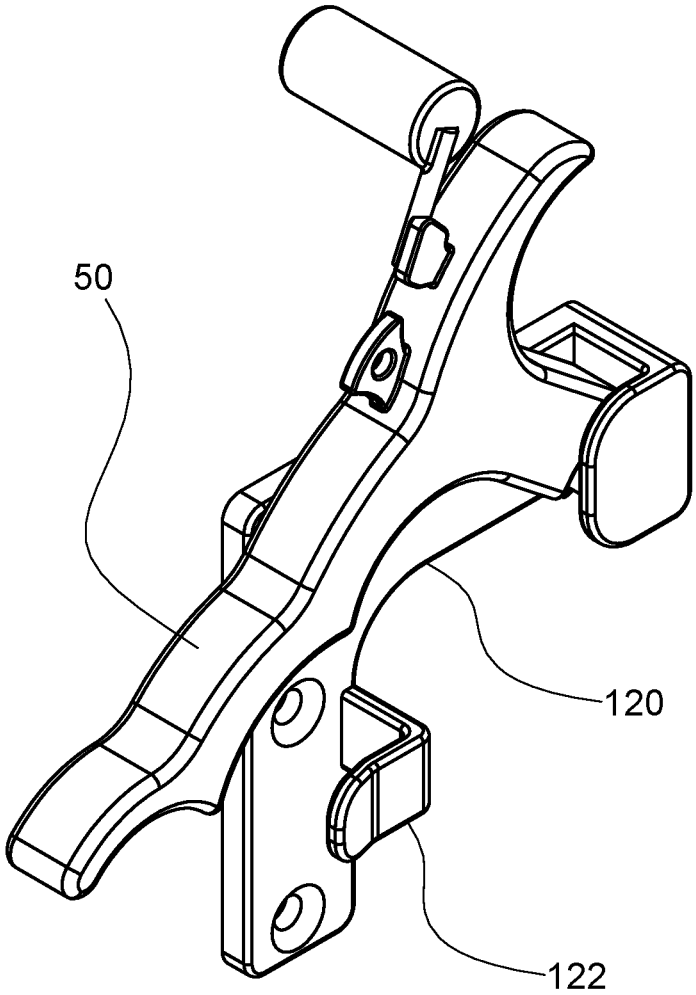

FIG. 30 and FIG. 31 show archery release aid 50 being attached to Cylinder 121 and then being rotated downward to be pressed into the cavity formed by feature (i.e., spring loaded tab) 122 in order to be secured by archery release aid mount 120.

Figure 32:
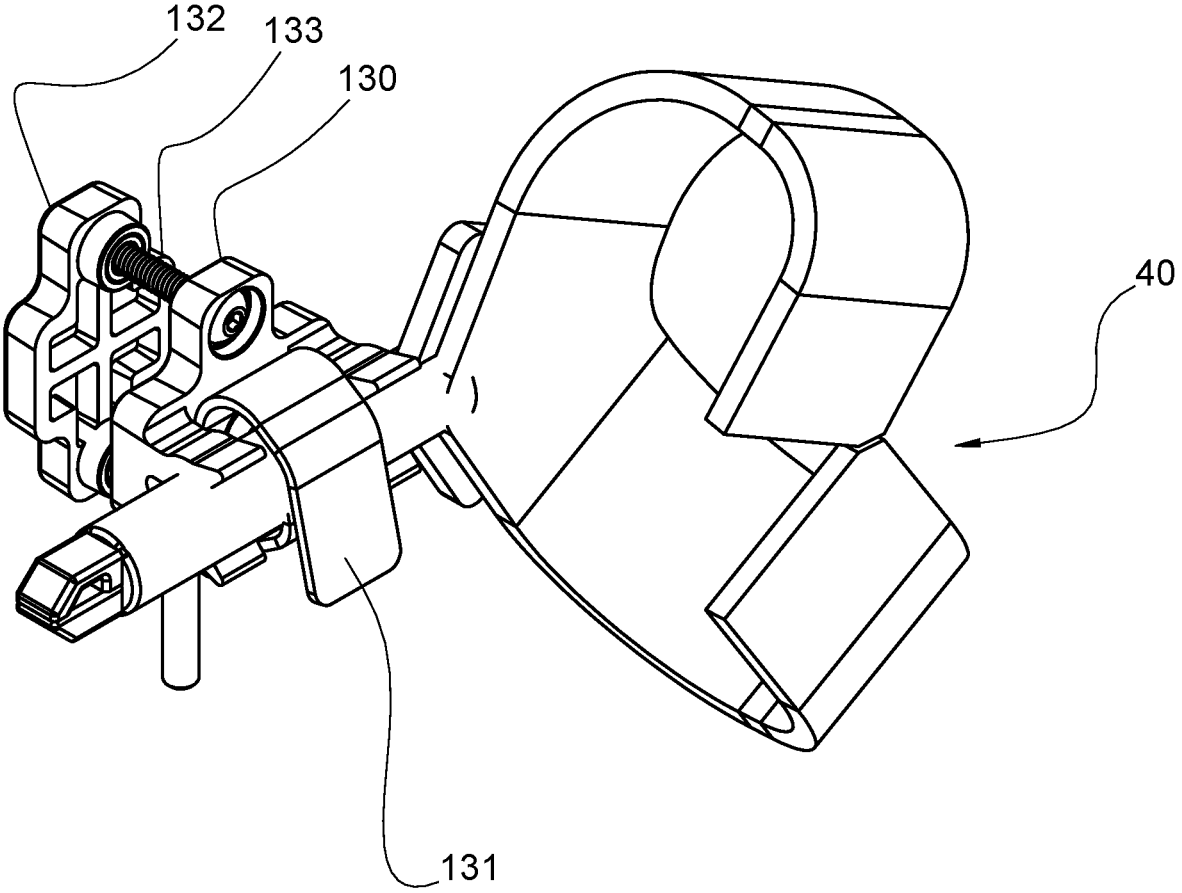
Figure 33:
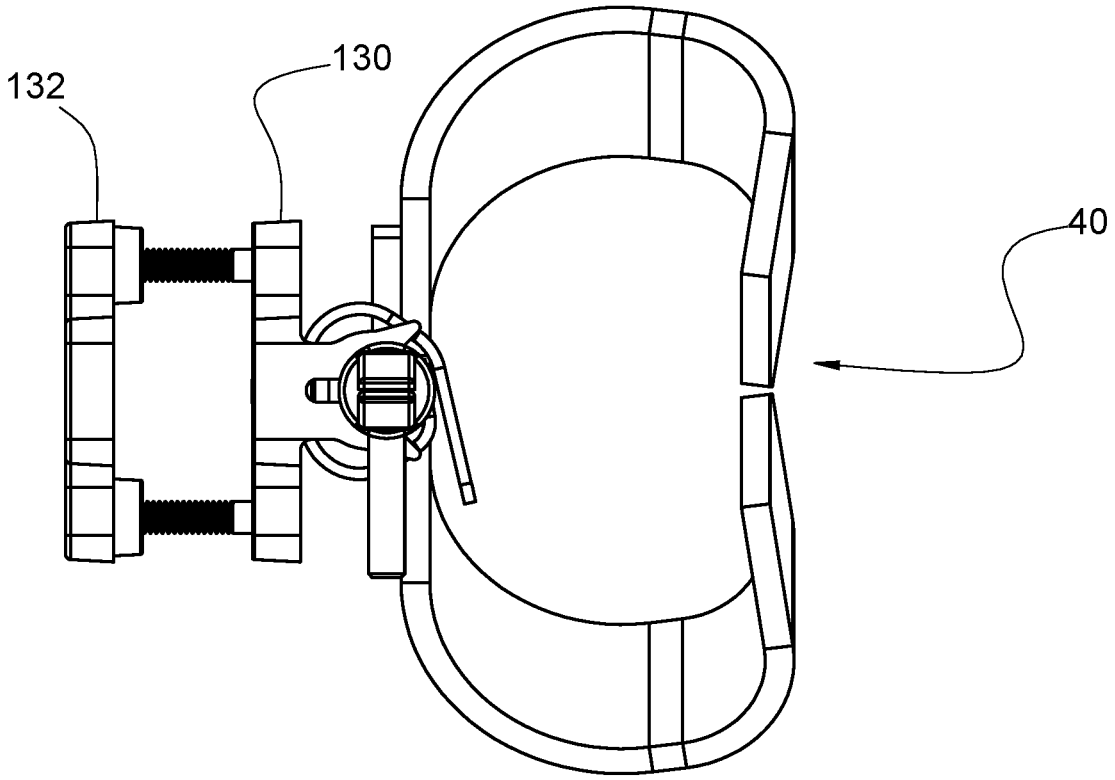
Figure 34:
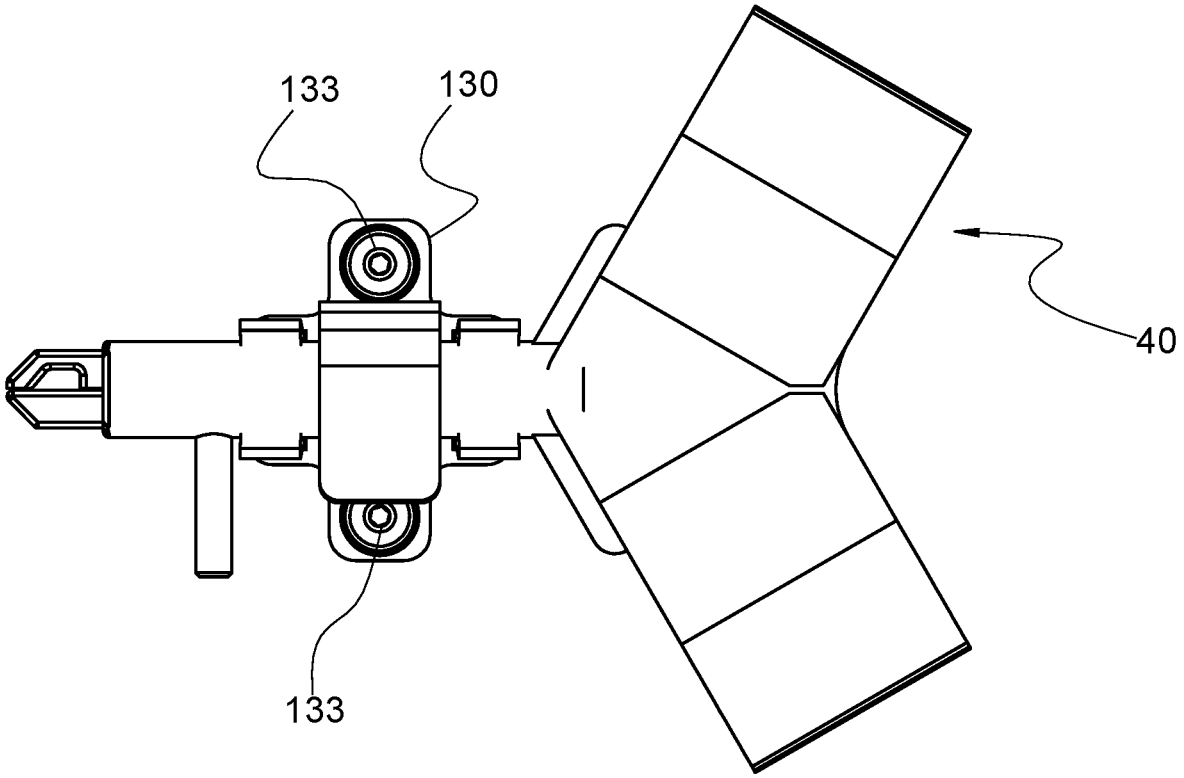

FIG. 32, FIG. 33 and FIG. 34 shows an archery release aid mount 130 that is attached to a clamp 132 by bolts 33. Clamp 132 serves as an attachment mechanism to attach release aid mount 130 to a bow. For example, archery release aid mount 130 attaches to archery release aid 40 using a hook and loop strap 131. Alternatively, the hook and loop strap 131 can be replaced with a strap that attaches using a button, a snap or some other fastening device. Hook and loop strap 131 serves as a securing device of a mounting mechanism that upon the archery release aid mount 130 receiving an archery release aid, hold the archery release aid securely, and that is configured to allow a user to without tools remove the archery release aid from archery release aid mount 130 when the user wants to use the archery release aid during archery.

Figure 35:
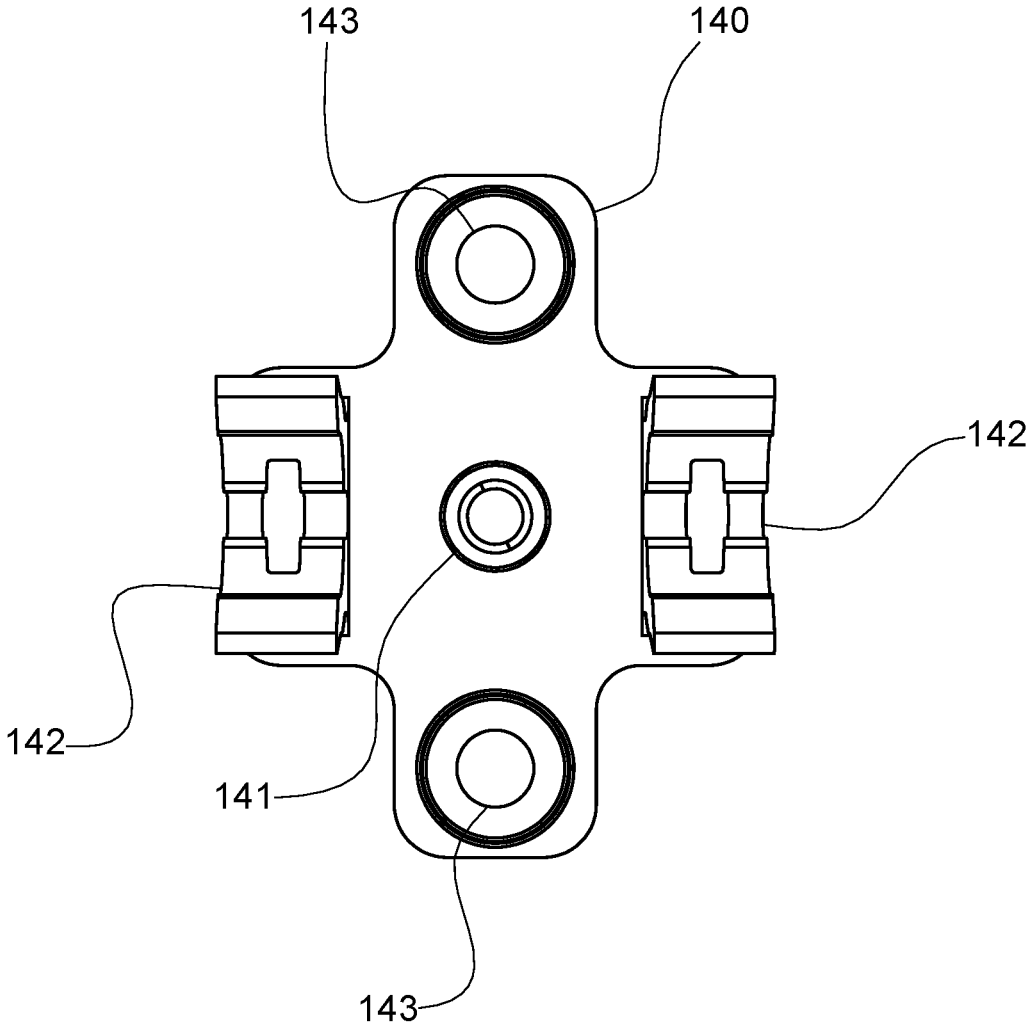
Figure 35A:
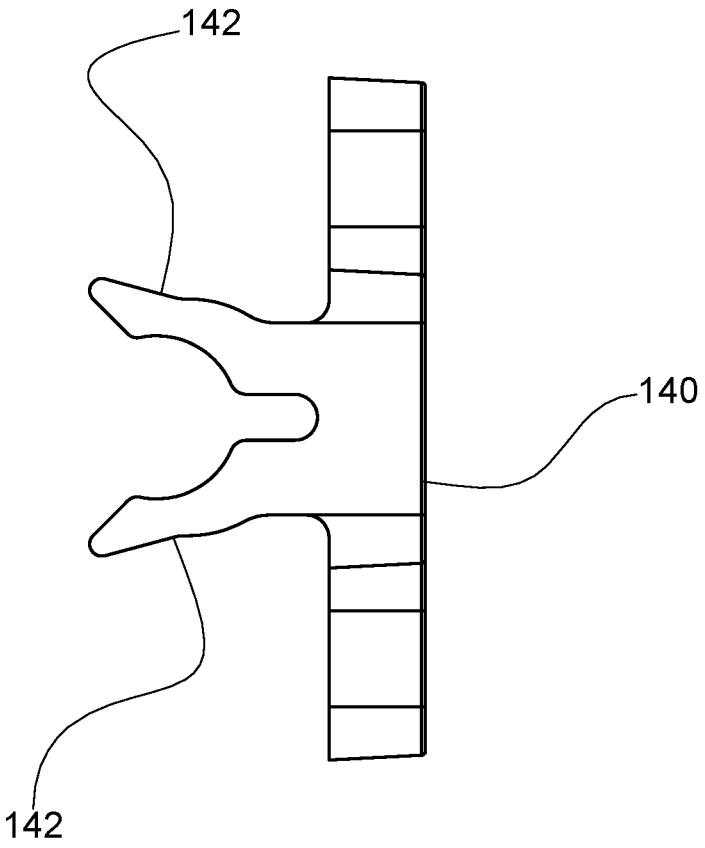
Figure 36:
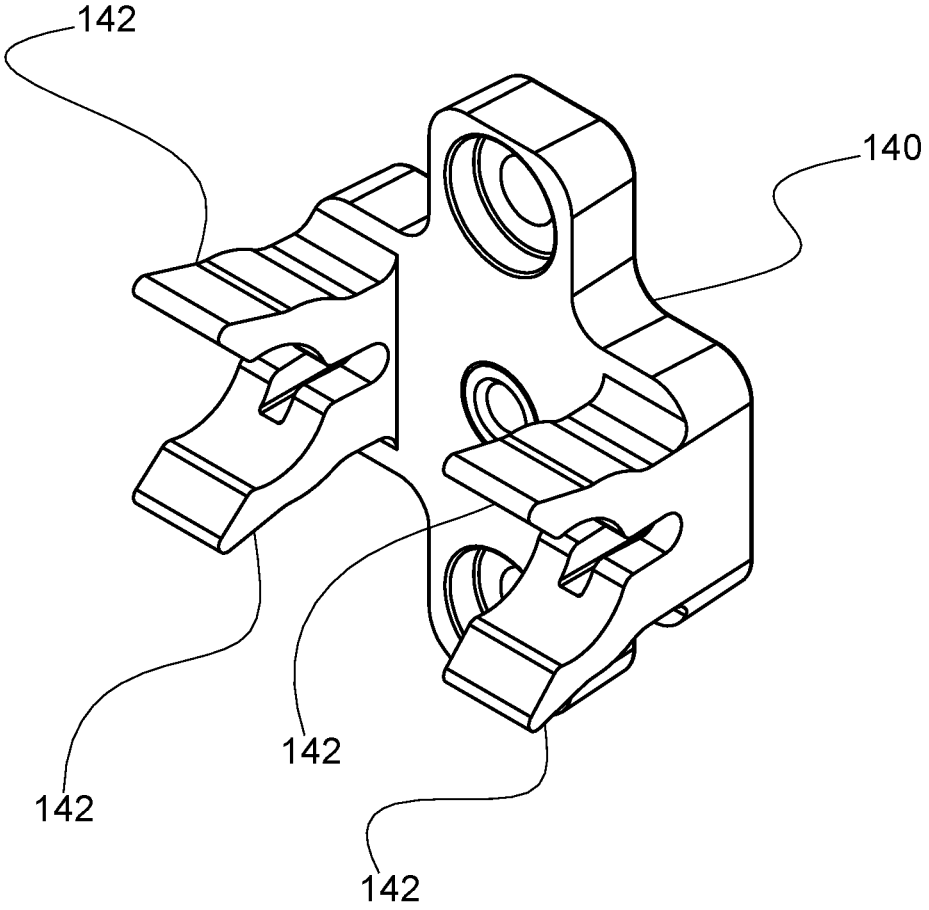
Figure 37:
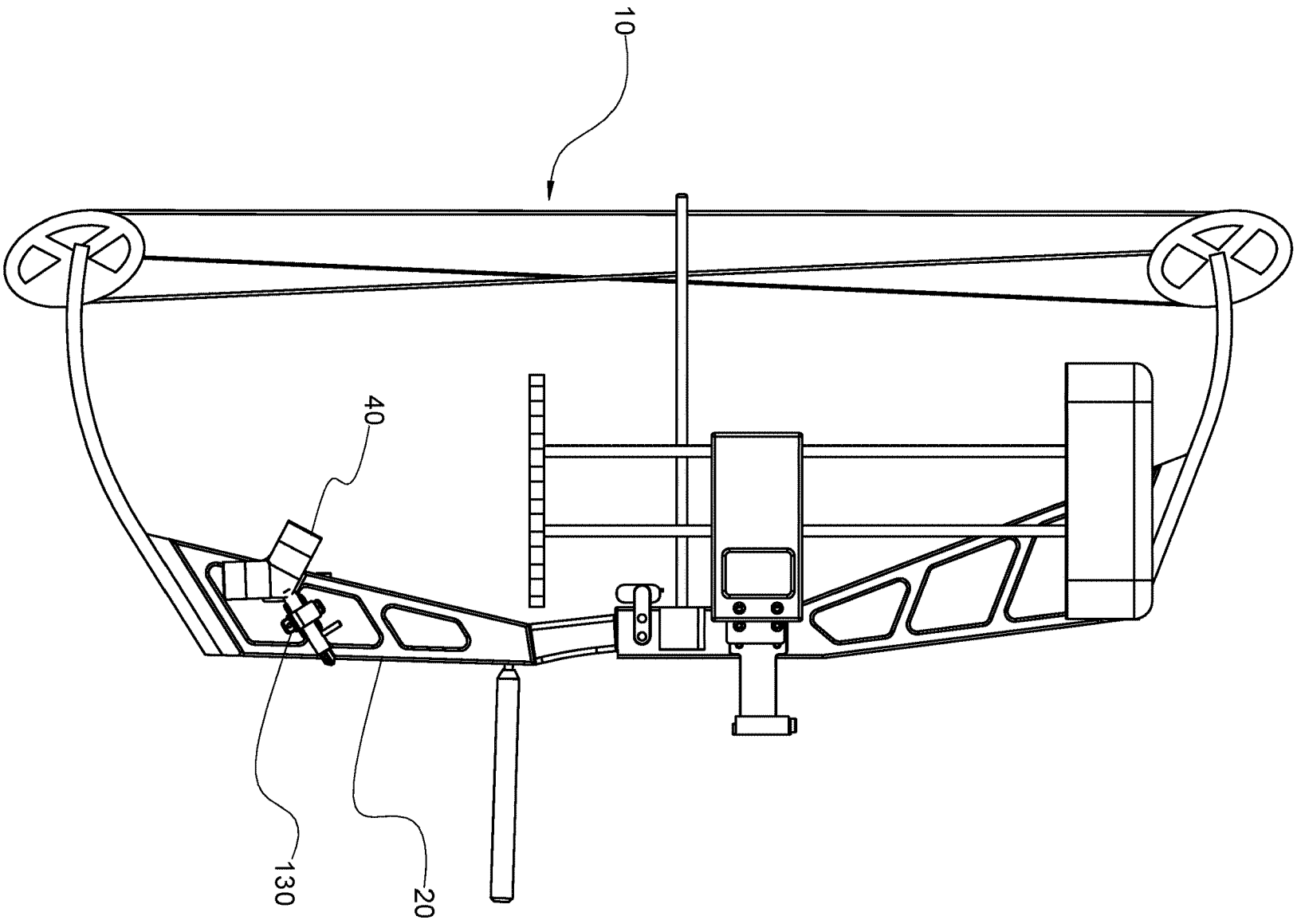
FIG. 37, FIG. 38, FIG. 39, FIG. 40, FIG. 41, FIG. 42, FIG. 43, FIG. 44, FIG. 45, FIG. 46, FIG. 47, FIG. 48, FIG. 49, FIG. 50, FIG. 51, FIG. 52, FIG. 53, FIG. 54, FIG. 55, FIG. 56, FIG. 57, FIG. 58, FIG. 59, FIG. 60, FIG. 61, FIG. 62, FIG. 63, FIG. 64, FIG. 65, FIG. 66, FIG. 67, FIG. 68, FIG. 69, FIG. 70, FIG. 71 and FIG. 72 illustrate how archery release aid mounts are attached to an archery bow or to an archery accessory in accordance with preferred implementations.

FIG. 35, FIG. 35A and FIG. 36 show an archery release aid mount 140 that uses jaws 142 to grasp and hold an archery release aid. Bolt holes 143 are spaced to match a bolt pattern used to mount risers and fixed sights on bows. Jaws 142 serve as securing devices of a mounting mechanisms that upon the archery release aid mount 140 receiving an archery release aid, hold the archery release aid securely, and that is configured to allow a user to without tools remove the archery release aid from archery release aid mount 140 when the user wants to use the archery release aid during archery.

Figure 38:
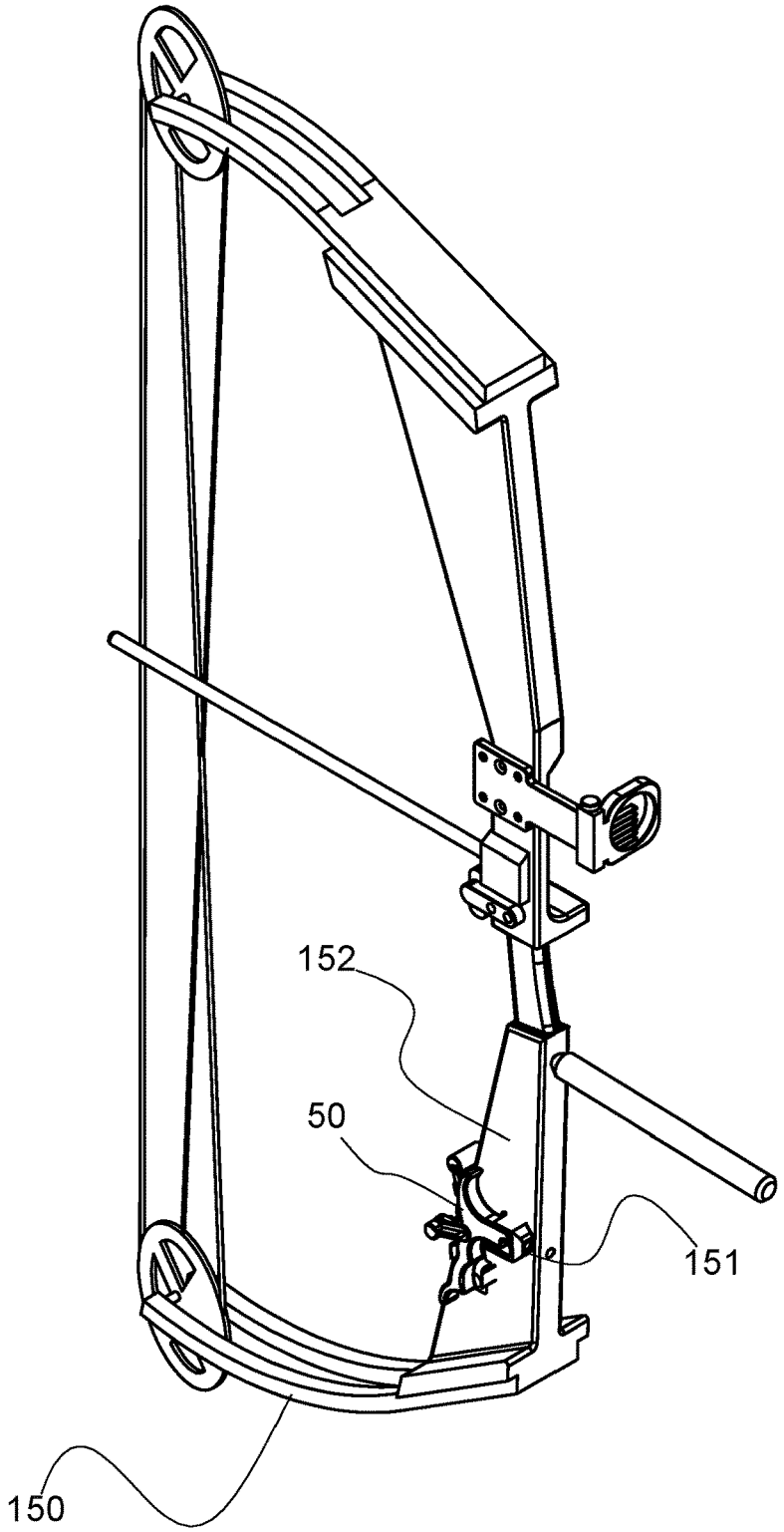
Figure 39:
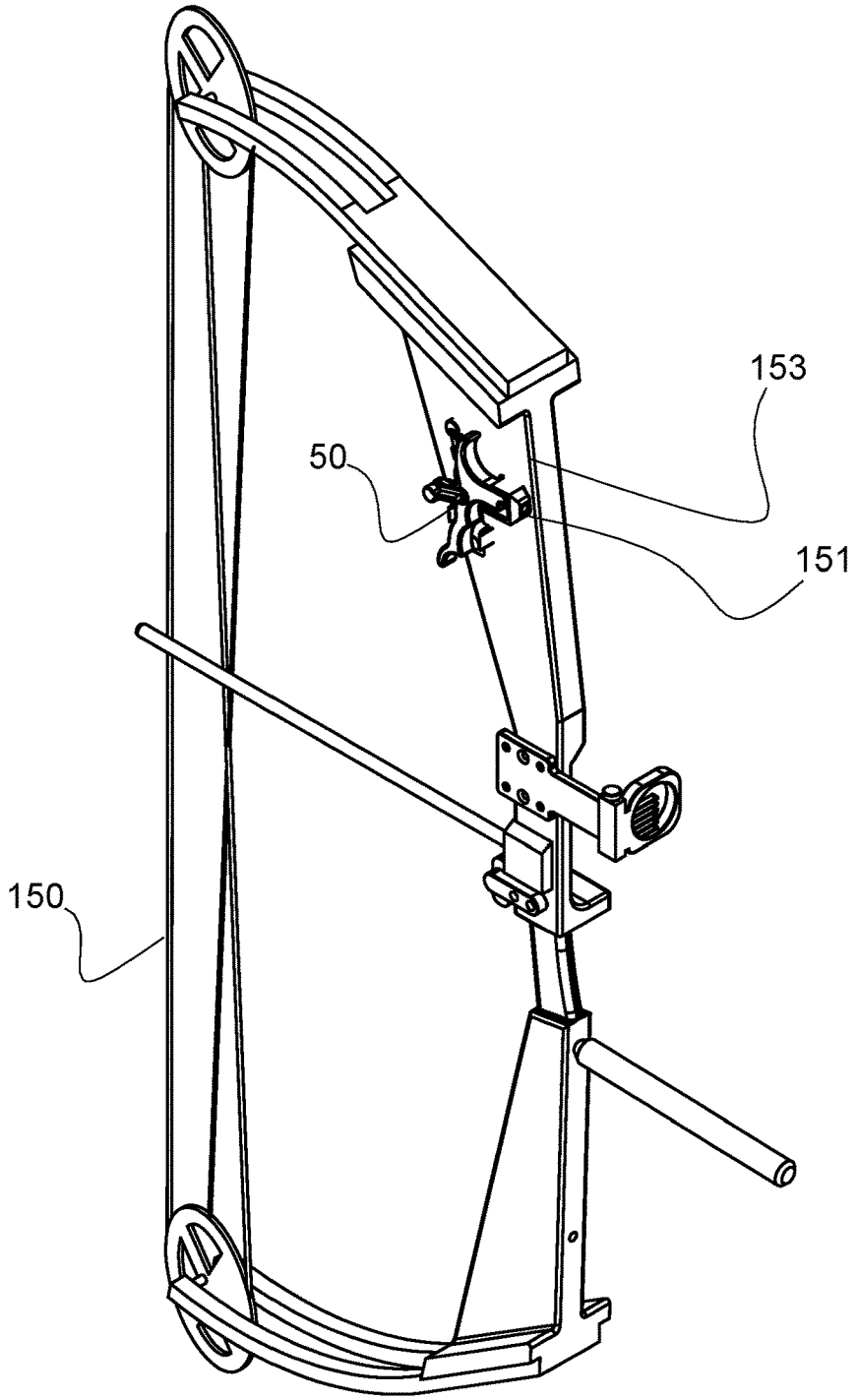

FIG. 38 shows an archery release aid mount 151 configured to hold archery release aid 50 attached to a riser 152 of a bow 150. FIG. 39 shows archery release aid mount 151 alternatively attached to a riser 153 of a bow 150.

Figure 40:
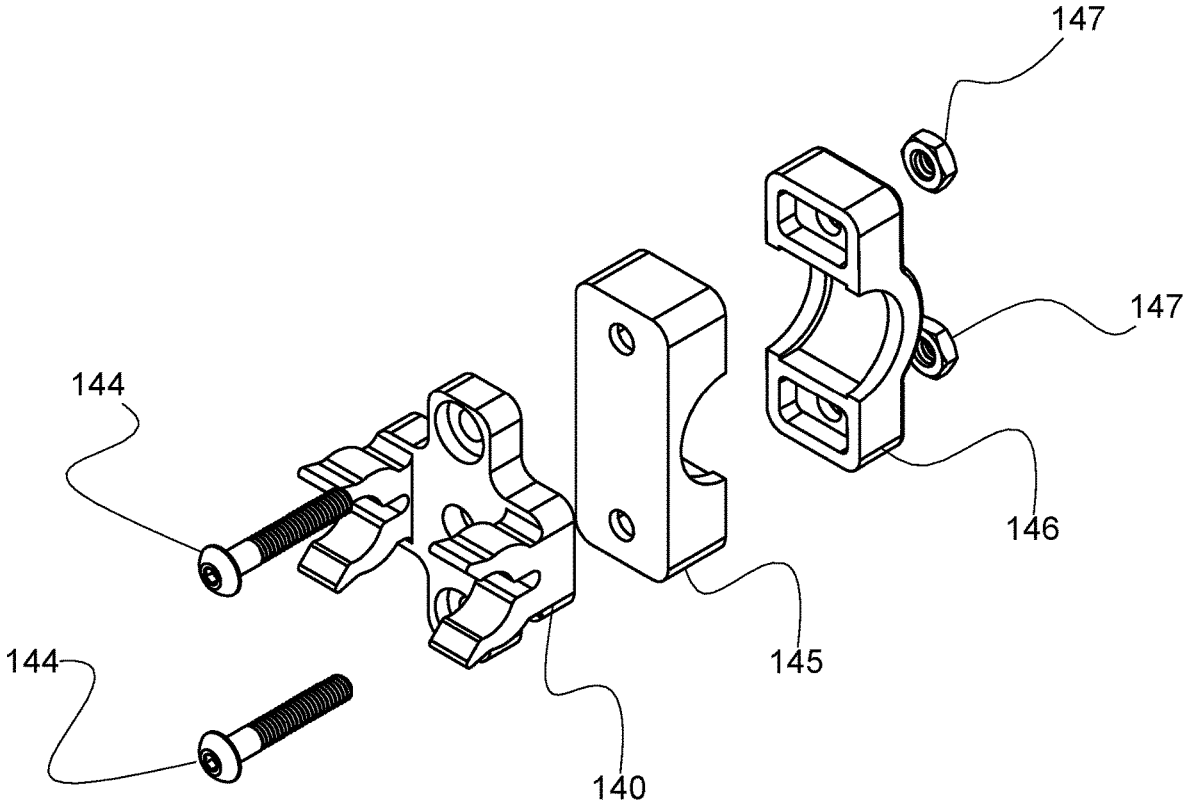

FIG. 40 shows archery release aid mount 140 configured to be attached to a stabilizer by inclusion of a mounting bracket 145, a mounting bracket 146, bolts 144 and screw nuts 147. Mounting bracket 145, mounting bracket 146, bolts 144 and screw nuts 147 form an attachment mechanism configured to rigidly attach archery release aid mount 140 to a bow.

Figure 41:
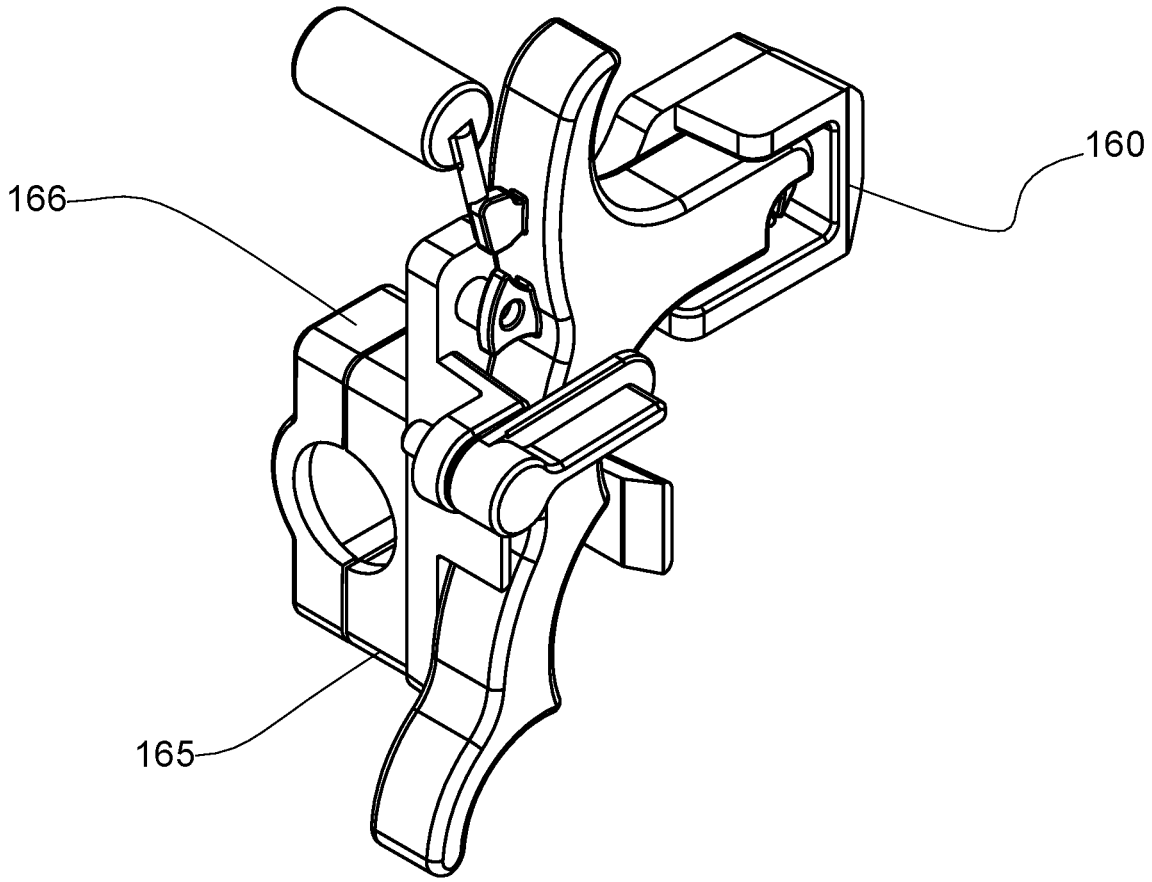
Figure 42:
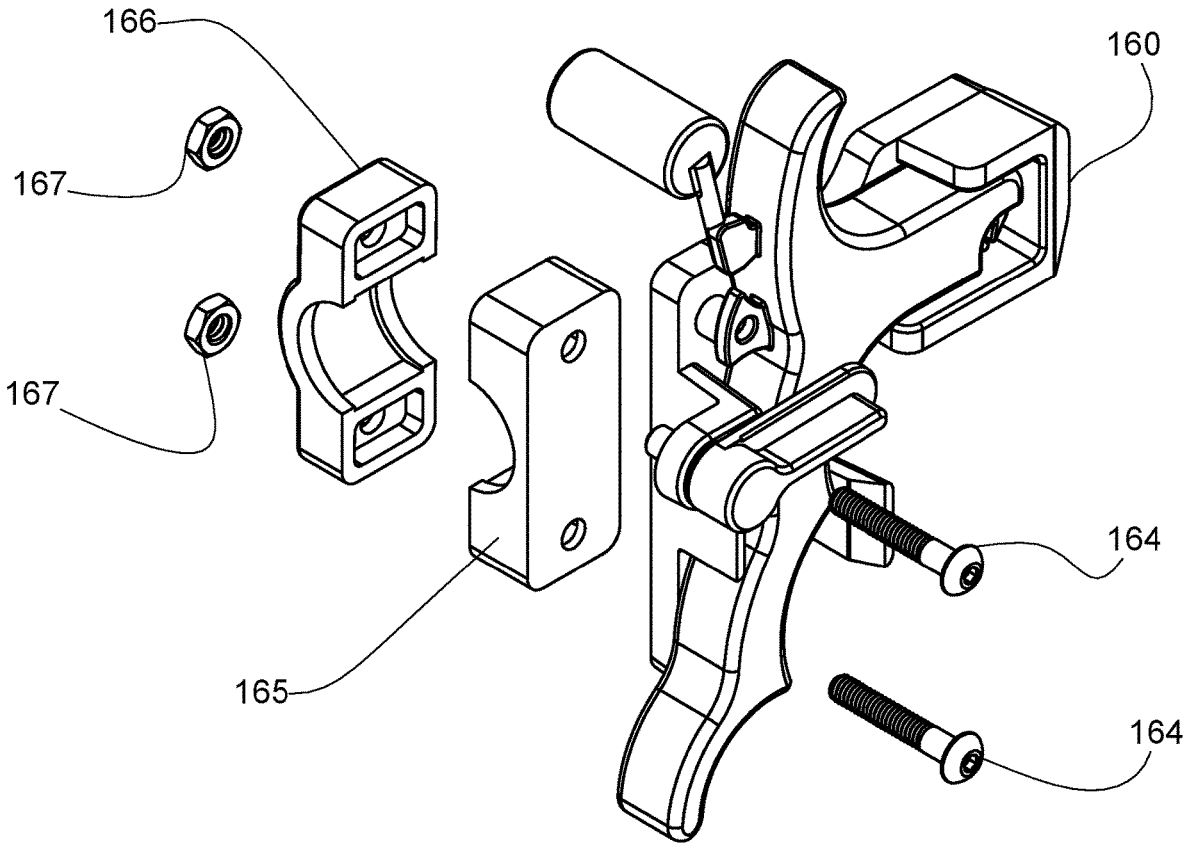

FIG. 41 and FIG. 42 shows an archery release aid mount 160 configured to be attached to a stabilizer by inclusion of a mounting bracket 165, a mounting bracket 166, bolts 164 and screw nuts 167. Mounting bracket 165, mounting bracket 166, bolts 164 and screw nuts 167 form an attachment mechanism configured to rigidly attach archery release aid mount 160 to a bow.

Figure 43:
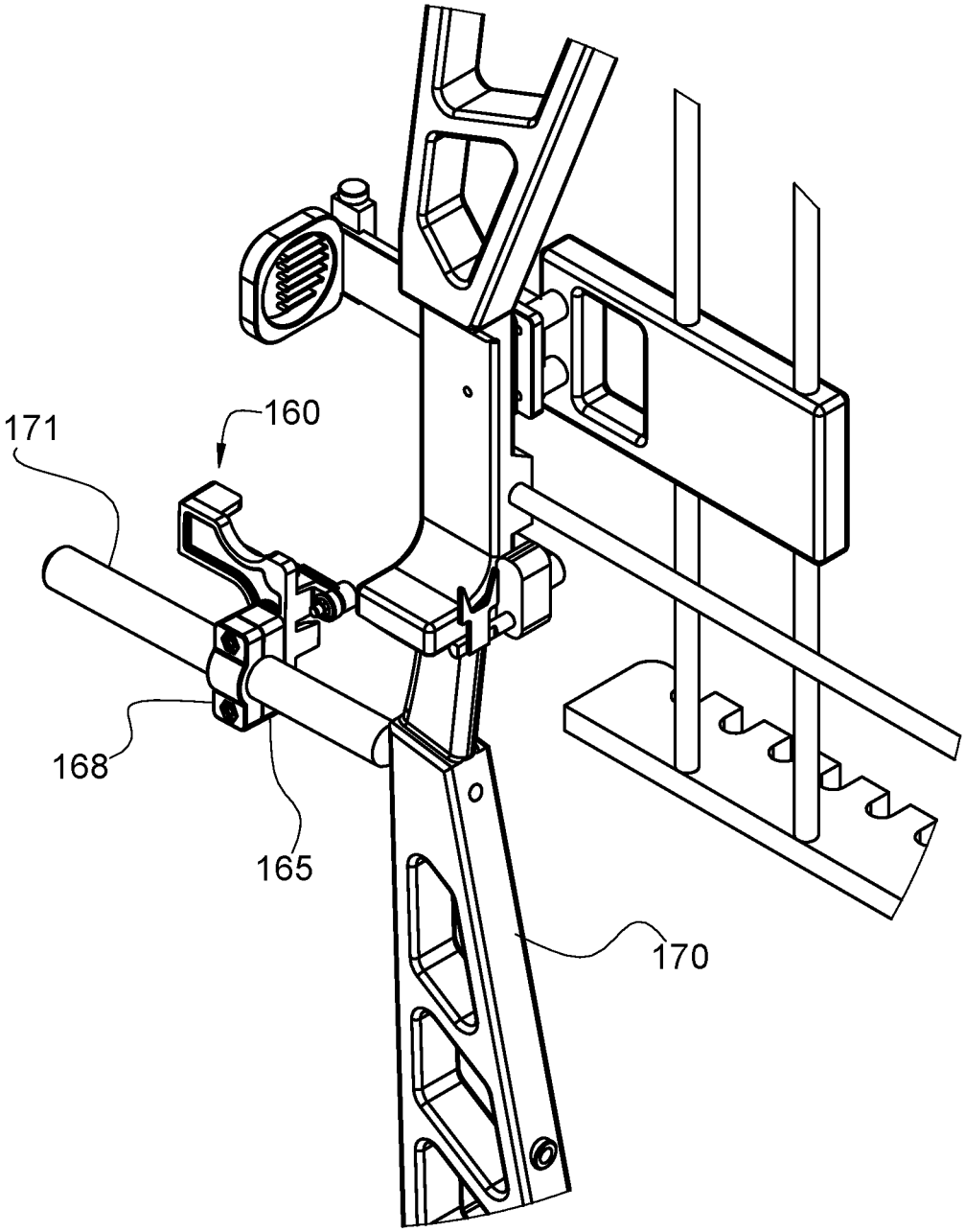

FIG. 43 shows archery release aid mount 160 attached to a stabilizer 171 of a bow 170.

Figure 44:
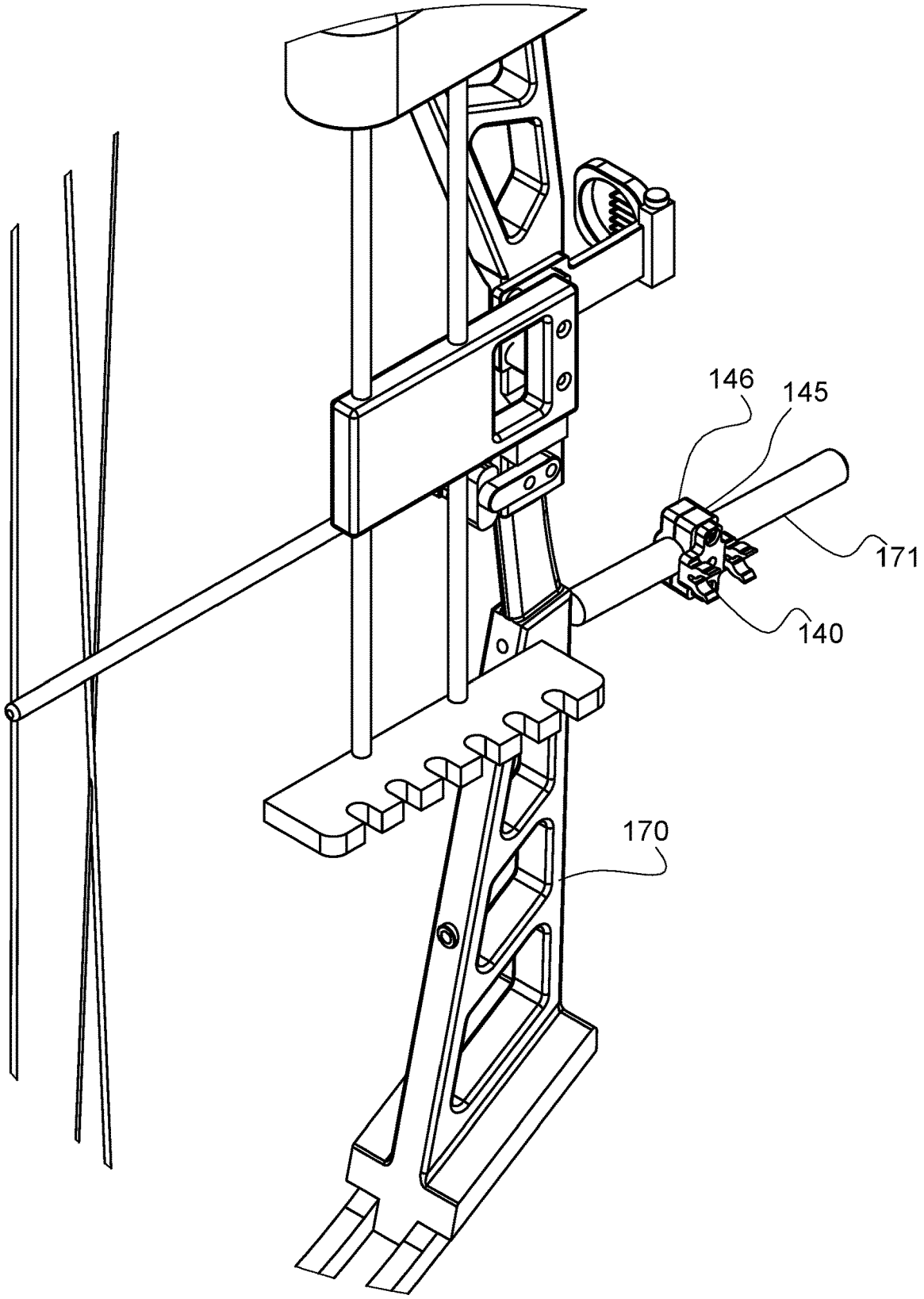

FIG. 44 shows archery release aid mount 140 attached to stabilizer 171 of bow 170.

Figure 45:
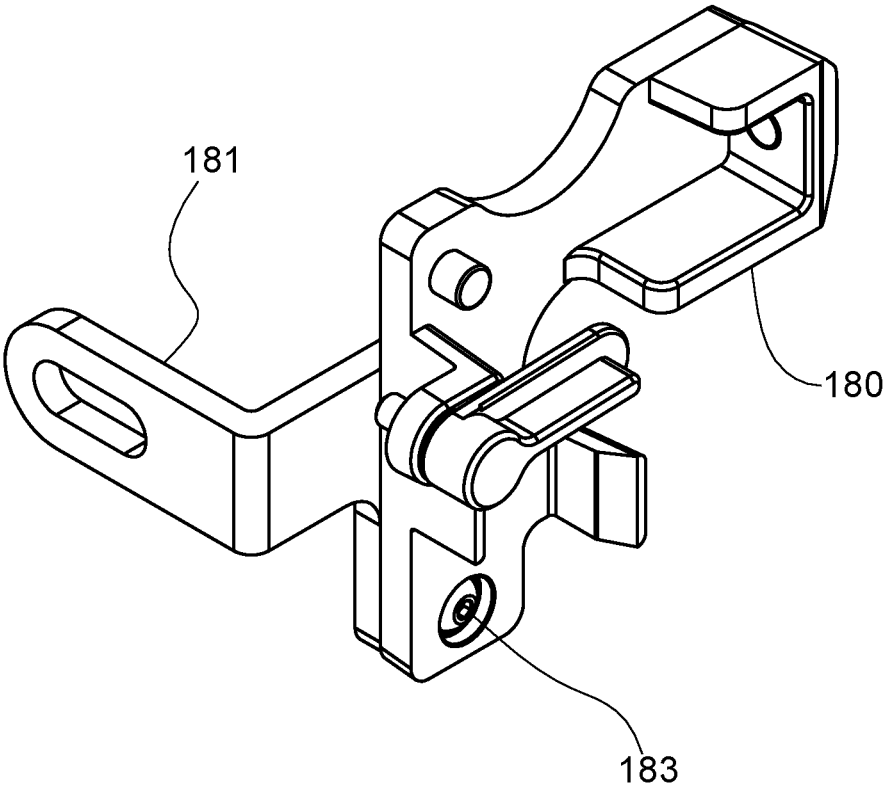
Figure 46:
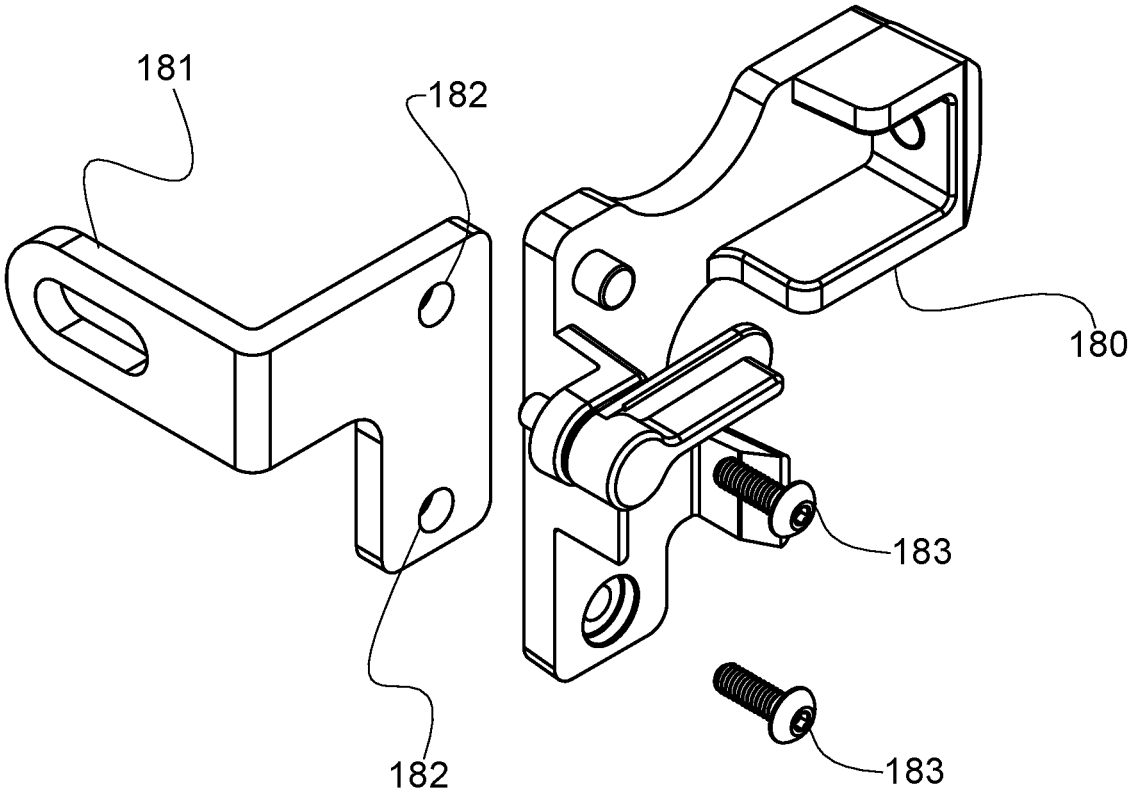

FIG. 45 and FIG. 46 shows an archery release aid mount 180 attached to a stabilizer mounting bracket 181 via bolts 183 that are screwed into threads within bolt holes 182. Stabilizer mounting bracket 181 and bolts 183 form an attachment mechanism configured to rigidly attach archery release aid mount 180 to a bow.

Figure 47:
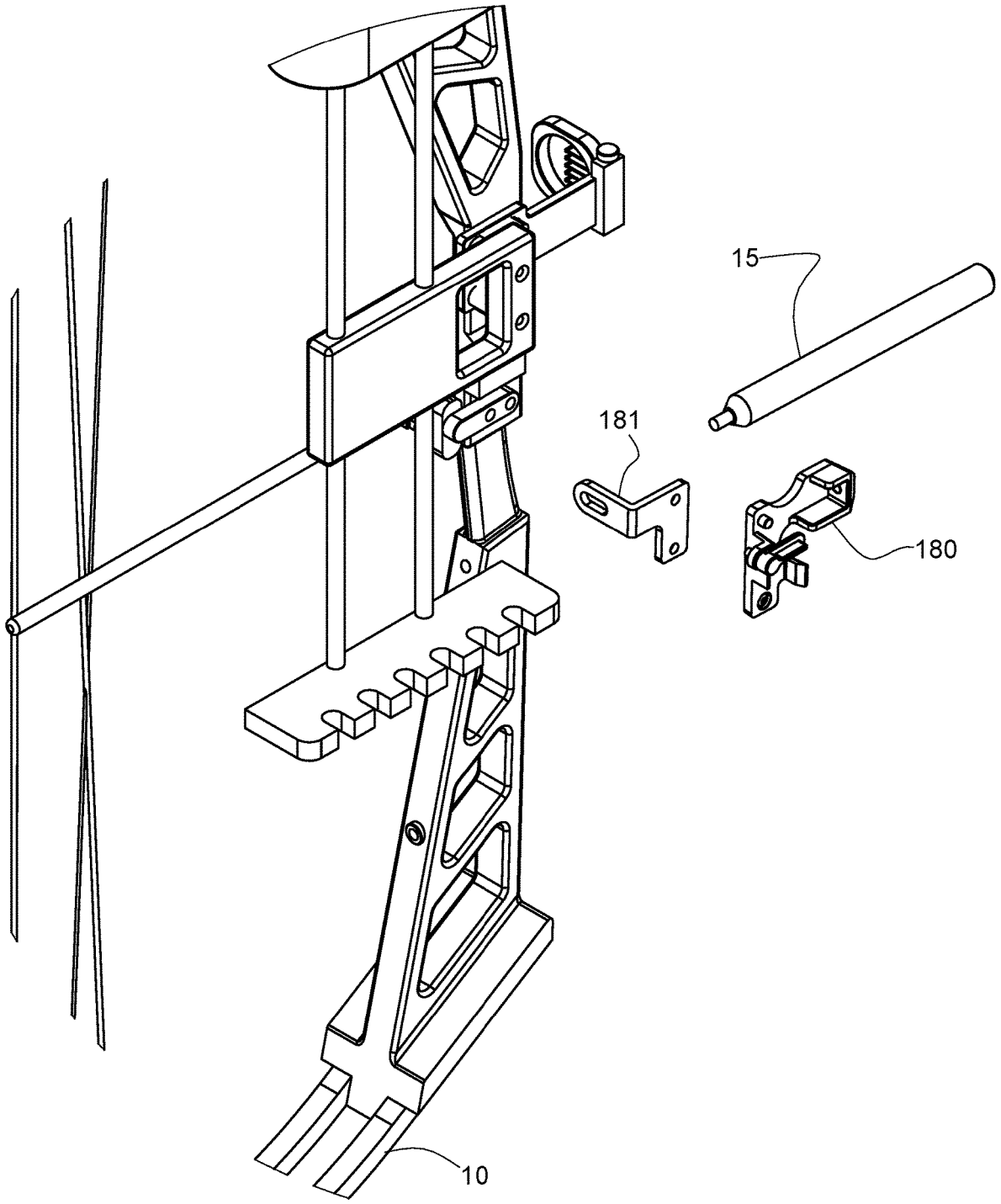
Figure 48:
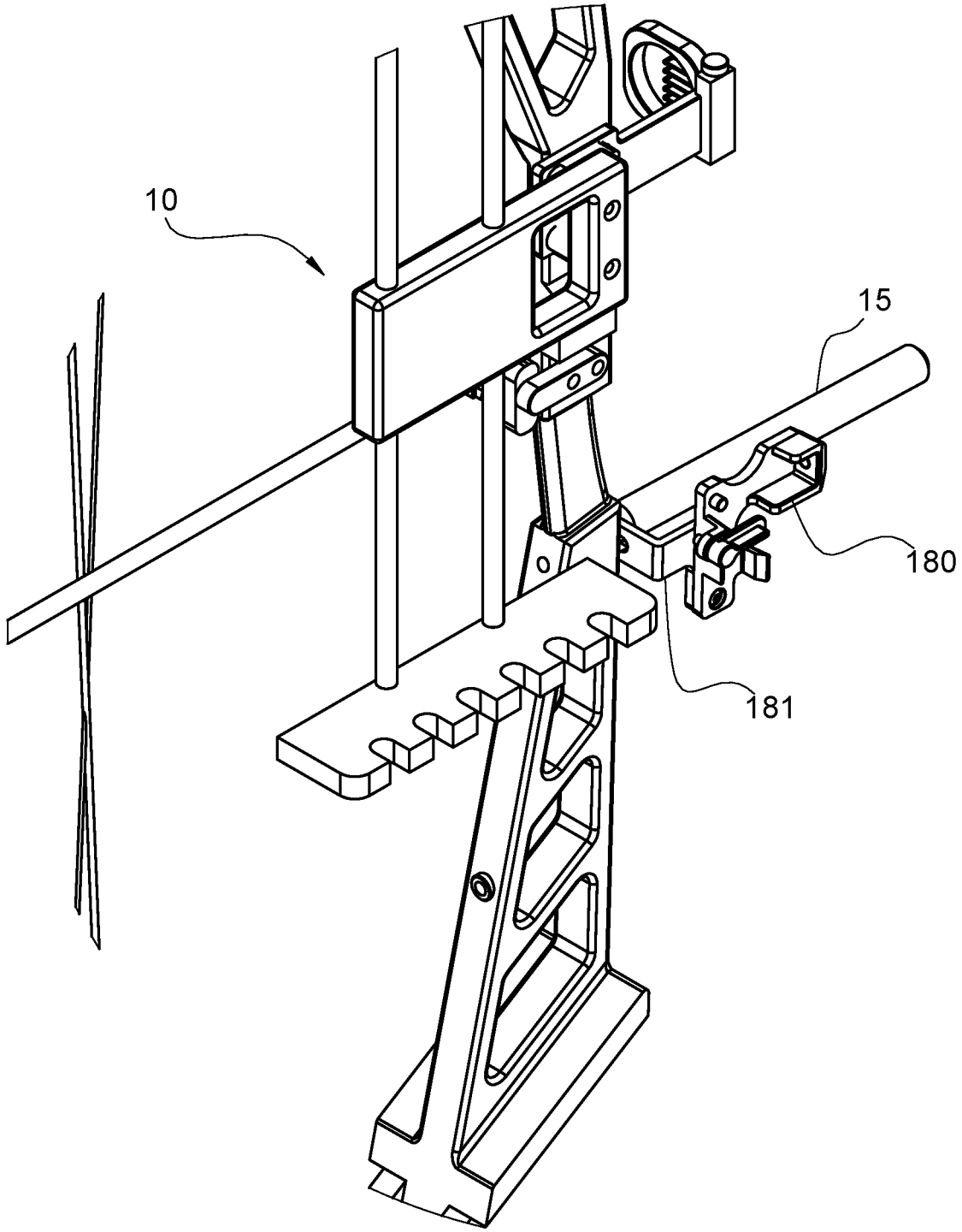

FIG. 47 and FIG. 48 illustrate archery release aid mount 180 being attached to bow 10 using stabilizer mounting bracket 181.

Figure 49:
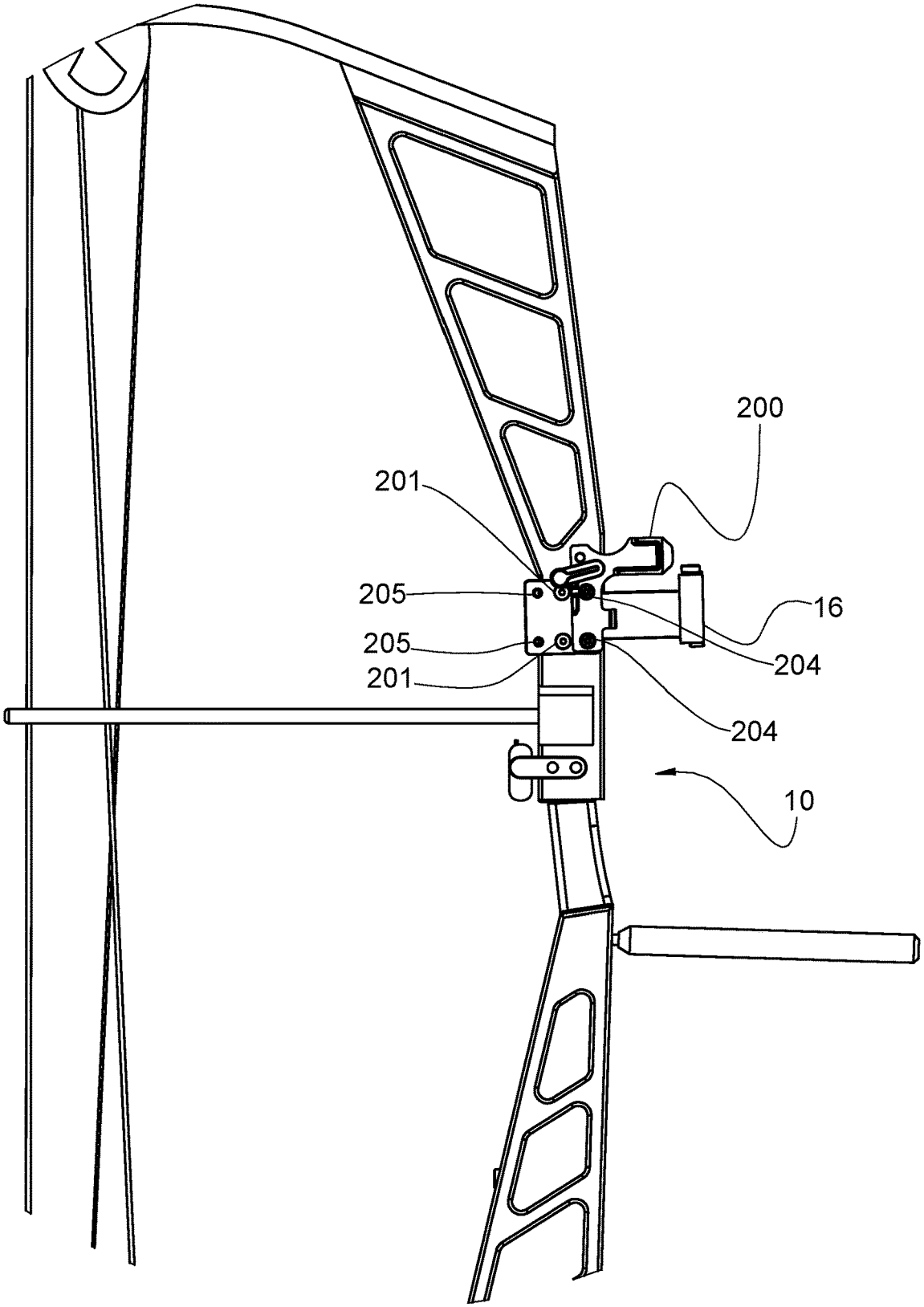
Figure 50:
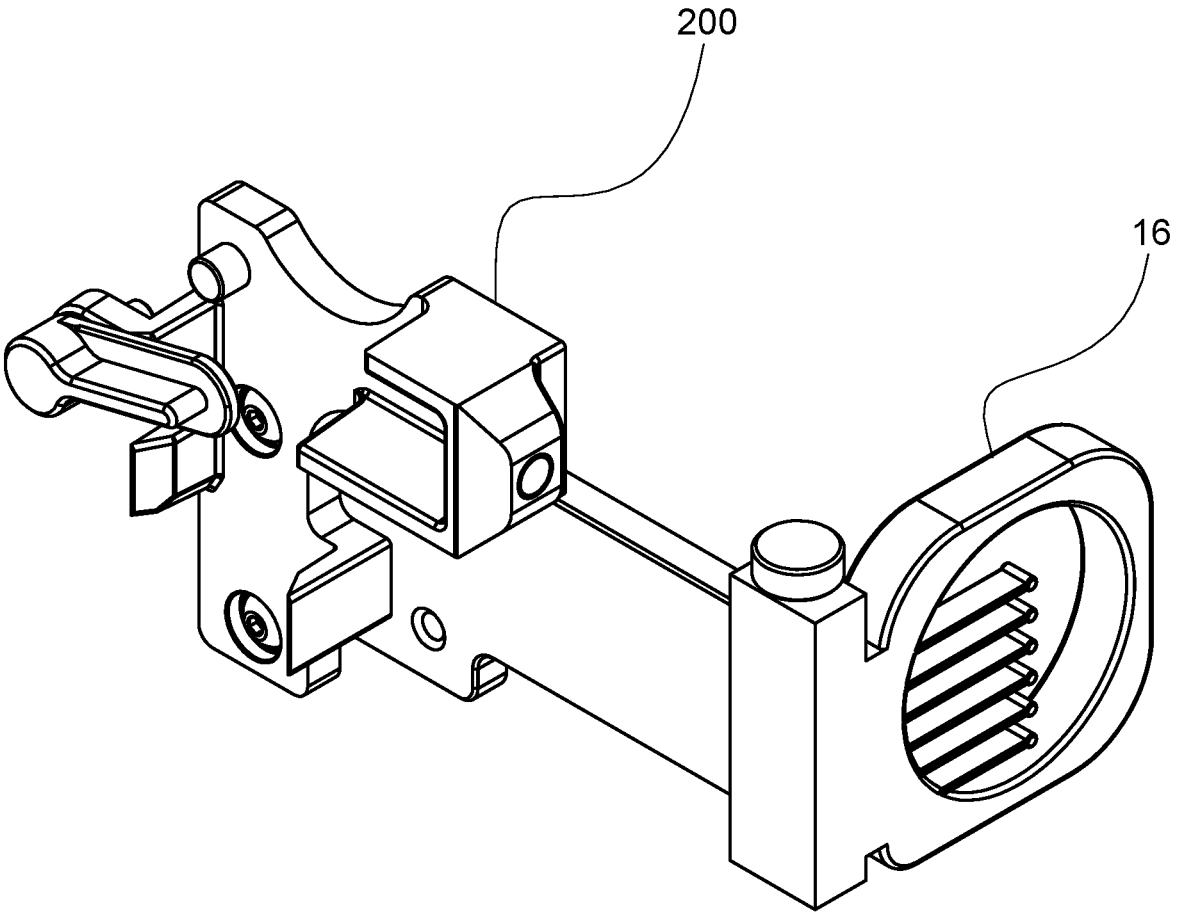

FIG. 49 shows an archery release aid mount 200 attached to bow 10 using auxiliary or accessory mounting holes such as at locations 204. For example, auxiliary or accessory mounting holes at locations 204 are in additional to standard mounting holes 201 used to mount fixed pin sight 16 on bow 10. For example, archery release aid mounts can have mounting holes configured to be attached to a bow using auxiliary or accessory mounting holes, or can be configured to use the same mounting holes on bow 10 used to mount a bow sight.

Figure 51:
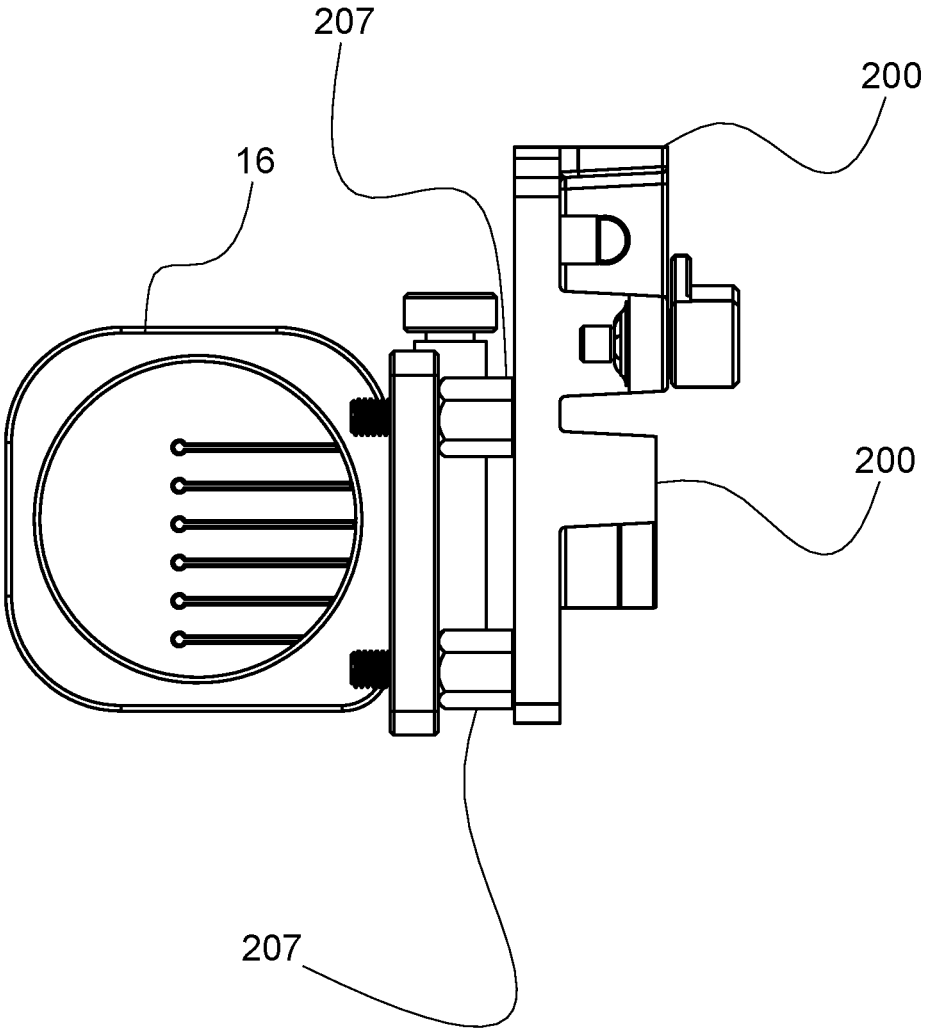
Figure 52:
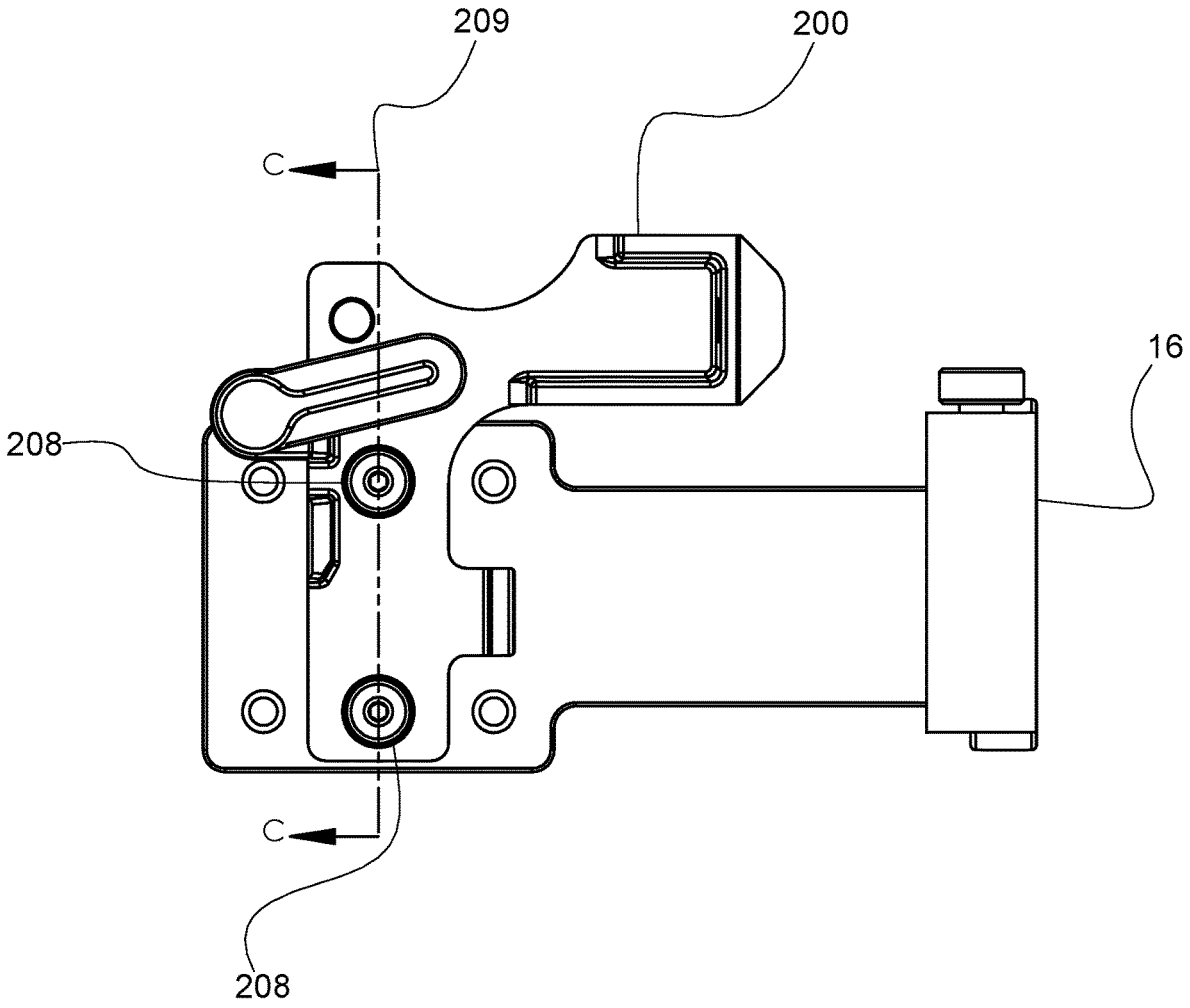
Figure 53:
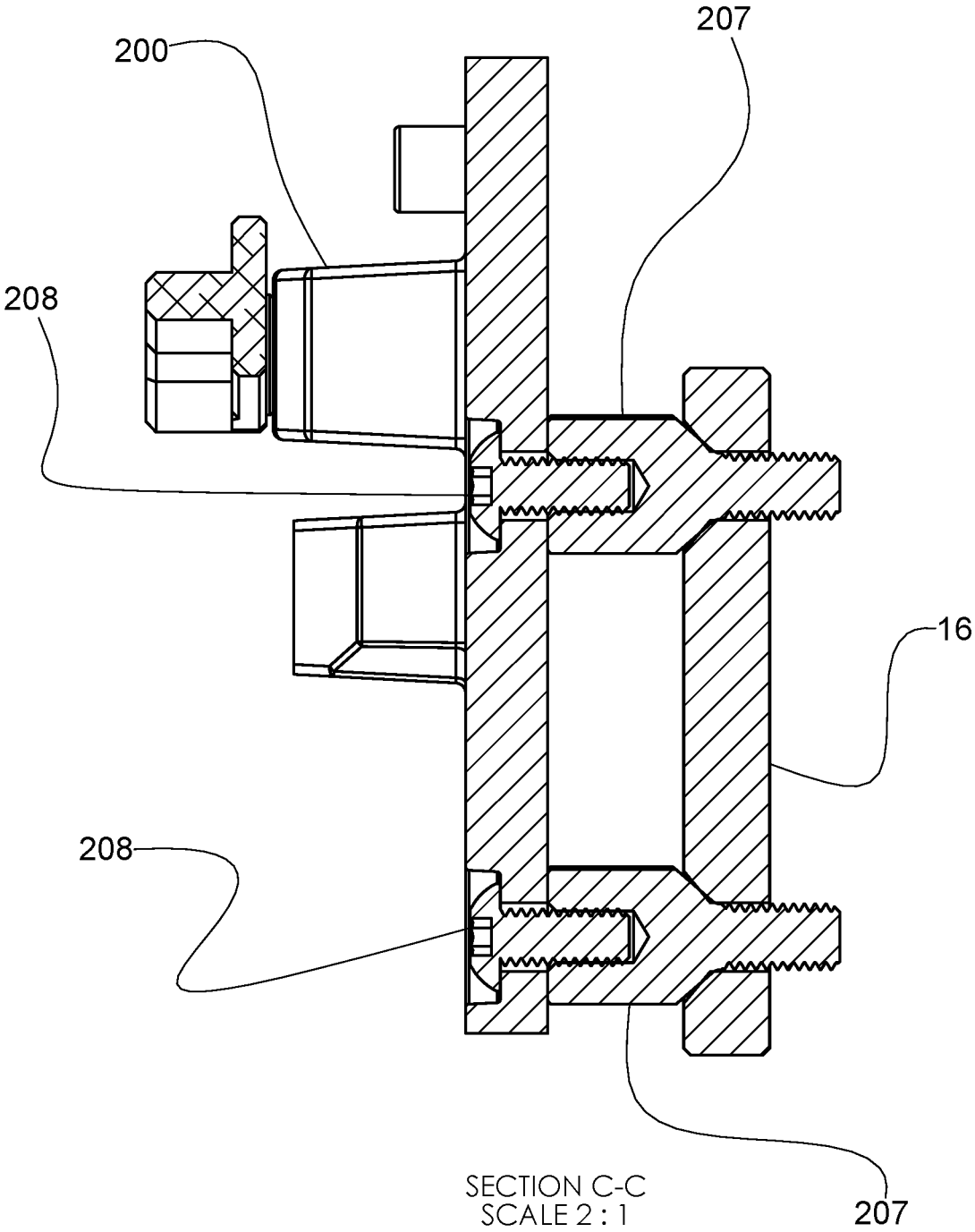

FIG. 50, FIG. 51, FIG. 52 and FIG. 53 gives more information of how additional holes are configured fixed pin sight 16 allowing mounting archery release aid mount 200 to be attached adjacent to fixed pin sight 16 on bow 10. For example, male/female threaded adapters 206 along with threaded screws 207 can be used as part of an attachment mechanism configured to rigidly attach archery release aid mount 200 to a bow, as shown in FIG. 51, FIG. 52 and FIG. 53. FIG. 53 shows a cross sectional view along a plane 209 defined in FIG. 51.

Figure 54:
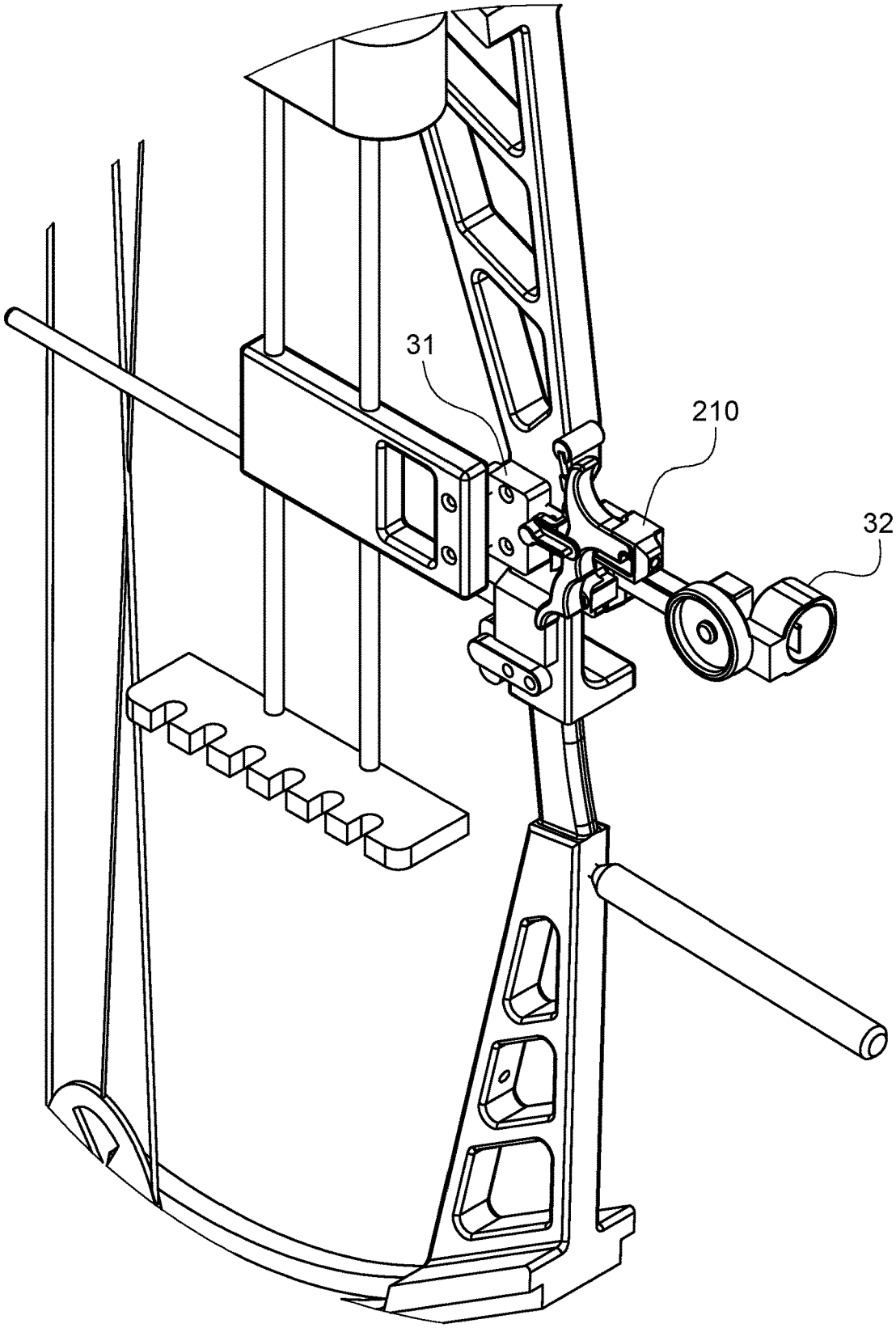
Figure 55:
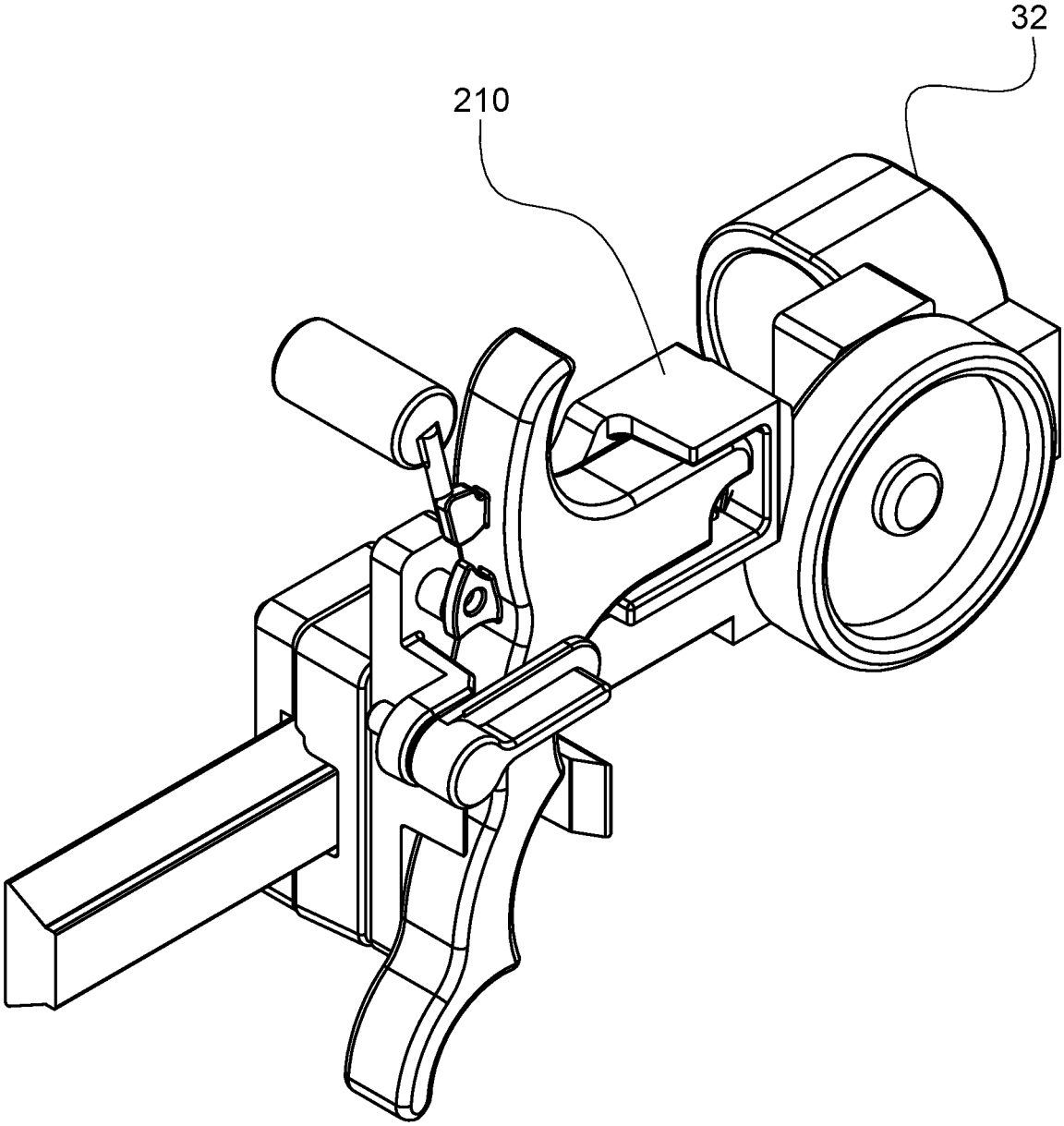
Figure 56:
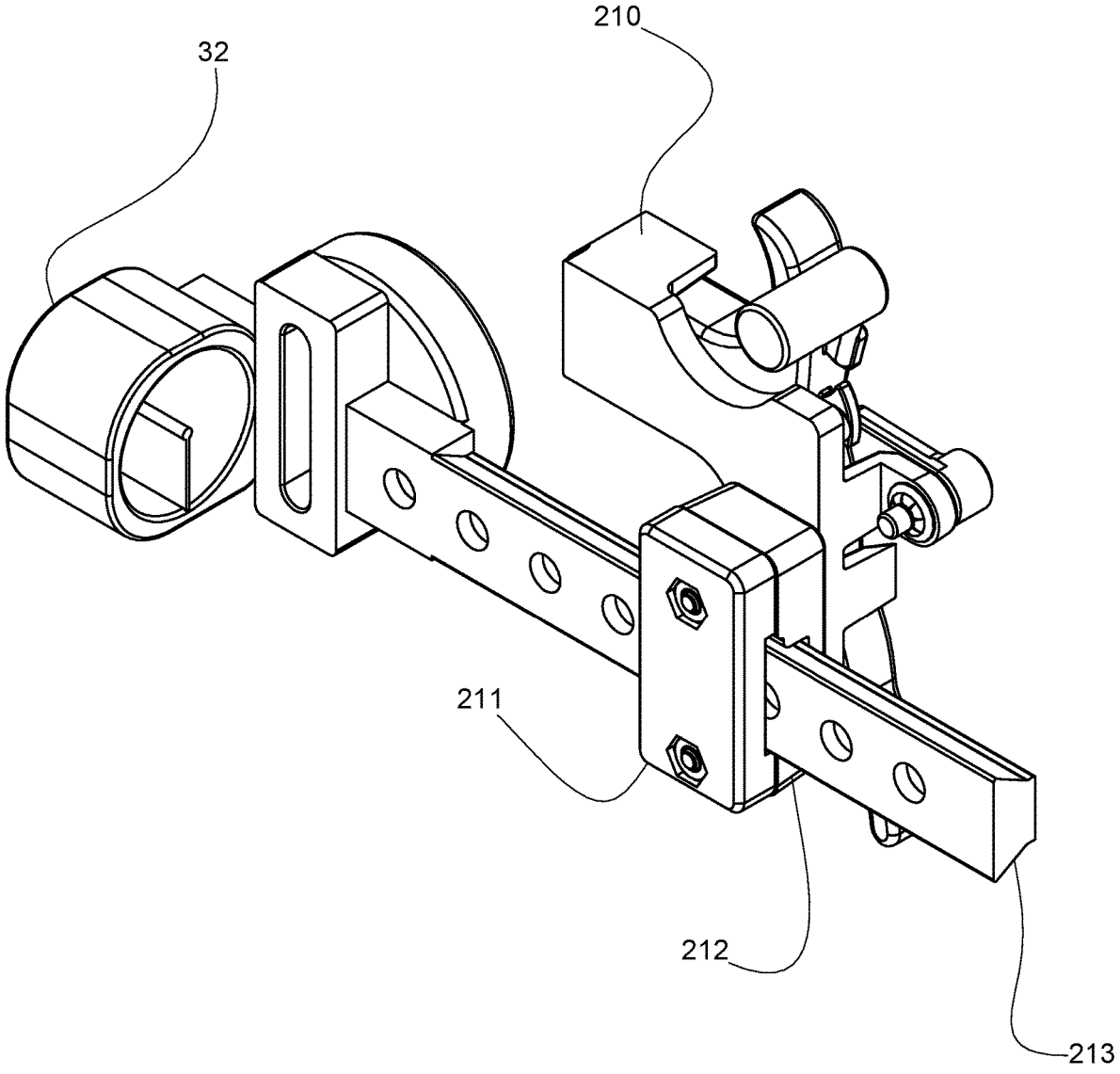
Figure 57:
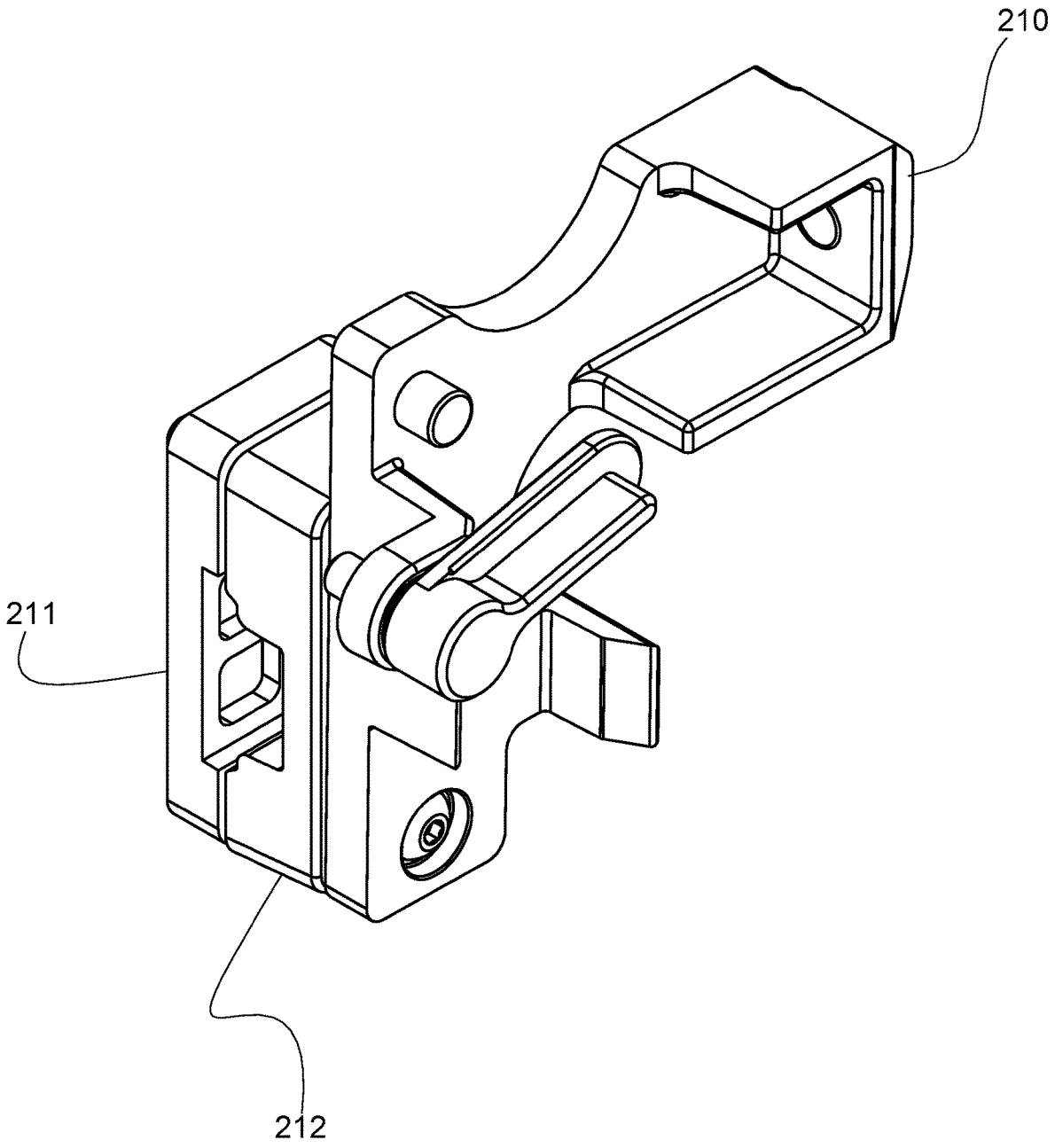
Figure 58:
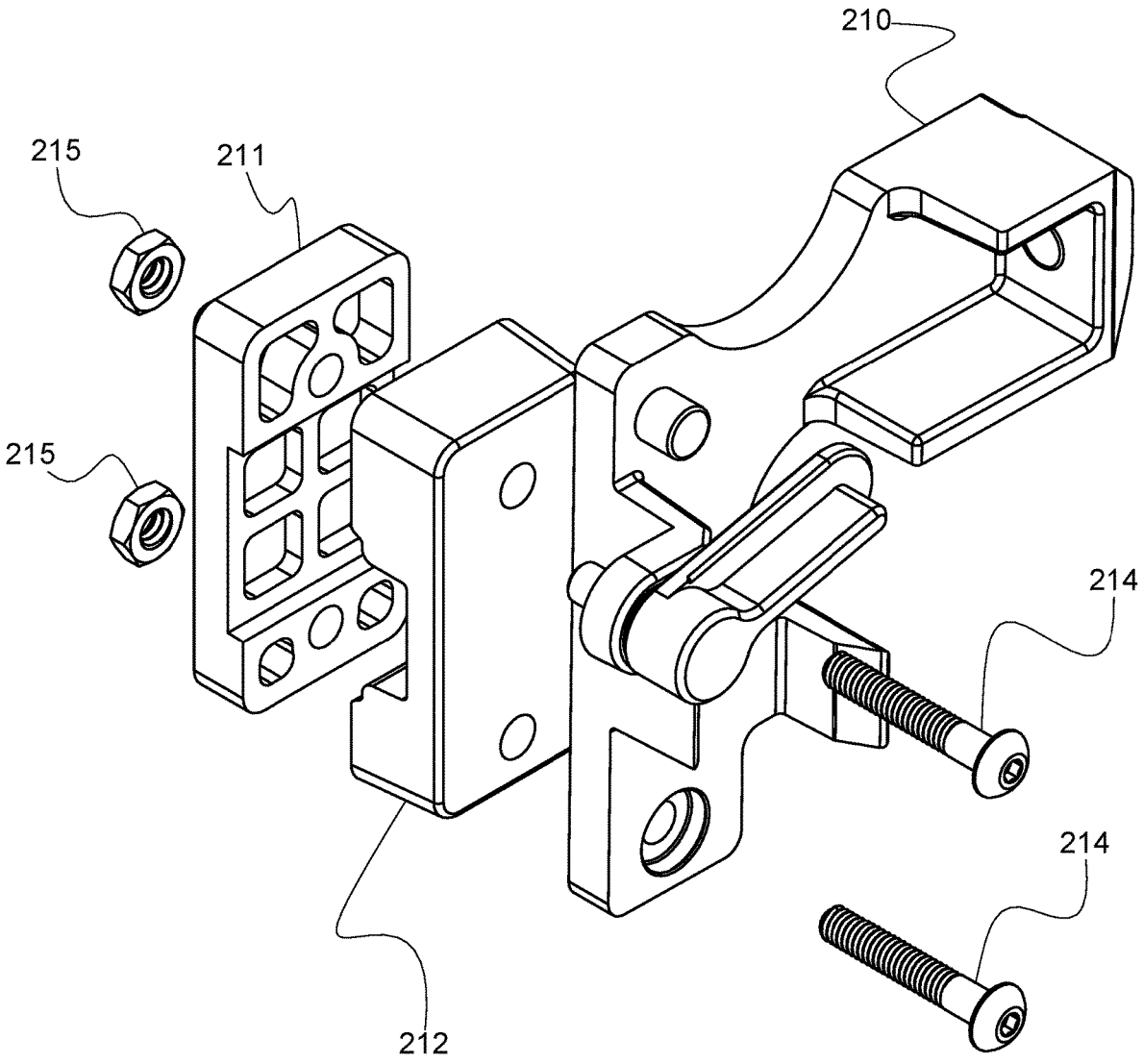

FIG. 54 shows an archery release aid mount 210 attached to adjustable sight 32, connected to bow 10 by dove tail sight mount 31. Alternatively, archery release aid mount 210 can be integrated into the design of the adjustable sight.

FIG. 55, FIG. 56, FIG. 57, FIG. 58, FIG. 59, FIG. 60 and FIG. 61 show how archery release aid mount 210 is attached to a dove tail mount crossbar 213 using a mounting fixture 212 and a clamping plate 211. Bolts 214 and nuts 215 are used to hold mounting fixture 212 and a clamping plate 211 secure to dove tail mount crossbar 213. Bolts 214, nuts 215, mounting fixture 212 and clamping plate 211 form an attachment mechanism configured to rigidly attach archery release aid mount 210 to a bow.

Figure 59:
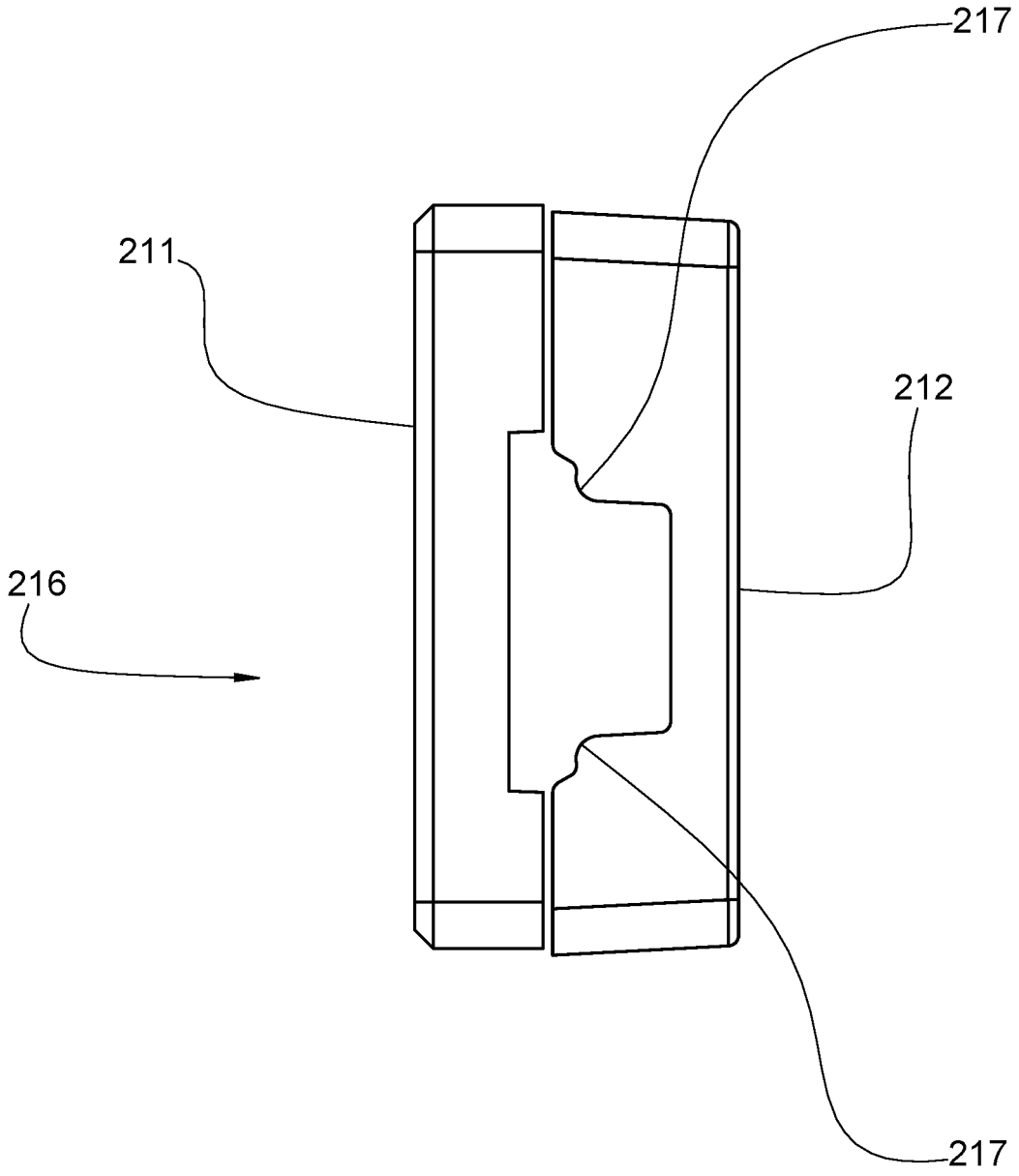
Figure 60:
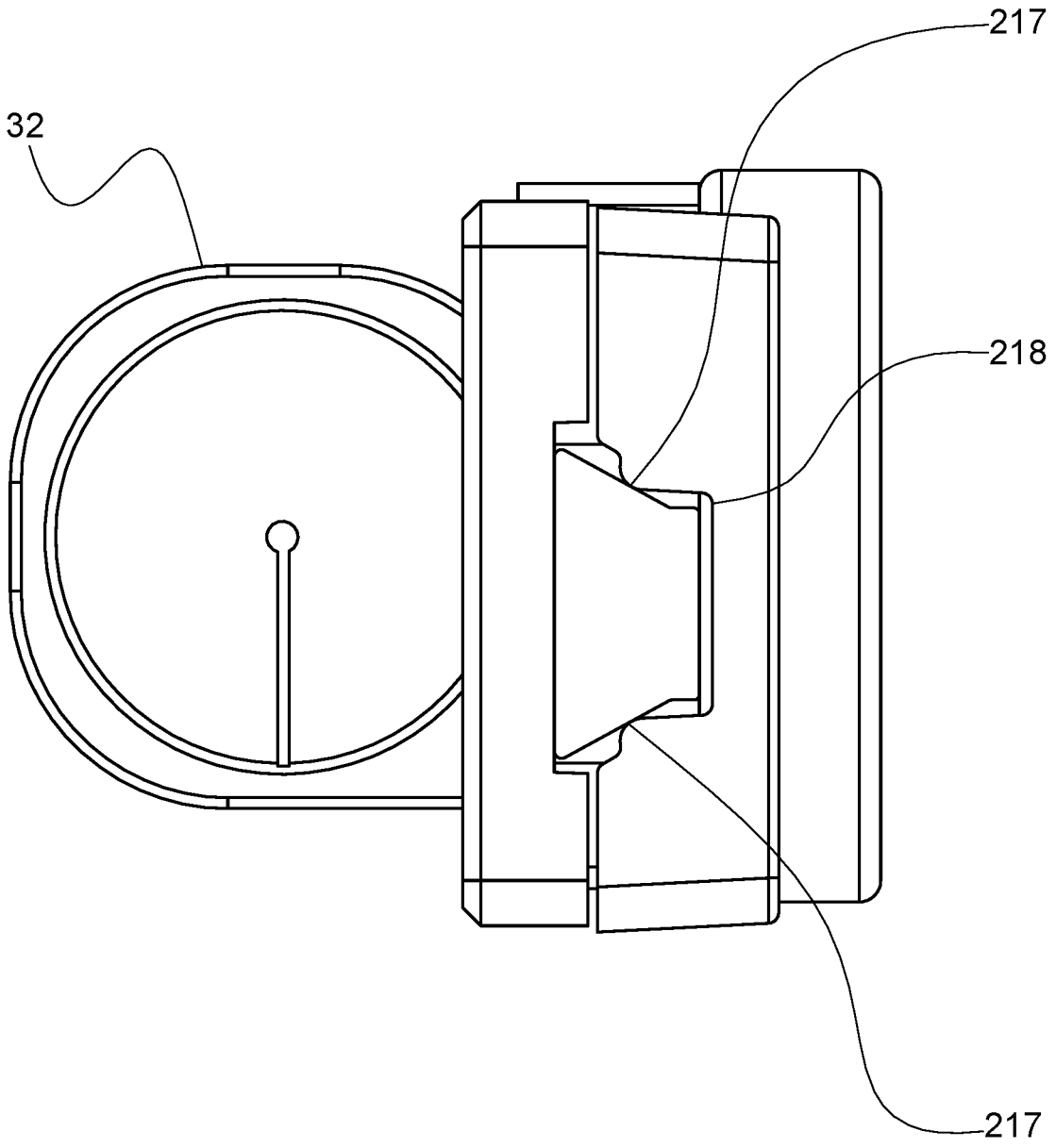
Figure 61:
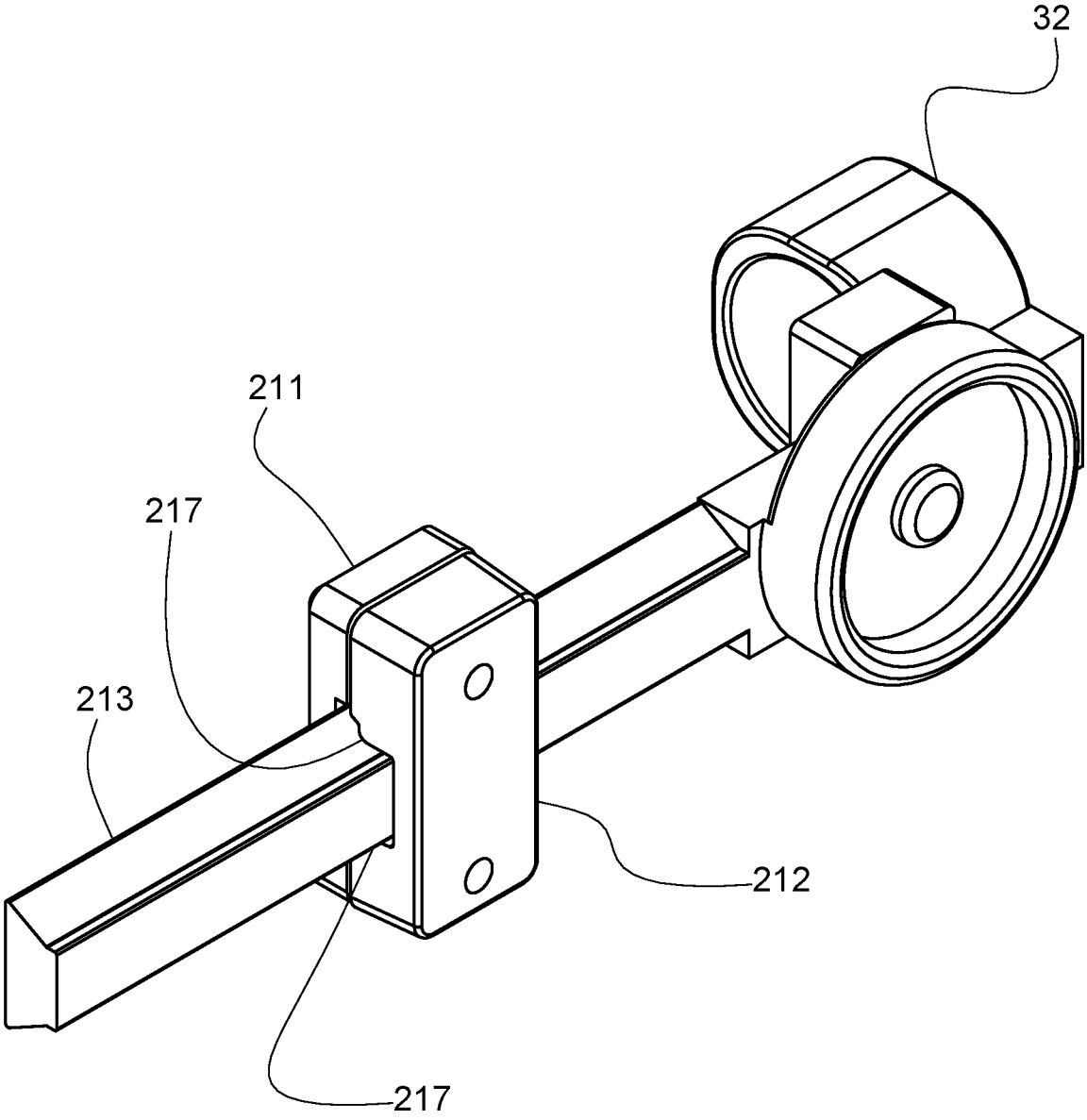

FIG. 59, FIG. 60 and FIG. 61 show how radius features 217 within mounting fixture 212 make contact on the angled surface of dove tail mount crossbar 213. The presence of radius features 217 allows secure connection of mounting fixture to dovetail cross bars that have a variety of styles and shapes and when there is a variable clearance profile 218 between mounting fixture 212 and different dovetail cross bars.

Figure 62:
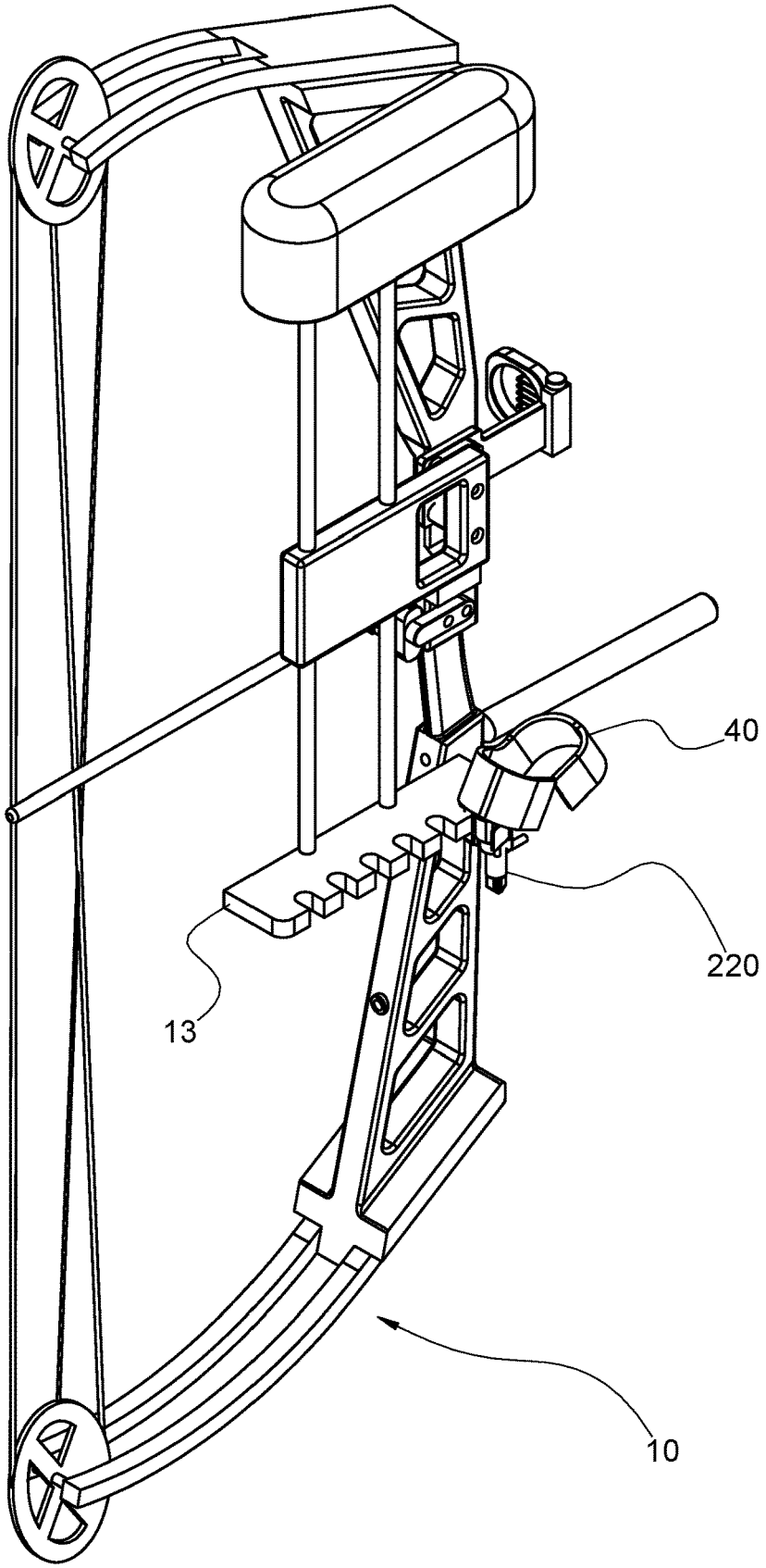
Figure 63:
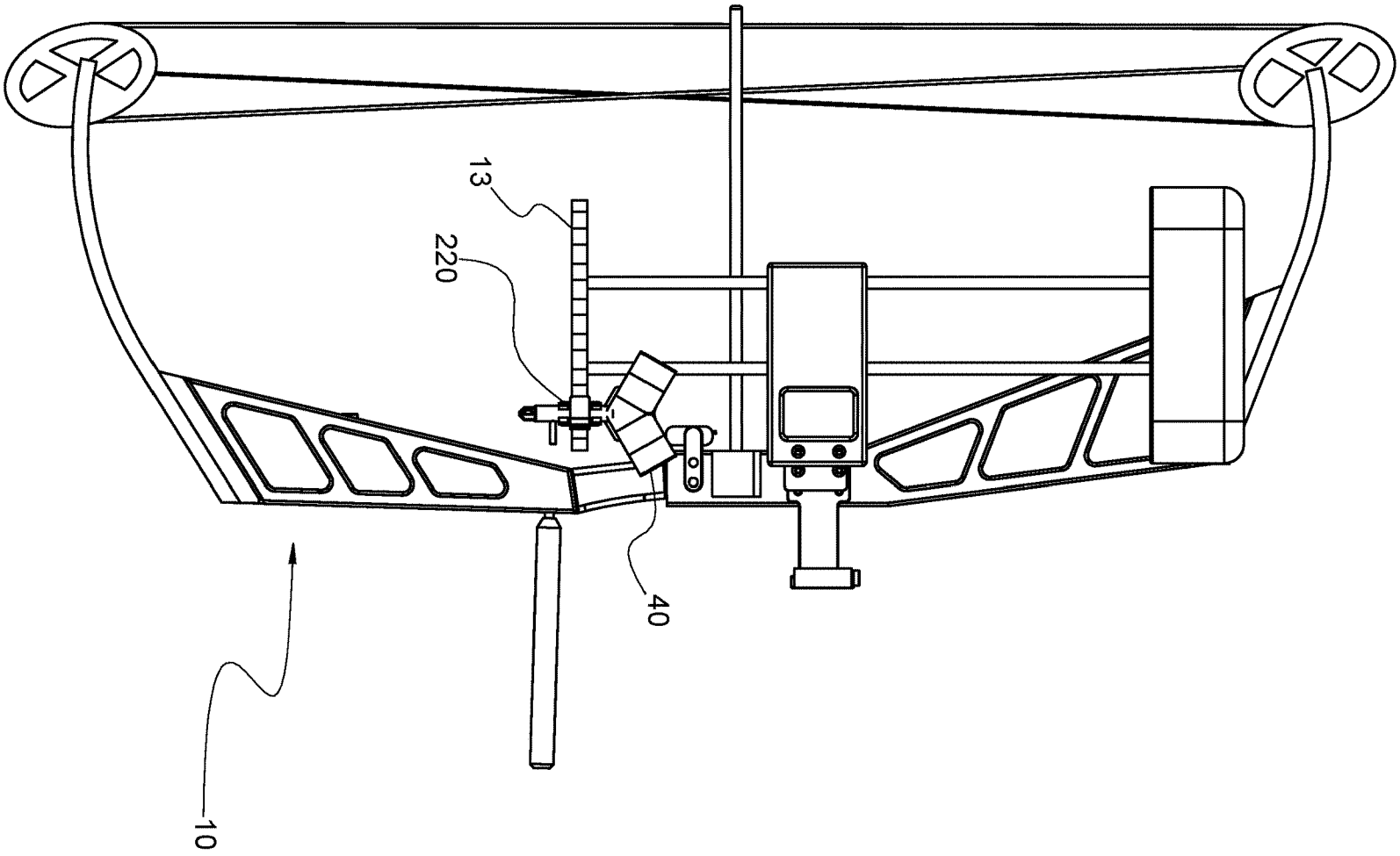

FIG. 62 and FIG. 63 show an archery release aid 220 attached to quiver arrow retainer structure 13 of bow 10. For example, archery release aid 220 is attached to quiver arrow retainer structure 13 of bow 10 using fasteners.

Alternatively, archery release aid mount 220 can be integrated into the design of the bow quiver.

Figure 64:
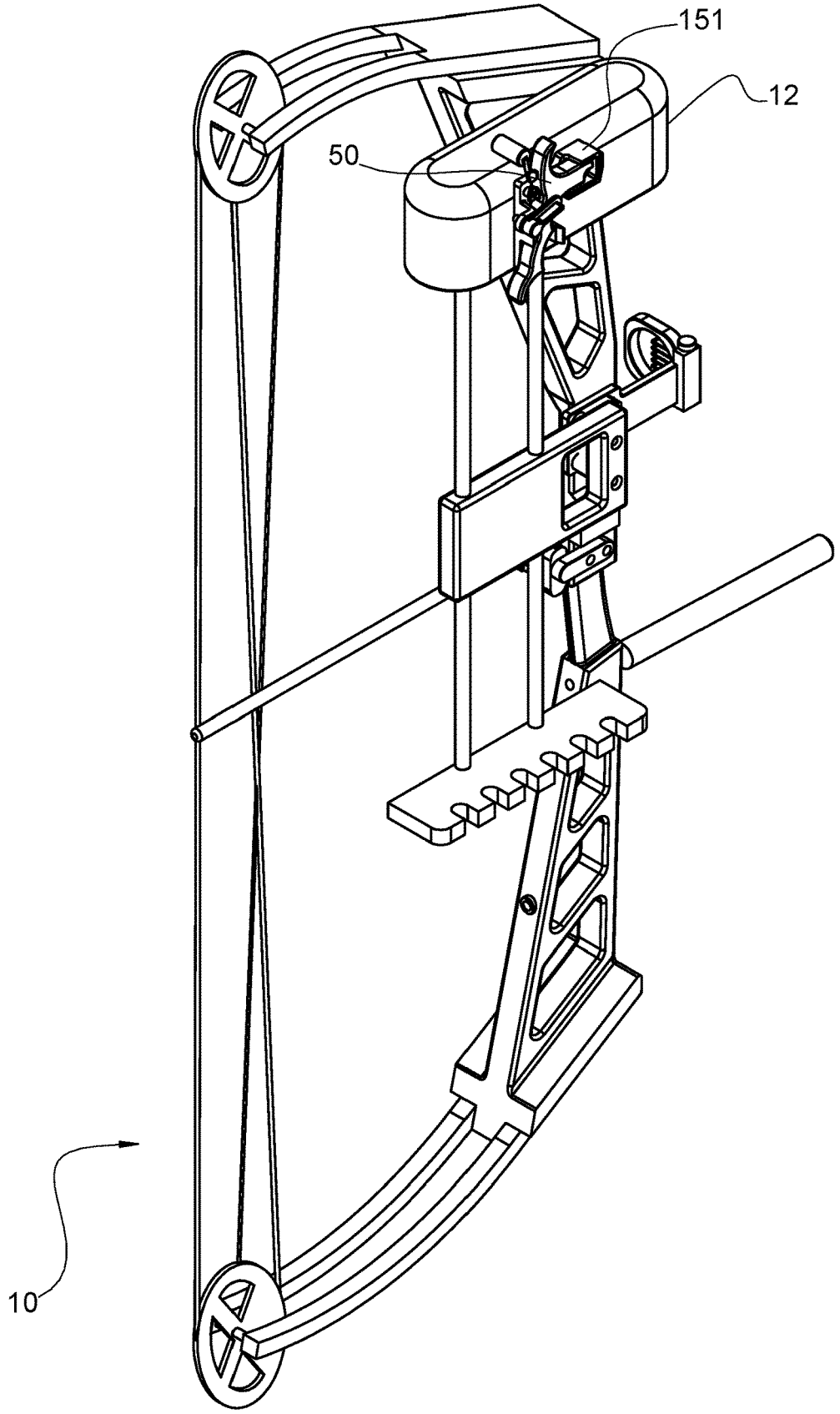
Figure 65:
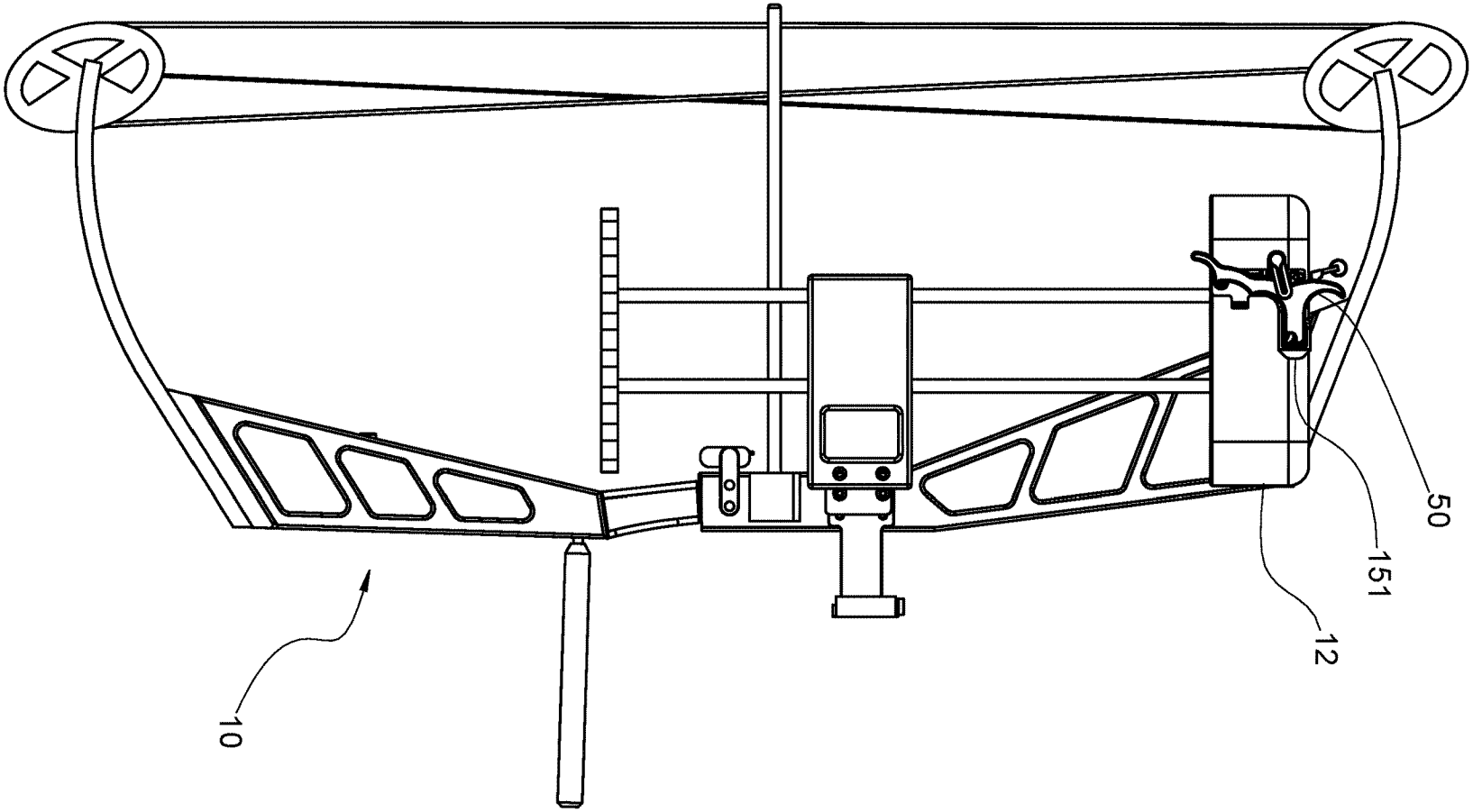

FIG. 64 and FIG. 65 show archery release aid mount 151 attached to top structure 12 of the of bow 10. For example, archery release aid mount 151 is attached to top structure 12 using fasteners. Alternatively, archery release aid mount 151 can be integrated into the design of the bow quiver.

Figure 66:
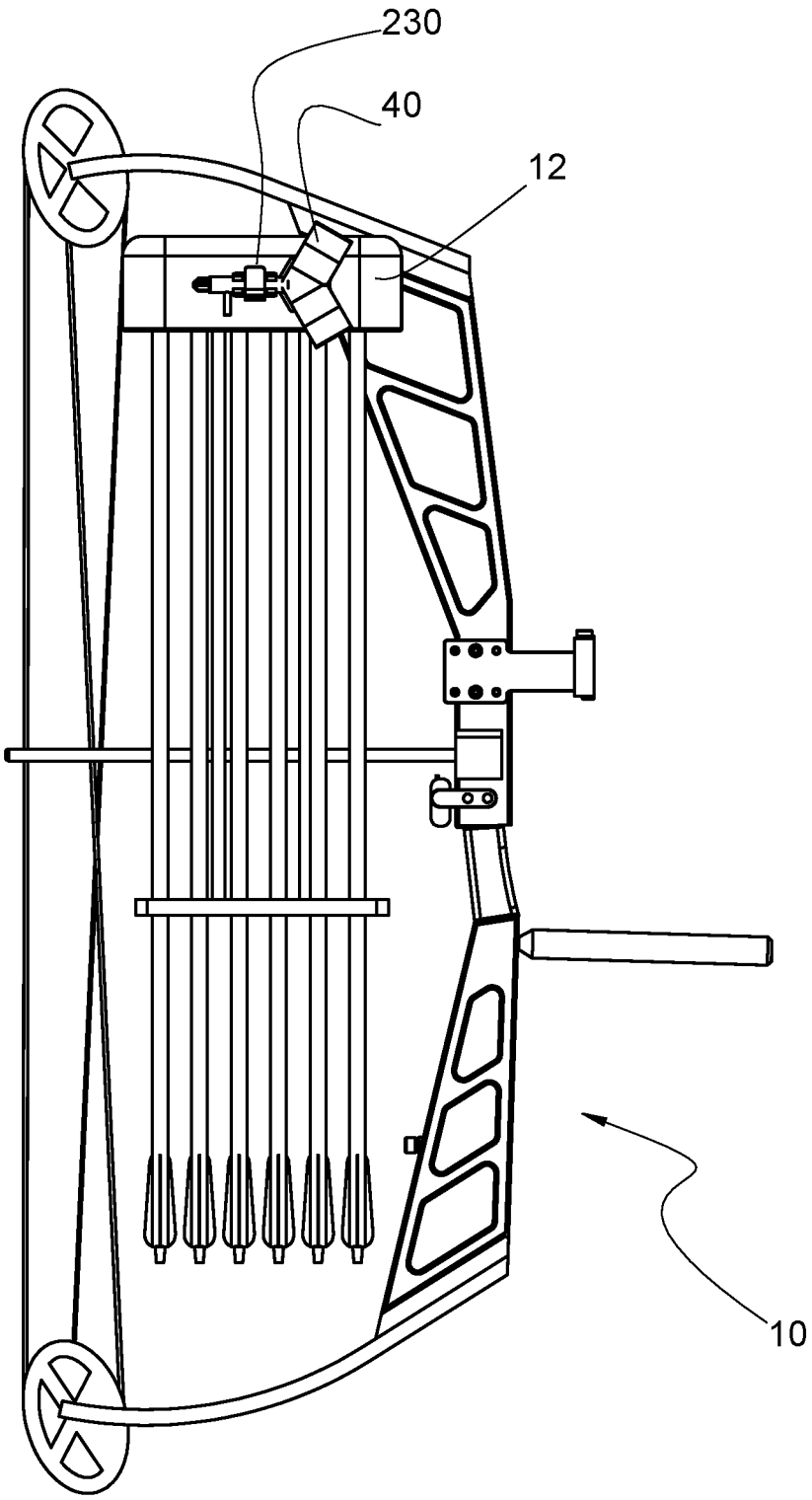
Figure 67:
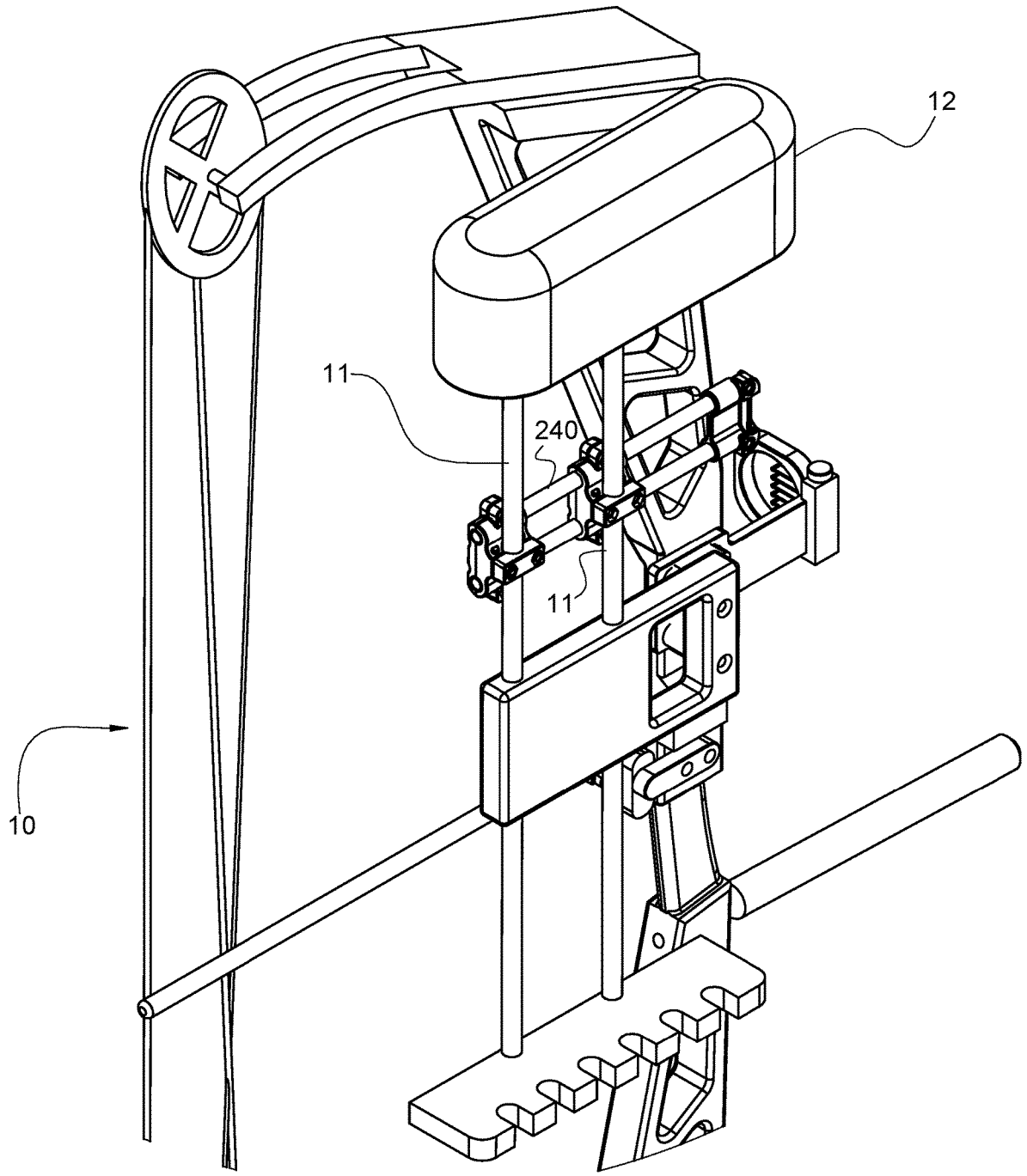
Figure 68:
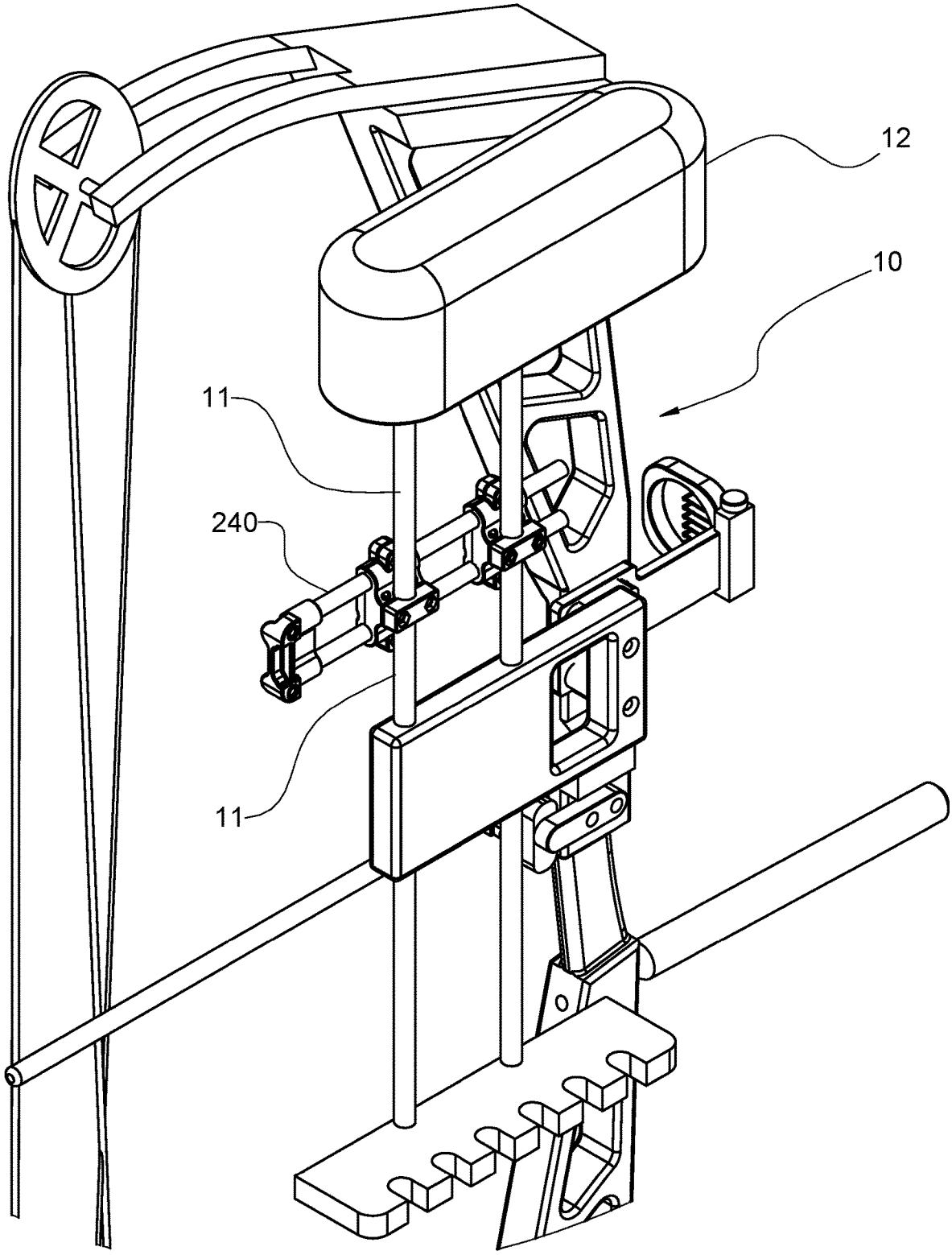

FIG. 66 shows an archery release aid mount 230 for archery release aid 40 attached to top structure 12 of the of bow 10. For example, archery release aid mount 230 is attached to top structure 12 using fasteners. Alternatively, archery release aid mount 230 can be integrated into the design of the bow quiver.

Figure 69:
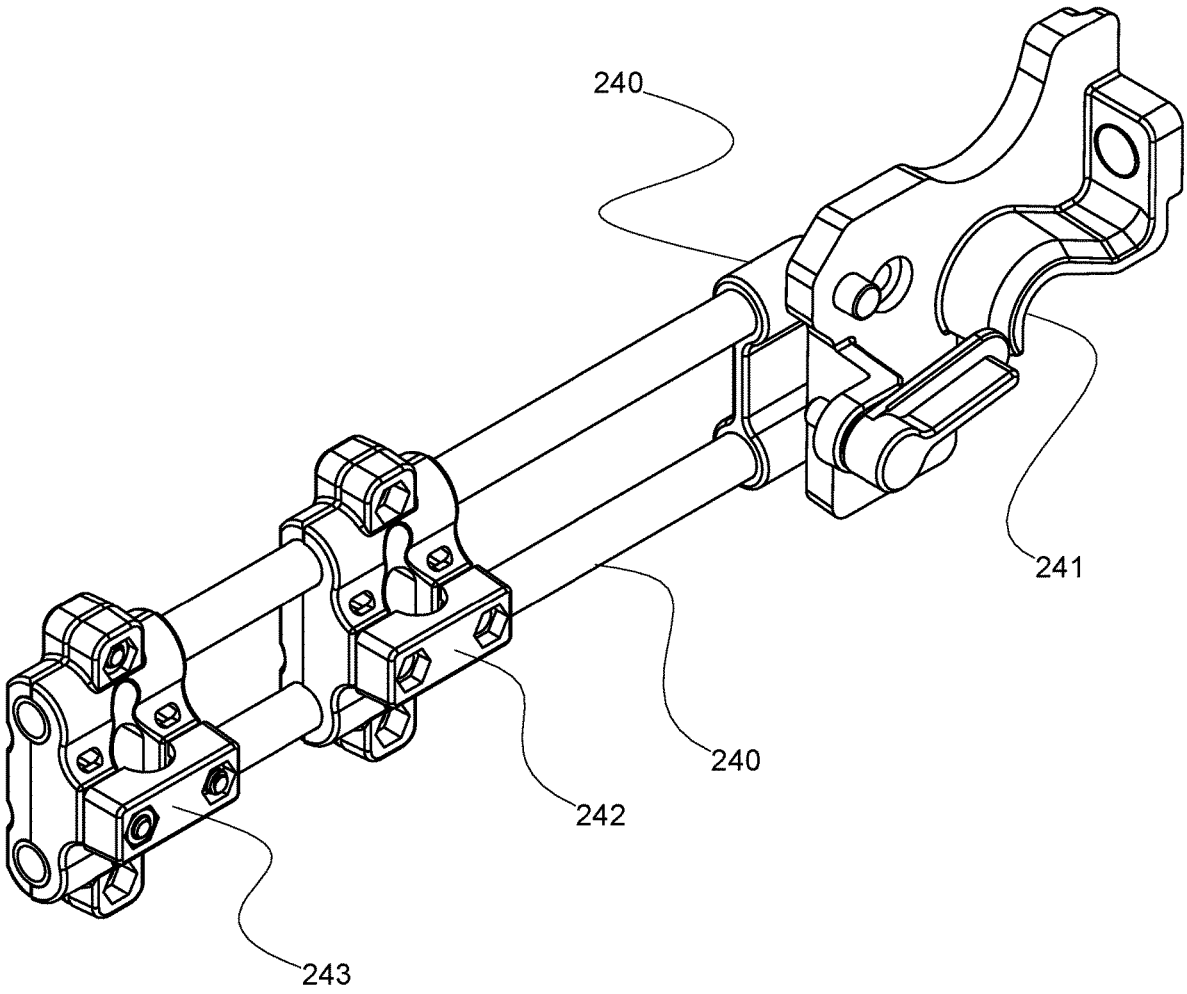
Figure 70:
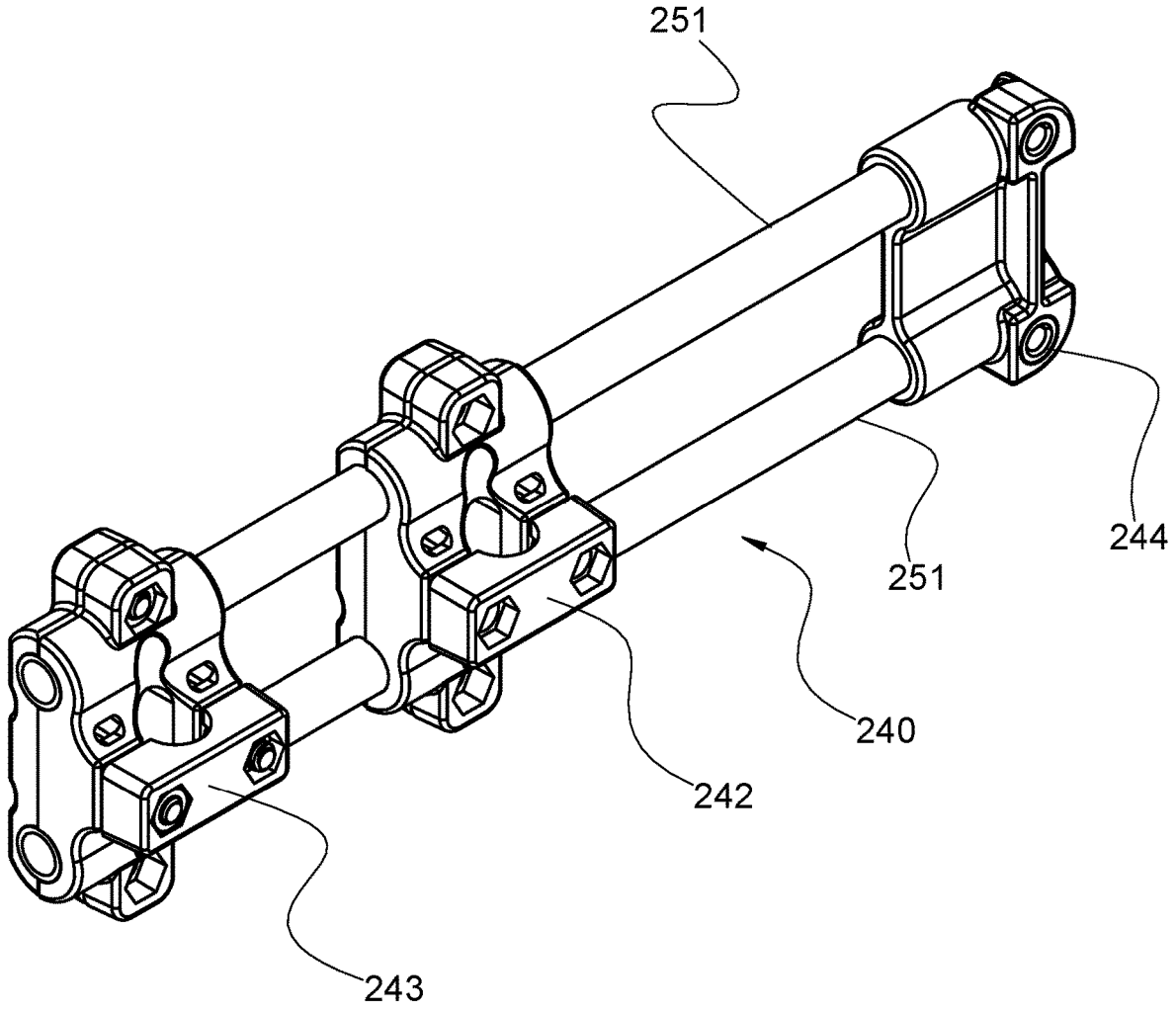

FIG. 68, FIG. 69, FIG. 70 and FIG. 71 show an accessory mount 240 that is configured to be attached to quiver support shafts 11 of the quiver for bow 10. For example, accessory mount 240 can be rotated so that the mounting surface is closer to the user. Accessory mount 240 can be positioned at different heights on the quiver by clamping at different locations along quiver support shafts 11. FIG. 69 shows an archery release aid mount 241 attached to accessory mount 240. The distance between a clam shell bracket 242 and a clam shell bracket 243 can be adjusted to match the distance between quiver support shafts 211. Clam shell bracket 242 and clam shell bracket 243 can also be used to position support shafts 251 to adjust the location of a mounting surface 244 relative to quiver support shafts 211.

Figure 71:
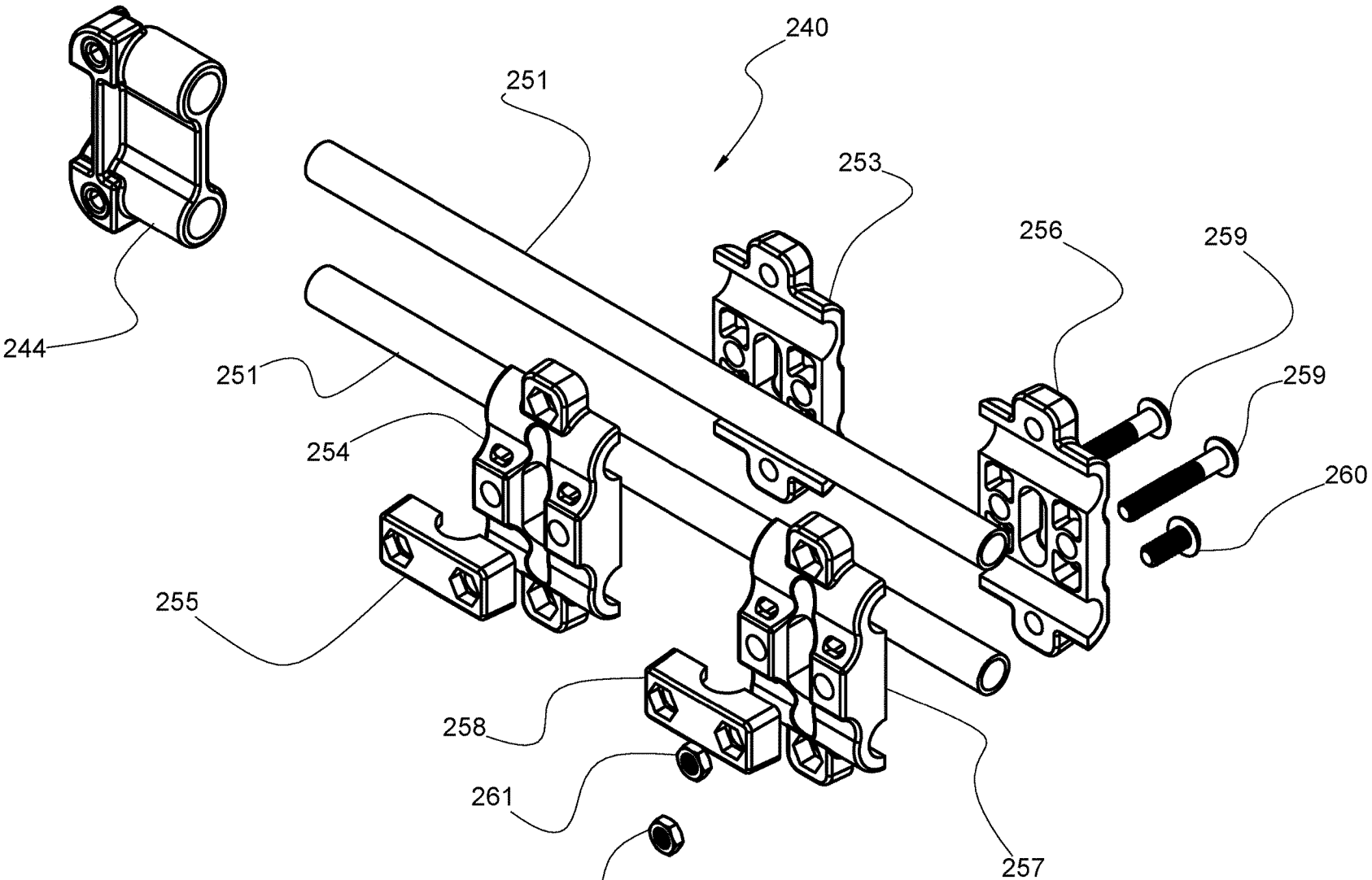

FIG. 71 shows an exploded view of accessory mount 240 where clam shell bracket 242 is shown to be composed of a clam shell clamp 253, a clam shell clamp 254 and a clamp 255. Clam shell bracket 243 is shown to be composed of a clam shell clamp 256, a clam shell clamp 257 and a clamp 258. Clamp 255 and clamp 258 capture quiver support rods allowing clam shell bracket 242 and clam shell bracket 243 to attach accessory mount 240 to quiver support shafts 211. For example, bolts 259 and nuts 261 are shown securing clamp 258 to clam shell bracket 257 and securing clam shell bracket 257 to clam shell bracket 256. Additional bolts and nuts, represented by bolt 260 are used to assemble clam shell bracket 243 and claim shell bracket 242.

Figure 72:
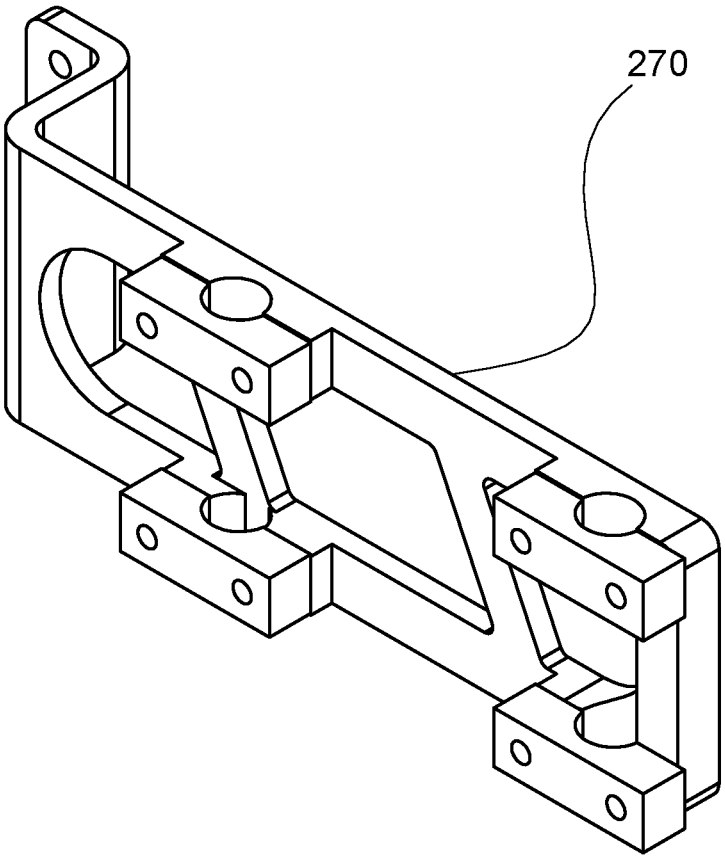

FIG. 72 shows a quiver accessory mount 270 made with fewer components. For example, quiver accessory mount 270 has limited adjustability and is configured to fit a specific quiver.

Figure 73:
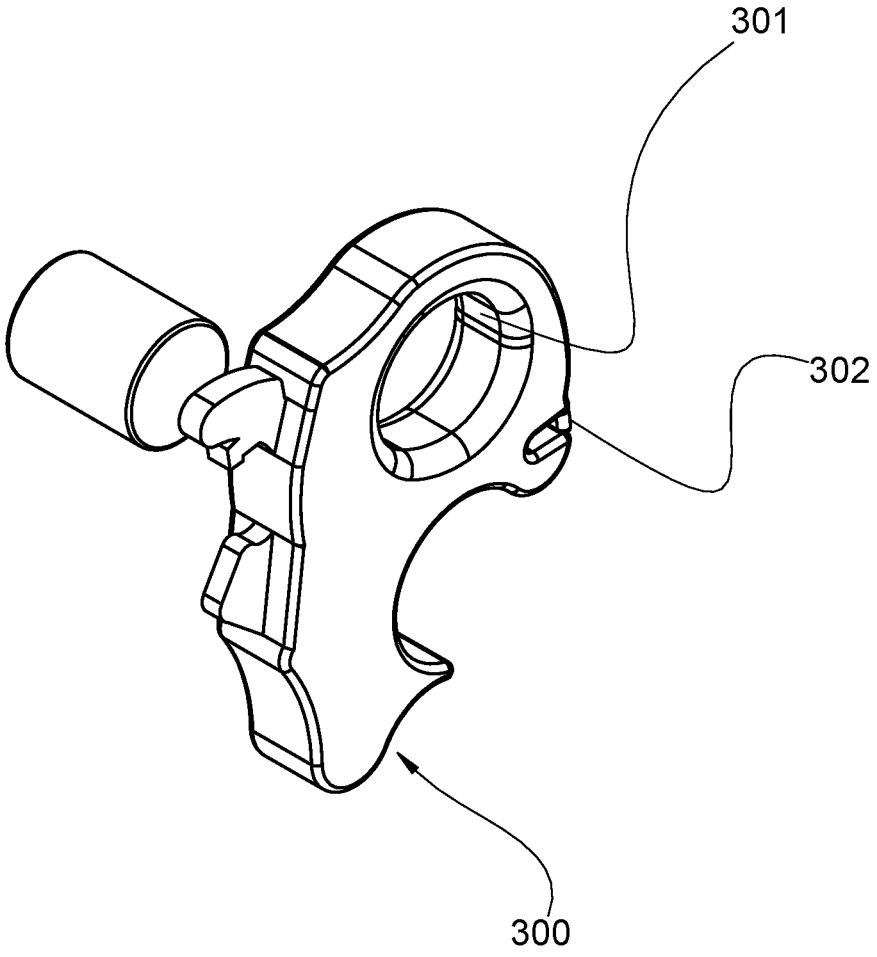
FIGURE 73 (PRIOR ART)
FIG. 73 shows an example of a prior art archery release aid.
Figure 74:
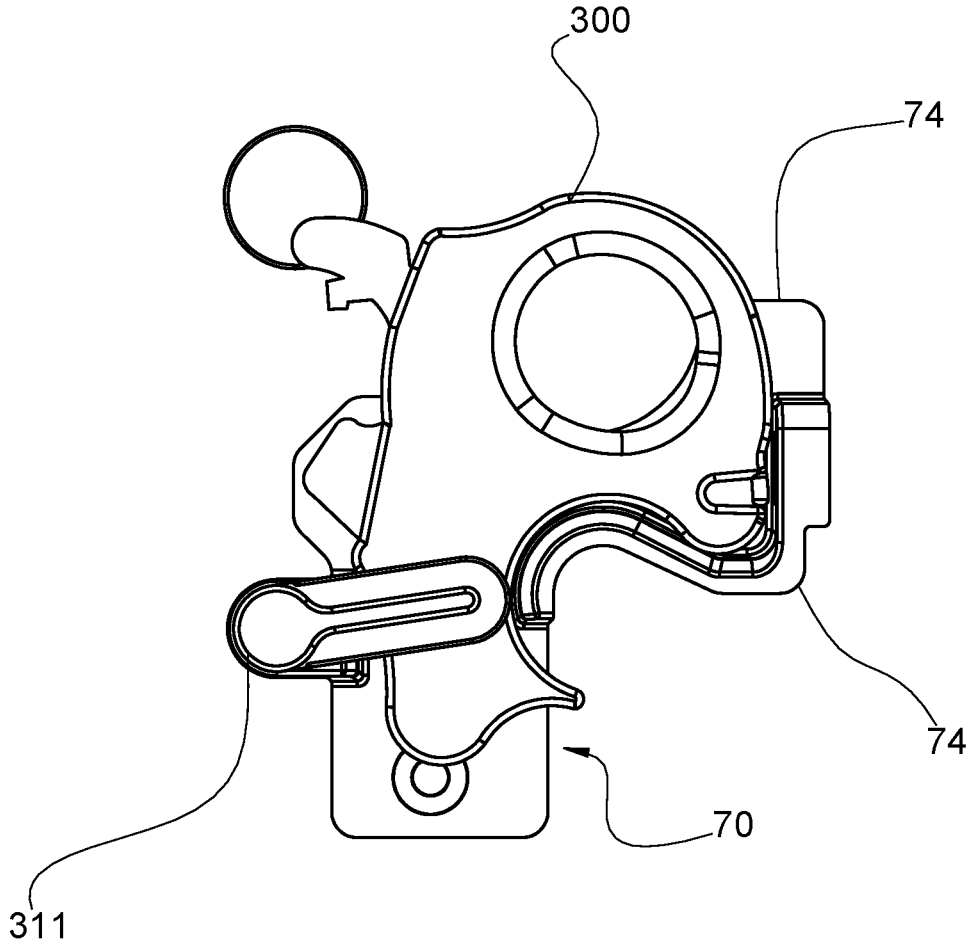
FIG. 74 shows an archery release aid secured in an archery release aid mount.

FIG. 73 shows an example of an archery release aid 300 that has a finger hole 301 and jaws 302. FIG. 74 shows archery release aid 300 secured in archery release aid mount 70, shown in FIG. 13. A region 741 of structure 74 keeps archery release aid 300 from being pushed out of archery release aid mount 70 when force is applied to archery release aid 300 near finger hole 301.

Figure 75:
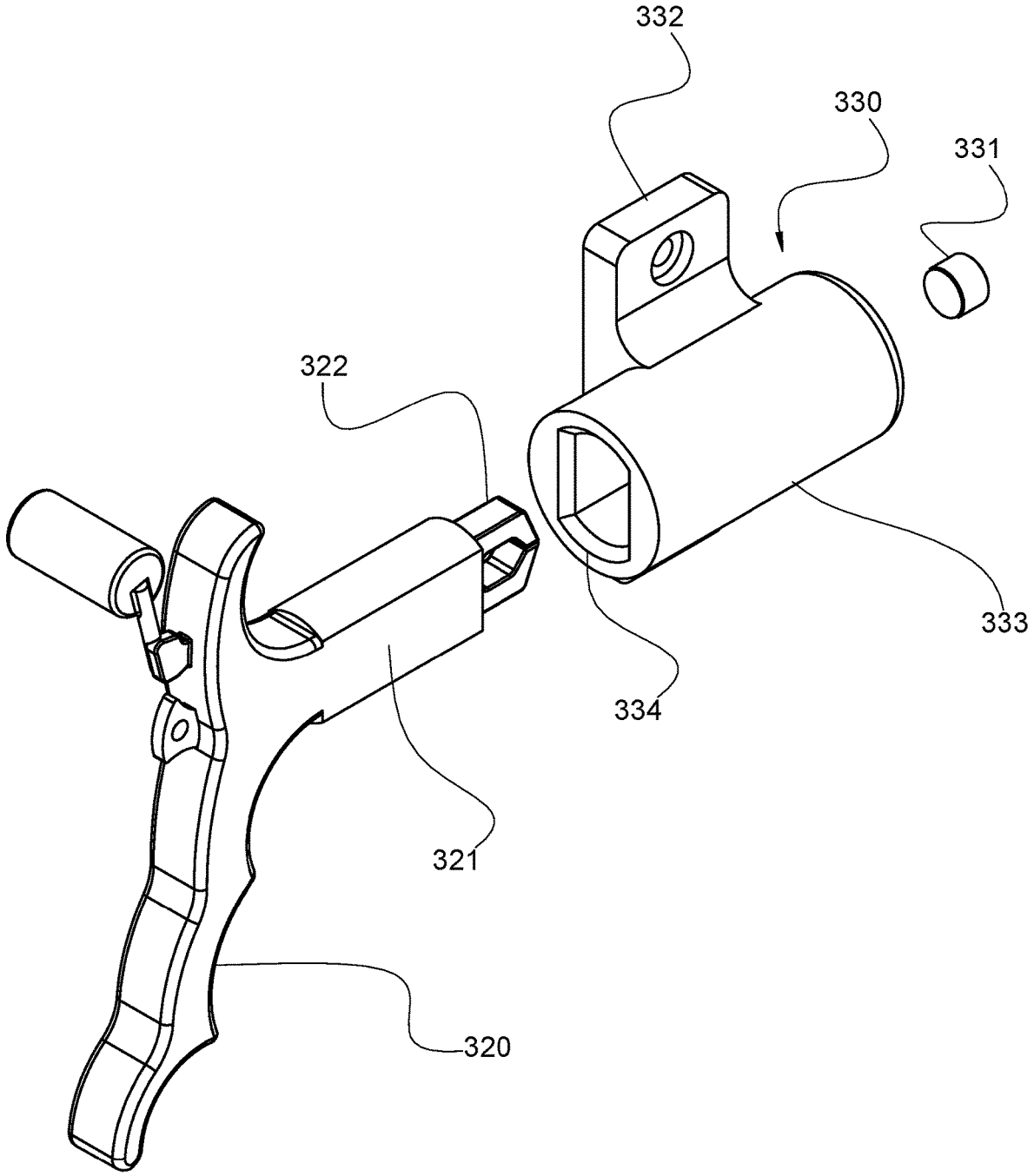
FIG. 75, FIG. 76 and FIG. 77 show an archery release aid mount that includes a mount, a magnet and a cylindrical body.
Figure 76:
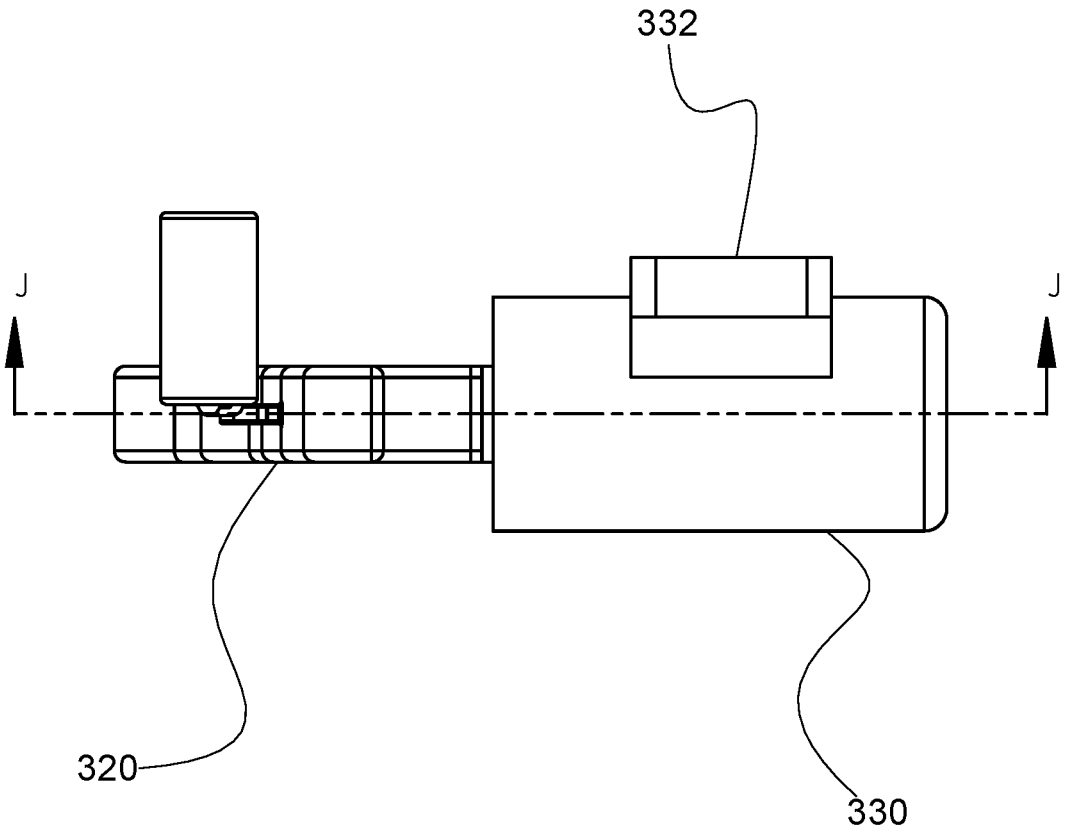
Figure 77:
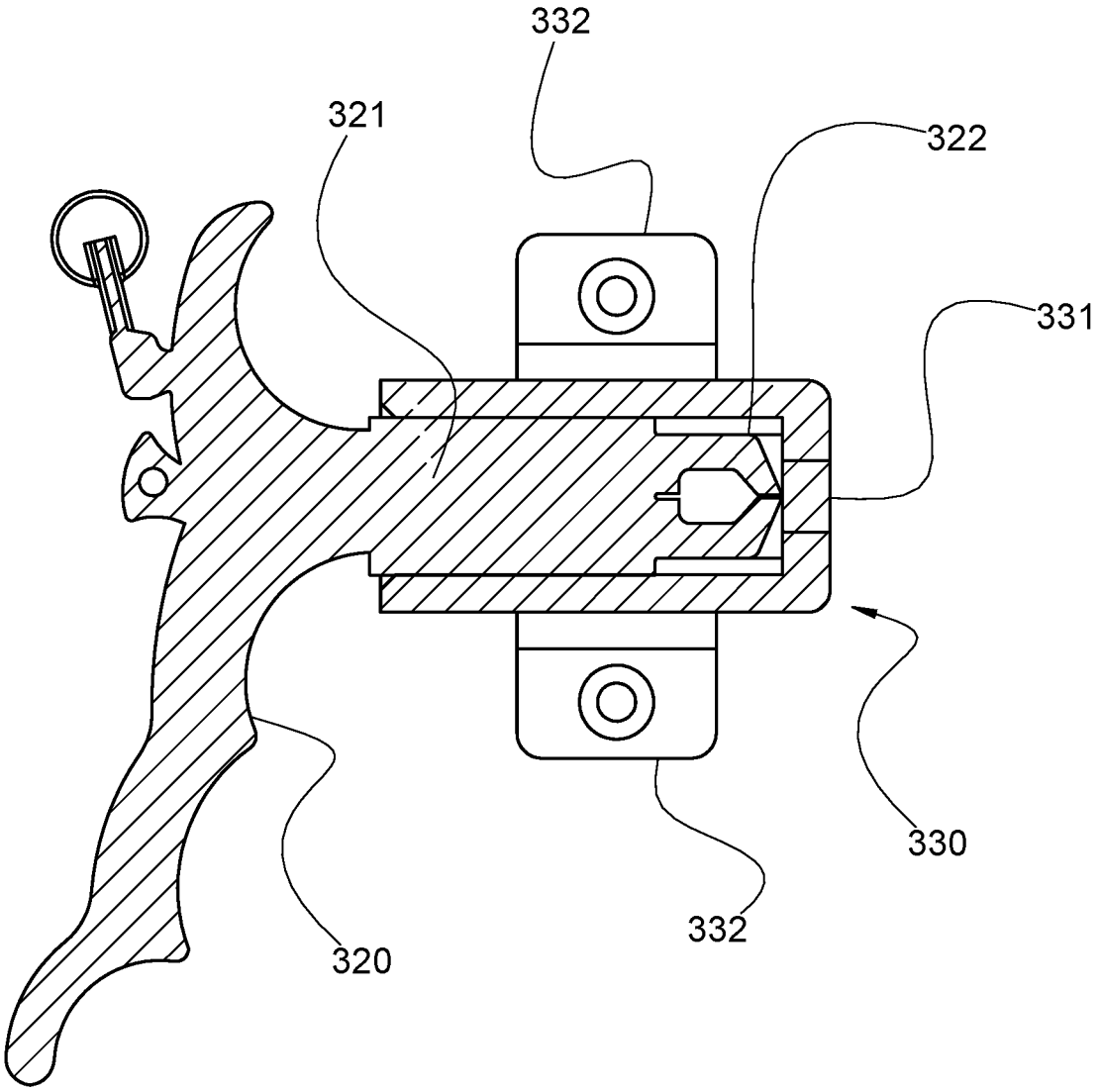
Figure 78:
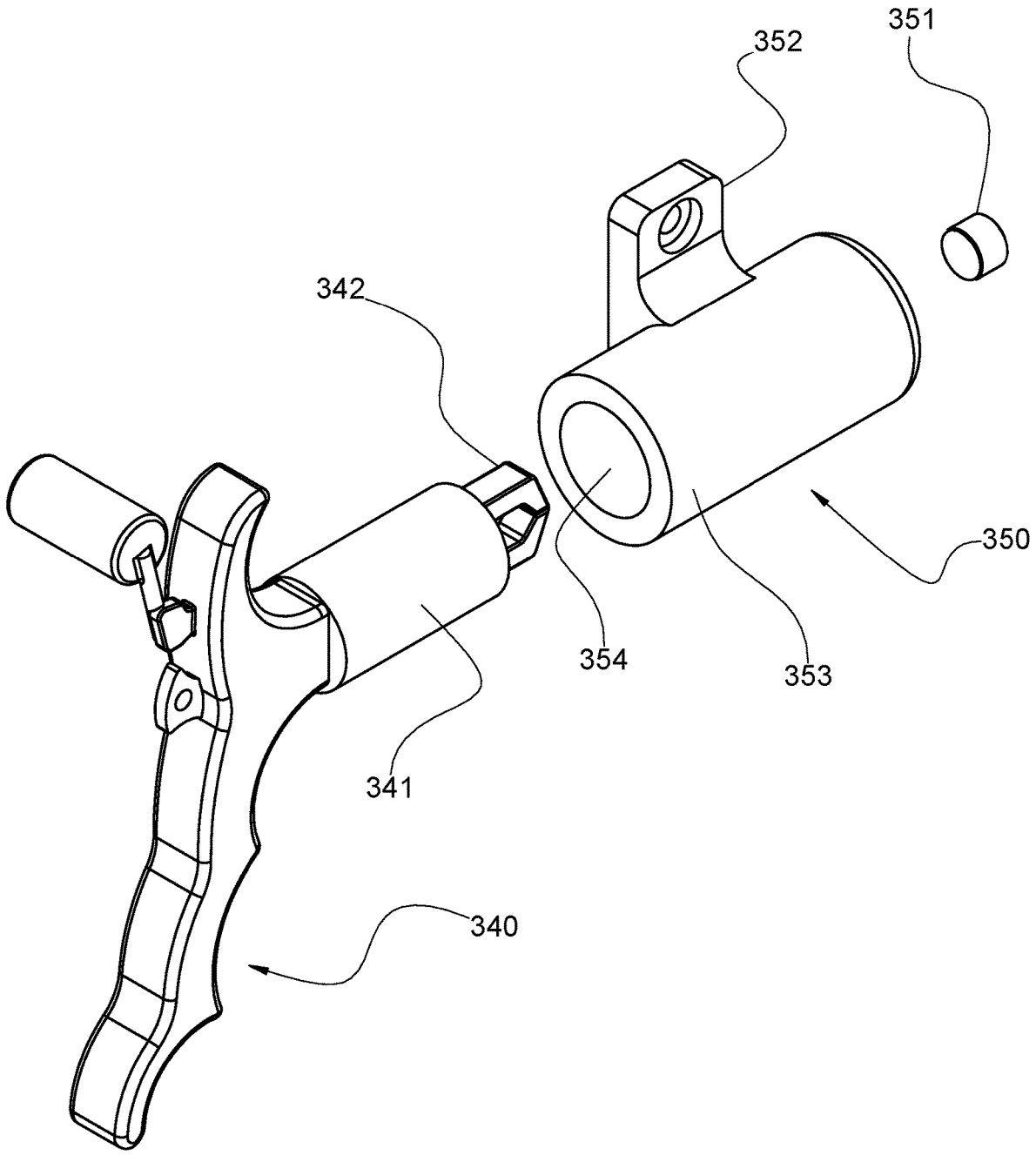
FIG. 78, FIG. 79, FIG. 80, FIG. 81 and FIG. 82 show an archery release aid mount that includes a mount, a magnet and a cylindrical body.
Figure 79:
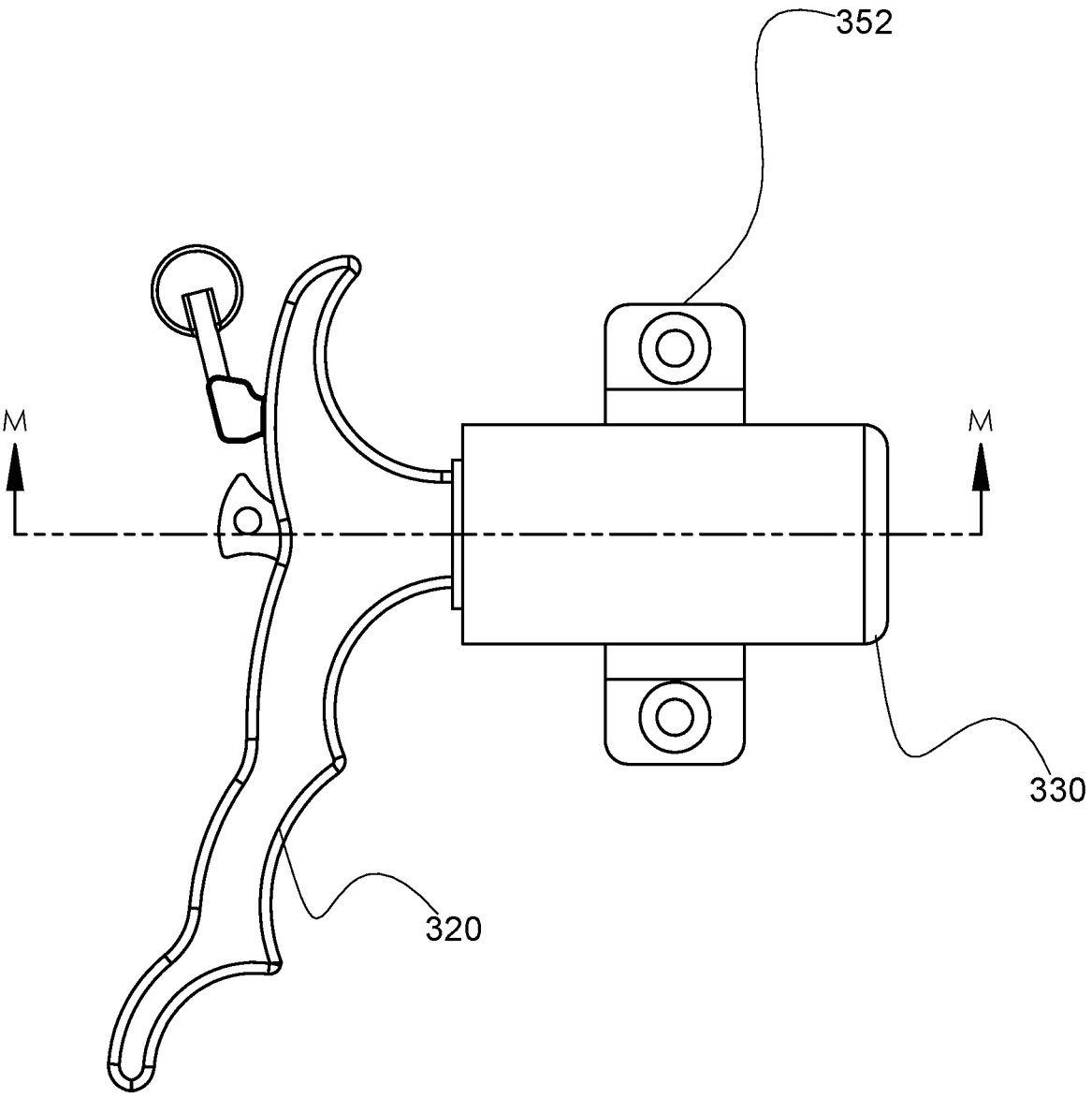
Figure 80:
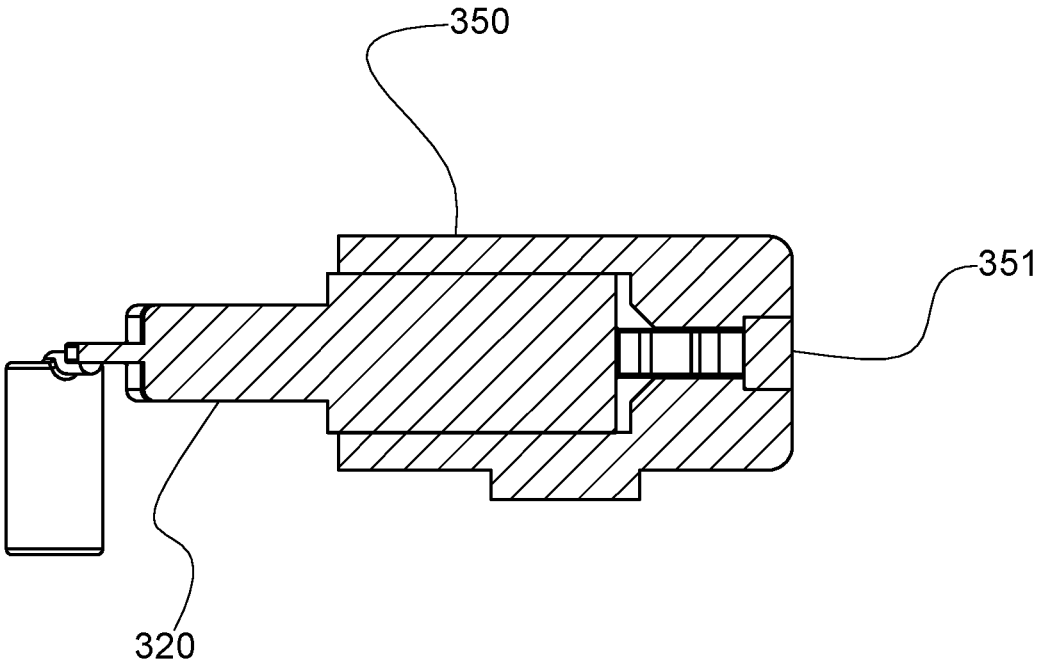
Figure 81:
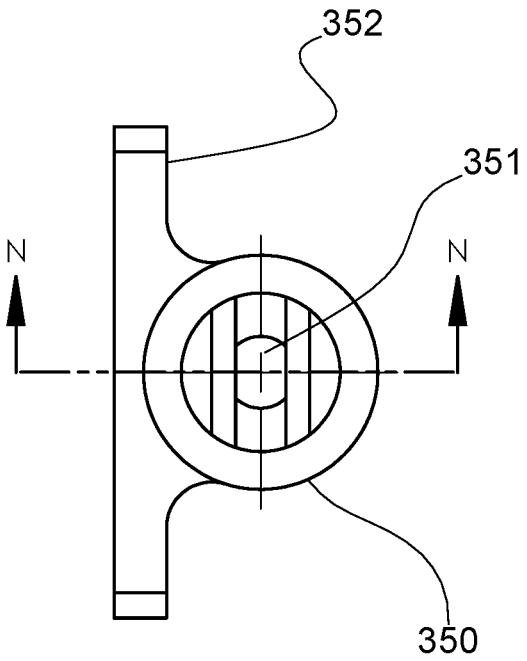
Figure 82:
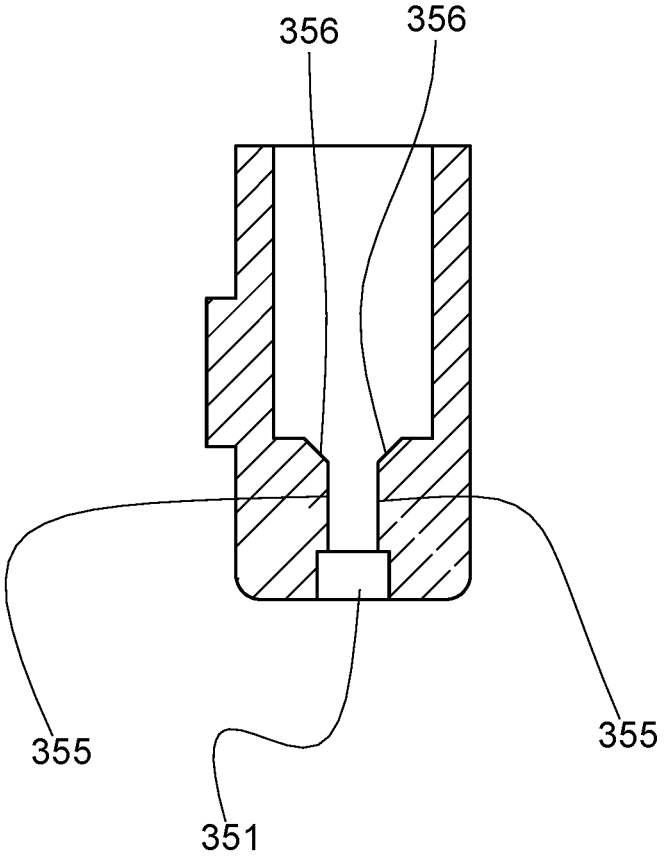

FIG. 75, FIG. 76 and FIG. 77 show an archery release aid mount 330 that includes a mount 332, a magnet 331 and a cylindrical body 333. An opening 334 receives a shaft 321 of an archery release aid 320. Opening 334 within cylindrical body 333 is shaped to generally match the shape of shaft 321 of archery release aid 320 in order to prevent rotation of archery release aid 320 when held by archery release aid mount 330. Opening 334 may additionally have rounded surface to keep archery release aid 320 centered. Magnet 331 attracts jaws 322 of archery release aid 320 to maintain archery release aid 320 within archery release aid mount 330.

FIG. 78, FIG. 79, FIG. 80, FIG. 81 and FIG. 82 show an archery release aid mount 350 that includes a mount 352, a magnet 351, a cylindrical body 353. An opening 354 receives a cylindrical shaped shaft 341 of an archery release aid 340. Opening 354 within cylindrical body 353 is rounded to generally match the shape of shaft 341 of archery release aid 340. In order to prevent rotation of archery release aid 340 when held by archery release aid mount 350, walls 355 near magnet 351 are narrowed to match the shape of jaws 342 of archery release aid 340 and to provide a keying feature preventing rotation. Tapering at locations 356 aid in alignment when placing cylindrical shaped shaft 341 of an archery release aid 340 within opening 354. Magnet 351 attracts jaws 342 of archery release aid 340 to maintain archery release aid 340 within the archery release aid mount 350.

Figure 83:
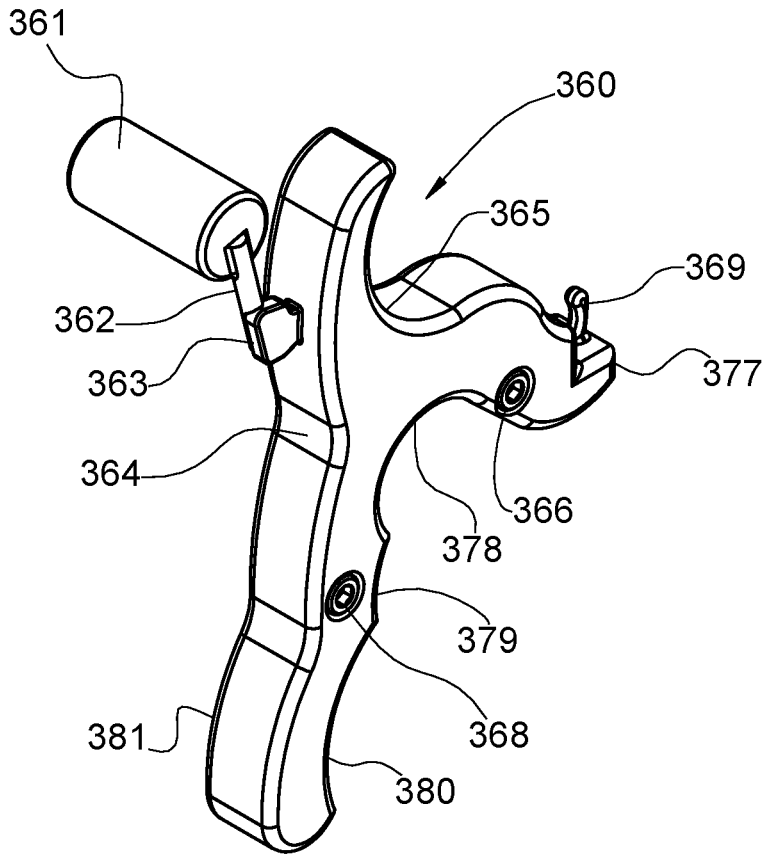
FIG. 83 is a perspective view of an embodiment of an archery release aid.

FIG. 83 is a perspective view of an archery release aid 360 that includes a thumb trigger 361 attached to an arm 362, coupled to a mechanical reset 363, which is attached to the structure 365. An archery user's hand will grip the structure 365 on the upper and lower palm surfaces 364, 381, and along finger contours 378, 379, and 380. The thumb trigger 361 is coupled to a jaw 369, disposed on a ledge 377, that captures the bow string (not shown). One suitable archery release aid is the Spott Hogg Whipper Snapper, which can be purchased online or at an archery store.

In an embodiment, the structure 365 is made of a rigid material such as metal, steel, or stainless steel, but alternatively may be made of non-magnetic rigid material (e.g., ABS). In the alternative embodiment, where the structure 365 is made of a non-magnetic material, upper contact 366 and lower contact 368 can be made of a suitable metal (e.g., a ferrous material, steel, or stainless steel) that is attracted by the magnets 371, 373, disposed in the holder 370 as shown in FIGS. 84-87. In still another embodiment, the magnets are on the structure 365 and the holder 370 is made off a suitable metal or has metal contacts opposite the magnets on the structure 365.

Figure 84:
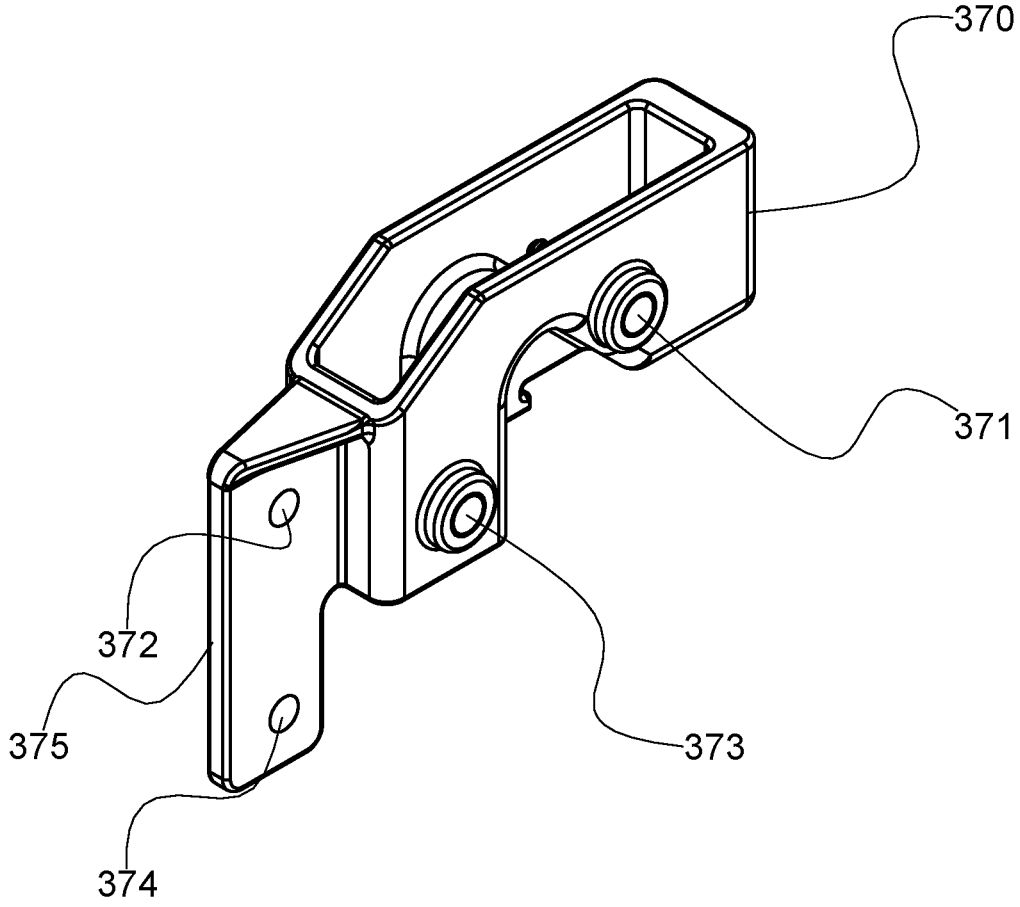
FIG. 84 is a perspective view of an embodiment of a holder of an archery release aid mount that is suitable for an archery release aid.

FIG. 84 is a perspective view of an embodiment of a holder 370 for securing the archery release aid 360 shown in FIG. 83. In an embodiment, the holder 370 can be machined in metal, or made of another rigid material by injection molding or by 3D printing. In the embodiment, the holder 370 includes a mounting bracket 375 having a top hole 372 and a bottom hole 374 for bolts to secure to a bow (not shown) and again the magnets 371, 373.

Figure 85:
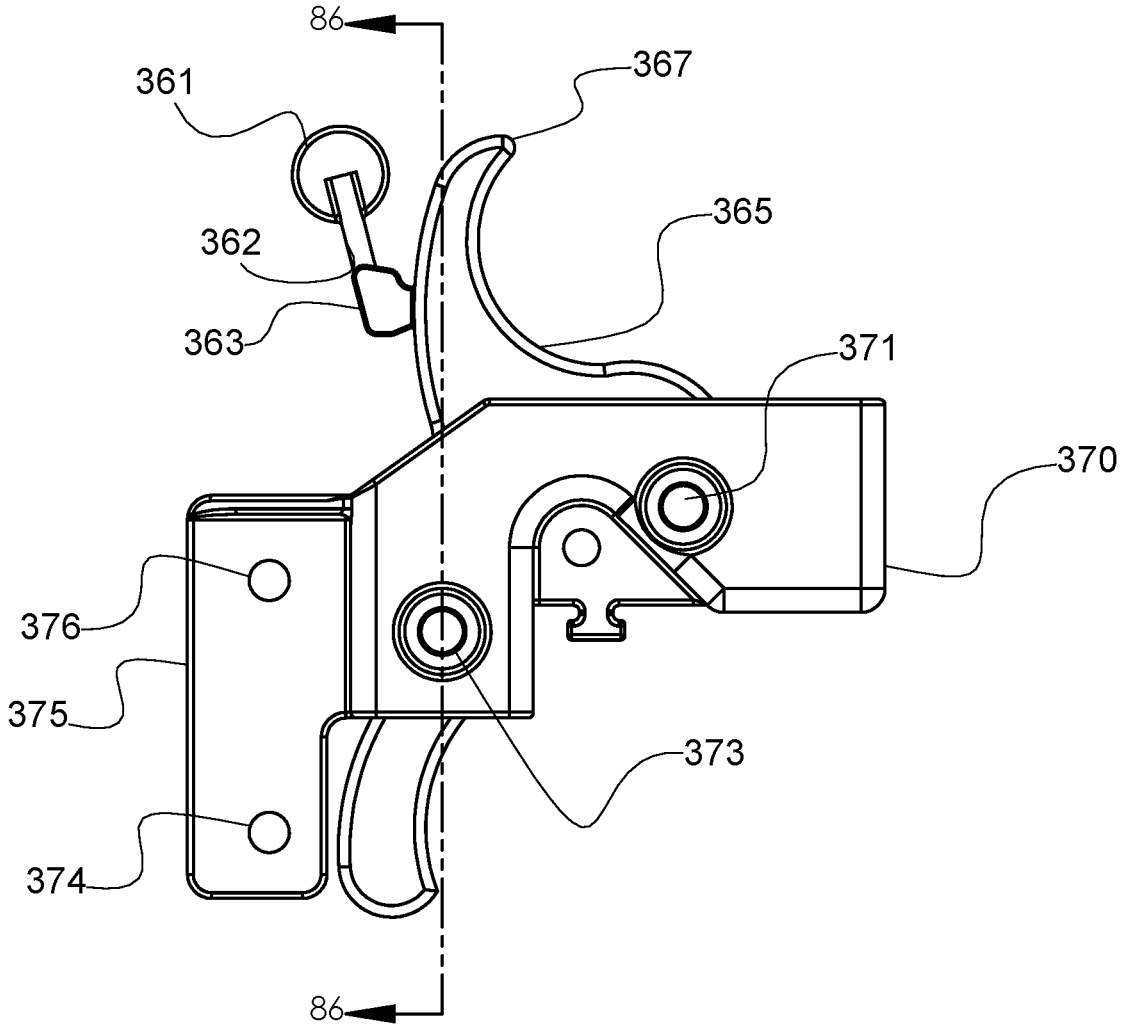
FIG. 85 is a side view of the archery release aid shown in FIG. 83 held in the holder shown in FIG. 84.

FIG. 85 is a side view of the archery release aid 360 secured in the holder 370 as described earlier and shown in FIGS. 83-84. When the archery release aid 360 sits within the holder 370, the upper magnet 371 is opposite, attracted, and preferably physical contacts the upper contact 366 (FIG. 83), and the lower magnet 373 is opposite, attracted and preferably physical contacts the lower contact 368 (FIG. 83). In an embodiment, the holder 370 includes two magnets (e.g., upper magnet 371 and lower magnet 373) where each magnet has 4-8 lbs. of pull force. This keeps the archery release aid 360 secure in the holder 370 during non-operation, but readily removable when the user wants to use the archery release aid 360 during operation, e.g., shooting of arrows.

FIG. 85 also illustrates the top 367 of the structure 365 of the archery release aid 360 as well as the thumb trigger 361, the arm 362, and the mechanical reset 363 attached to the structure 365. FIG. 85 also shows the embodiment has two holes 374, 376 in the mounting bracket 375 that extend from the holder 370.

Figure 86:
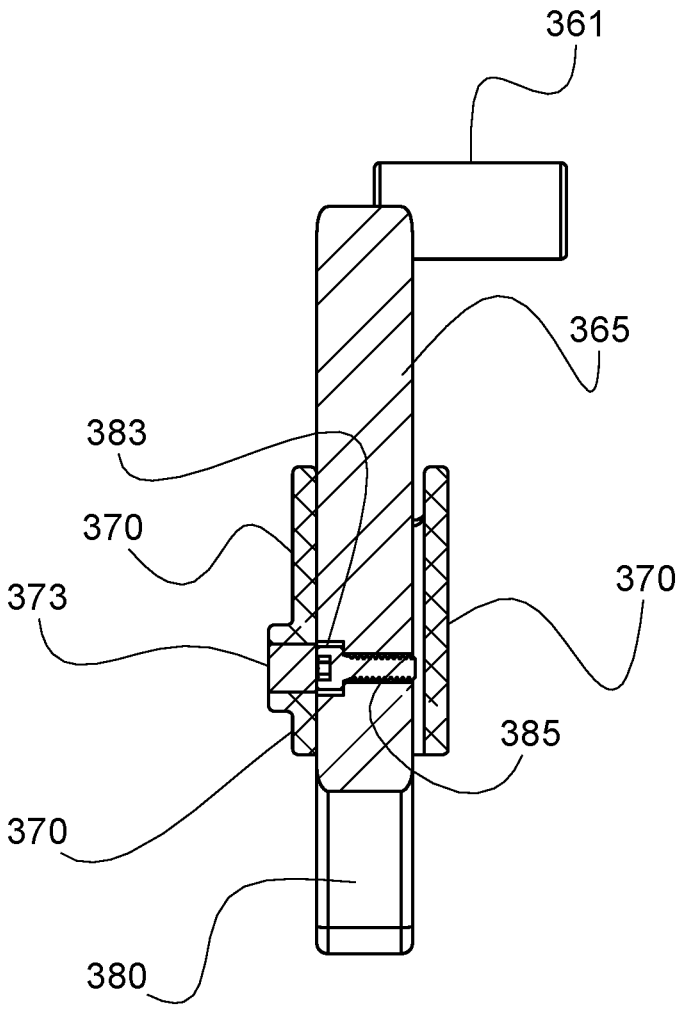
FIG. 86 is a cross-sectional view of the archery release aid and the holder along line 86-86 in FIG. 85.

FIG. 86 is a cross-sectional view of another embodiment of the archery release aid 360 including thumb trigger 361 coupled to structure 365 and the holder 370 along line 86-86 shown in FIG. 85. The details of the archery release aid 360 and the holder 370 remain the same or similar as described before and shown in FIGS. 83-85.

In this embodiment, FIG. 86 shows a machine screw 383 that functions as the contact 368 shown in FIG. 83. Machine screw 383 is threaded into a threaded hole 385 in the structure 365 and is magnetically attracted to the lower magnet 373 in the holder 370. The same or similar type of machine screw (not shown) functions as contact 366 (FIG. 83) and is threaded in the structure 365, and is magnetically attracted to the upper magnet 371 (FIG. 85) in the holder 370.

Figure 87:
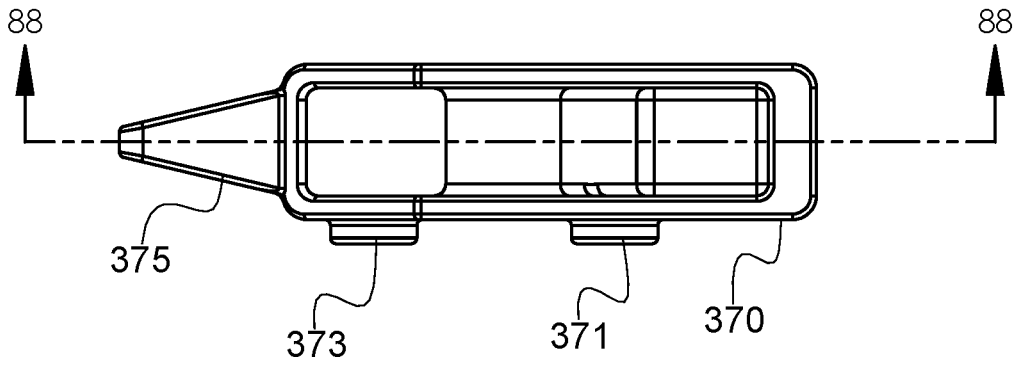
FIG. 87 is a top view of an embodiment of the holder.

FIG. 87 is a top view showing the holder 370, the upper magnet 371, the lower magnet 373, and the mounting bracket 375. As shown in the top view, the holder 37 is a rectangular shaped box. The mounting bracket 375 extends from an end wall that joins the two side walls which are parallel to each other. The upper magnet 371 and the lower magnet 373 are mounted on the holder 370 nearby or in contact with the archery release aid 360 with sufficient magnetic force to secure the archery release aid 360 in the holder 370 as described earlier. The archery release aid 360 can be made of metal, or include one or more metal contacts in the structure 365 (e.g., machine screw 383) that are contact or are sufficiently near to be magnetically attracted to the magnets 371, 372 in the holder 370.

Figure 88:
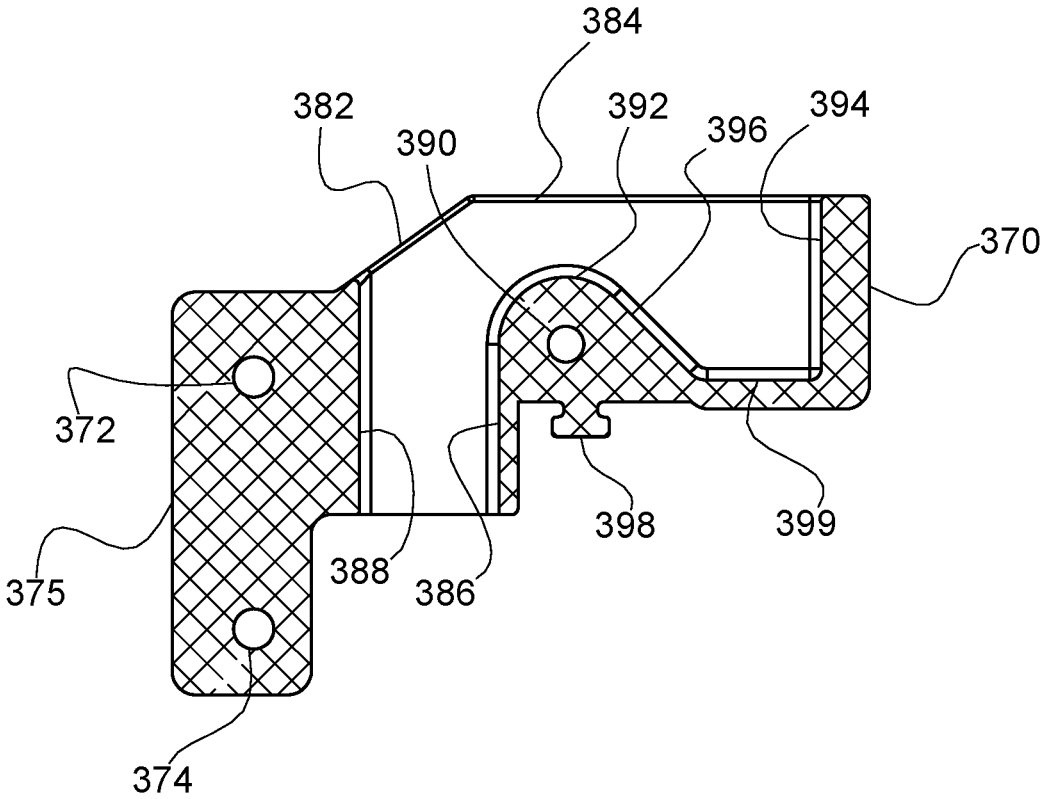
FIG. 88 is a cross-sectional view of the holder along line 88-88 shown in FIG. 87.

FIG. 88 is a cross-sectional view of the holder 370 along line 88-88 in FIG. 87. As shown, the top surface 384 of the holder 370 includes an edge 382 that slants down toward the mounting bracket 375 with holes 372, 374, to facilitate entry and removal of the archery aid release 360 (FIG. 83) from the holder 370.

As shown in FIGS. 85 and 88, both the side walls and internal space of the holder 370 define a L-shape with a corner removed (i.e., rotate holder 370, about 90 degrees counter-clockwise to see L-shape). The bottom of the holder 370 includes an opening of a vertical front wall 388 and a vertical back wall 386 that surround the grip portion of the structure 365 (FIG. 83). The holder 370 is also partly closed at the bottom with a crest 392, a ramp 396, a bottom wall 399, and a back wall 394 that support the ledge 377 of the archery release aid 360. FIG. 88 shows a strap hole 390 and a peg 398 to secure the holder 370 to the user.

This specification describes various embodiments. The subject matter may be embodied in other forms. Various materials can be used to manufacture the various parts such as metal, stainless steel, and/or fiberglass. Accordingly, the present disclosure is illustrative, but not limiting, of the scope, which is set forth in the following claims.

What is claimed:

1. An archery release aid holder, comprising: a rectangular box shaped holder comprising spaced apart side walls, spaced apart end walls that join the side walls to form a box with an open top and a partly closed bottom, and magnet(s) mounted on a side wall to releasably secure an archery release aid within the rectangular box shaped holder.

2. The archery release aid holder of claim 1, further comprising a mounting bracket extending perpendicularly from one of the end walls to secure the holder to the bow.

3. The archery release aid holder of claim 2, wherein the mounting bracket includes a top hole and a bottom hole for bolts to secure the mount to the bow.

4. The archery release aid holder of claim 1, wherein the holder substantially conforms but is shorter than the height of the archery release aid which protrudes above the top of the holder for user access.

5. The archery release aid holder of claim 1, wherein the one or more magnets include an upper magnet and a lower magnet in close proximity to a metal structure in the archery release aid so as to exert a magnetic force that secures the archery release aid within the holder.

6. The archery release aid holder of claim 1, wherein the holder includes a front vertical wall and a back vertical wall that define an opening for a finger contour and a lower palm surface of the archery release aid to protrude beyond the bottom of the holder.

7. The archery release aid holder of claim 1, wherein the holder includes a closed bottom side includes a crest and a ramp that substantially conform to a ledge of the archery release aid.

8. The archery release aid holder of claim 1, wherein the side walls of the holder are parallel to each other and define a L-shape surface with a removed corner.

9. The archery release aid holder of claim 1, wherein the holder can releasably secure the archery release aid for right and/or left handed shooters.

10. The archery release aid holder of claim 1, further comprising a mounting bracket adapted to secure between a stabilizer and a riser of the bow.

11. The archery release aid holder of claim 1, further comprising a strap wall extending from the bottom side of the holder and parallel to the side walls, wherein the strap wall includes a hole and a peg for a strap to further secure the archery release aid to the holder.

12. The archery release aid holder of claim 1, wherein the archery release aid is a handheld archery release aid.

* * * * *